US011931866B2

(12) United States Patent
Odeh

(10) Patent No.: US 11,931,866 B2
(45) Date of Patent: Mar. 19, 2024

(54) GRINDING WHEEL ASSEMBLY

(71) Applicants: SAINT-GOBAIN ABRASIVES, INC., Worcester, MA (US); SAINT-GOBAIN ABRASIFS, Conflans-Sainte-Honorine (FR)

(72) Inventor: Samuel H. Odeh, Greer, SC (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 46 days.

(21) Appl. No.: 16/656,915

(22) Filed: Oct. 18, 2019

(65) Prior Publication Data

US 2020/0122299 A1 Apr. 23, 2020

Related U.S. Application Data

(60) Provisional application No. 62/868,143, filed on Jun. 28, 2019, provisional application No. 62/748,099, filed on Oct. 19, 2018.

(51) Int. Cl.
*B24D 5/02* (2006.01)
*B24D 5/16* (2006.01)

(52) U.S. Cl.
CPC ..... *B24D 5/02* (2013.01); *B24D 5/16* (2013.01)

(58) Field of Classification Search
CPC ... B24D 5/02; B24D 5/04; B24D 5/16; B24D 5/08; B24D 5/066; B24D 5/00; B24D 2201/00; B24D 13/20; B24B 23/022; B24B 23/02; B24B 23/00; B24B 45/00; B24B 45/003; B24B 45/006
USPC ..... 451/541
See application file for complete search history.

(56) References Cited

U.S. PATENT DOCUMENTS

| | | | | |
|---|---|---|---|---|
| 1,404,339 | A | 1/1922 | Bockshe | |
| 2,155,037 | A | 4/1939 | Leopold | |
| 2,268,599 | A | 1/1942 | Kinney et al. | |
| 2,269,799 | A * | 1/1942 | Upson | F04D 29/263 464/89 |
| 2,746,217 | A | 5/1956 | Breisch | |
| 3,068,664 | A * | 12/1962 | Tocci-Guilbert | B24B 45/00 464/89 |
| 3,122,628 | A | 2/1964 | Inoue | |

(Continued)

FOREIGN PATENT DOCUMENTS

| | | |
|---|---|---|
| CN | 101715382 A | 5/2010 |
| CN | 201950580 U | 8/2011 |

(Continued)

OTHER PUBLICATIONS

Neoprene Wikipedia Summary (Year: 2017).*

(Continued)

*Primary Examiner* — Joel D Crandall
*Assistant Examiner* — Makena S Markman
(74) *Attorney, Agent, or Firm* — Abel Schillinger, LLP; Arpan Ghosh

(57) ABSTRACT

An abrasive tool comprises an arbor having a body formed with an internal bore, a mounting plate disposed on the arbor, a cover plate, an abrasive article disposed between the mounting plate and the cover plate, and at least one internal resilient member disposed within the internal bore of the arbor.

20 Claims, 32 Drawing Sheets

(56) References Cited

U.S. PATENT DOCUMENTS

| | | | | |
|---|---|---|---|---|
| 3,353,306 | A | 11/1967 | Seymour et al. | |
| 3,635,272 | A | 1/1972 | Scheffer | |
| 3,746,330 | A | 7/1973 | Taciuk | |
| 3,751,176 | A | 8/1973 | Von Hollen | |
| 3,947,009 | A | 3/1976 | Nelmark | |
| 4,135,847 | A | 1/1979 | Hemmings | |
| 4,597,227 | A * | 7/1986 | Gentischer | B24B 45/006 451/342 |
| 4,729,193 | A | 3/1988 | Gant et al. | |
| 4,809,465 | A * | 3/1989 | Mushardt | B24B 45/00 451/340 |
| 4,850,154 | A | 7/1989 | Grammer et al. | |
| 5,157,873 | A * | 10/1992 | Rudolf | B24B 23/022 279/904 |
| 5,349,786 | A * | 9/1994 | Dorrah | B24B 23/03 451/357 |
| 5,494,368 | A | 2/1996 | Matthews | |
| 5,865,571 | A | 2/1999 | Tankala et al. | |
| 5,961,255 | A | 10/1999 | Korbonski | |
| 6,227,188 | B1 | 5/2001 | Tankala et al. | |
| 6,283,845 | B1 | 9/2001 | Fischbacher et al. | |
| 6,569,001 | B2 * | 5/2003 | Rudolf | B24B 23/02 451/344 |
| 6,663,481 | B2 * | 12/2003 | Nauche | B24B 9/14 451/541 |
| 6,769,964 | B2 | 8/2004 | Tunstall | |
| 6,988,941 | B2 | 1/2006 | Saunier et al. | |
| 7,186,172 | B1 | 3/2007 | Ohata | |
| 7,192,338 | B2 * | 3/2007 | Kausch | B24D 5/16 451/514 |
| 7,344,435 | B2 * | 3/2008 | Pollak | B27B 5/32 451/342 |
| 7,621,801 | B2 | 11/2009 | Himmelsbach | |
| 8,231,438 | B2 * | 7/2012 | Kuhnle | B24B 45/00 451/359 |
| 8,607,435 | B2 | 12/2013 | Yeh et al. | |
| 8,858,301 | B2 * | 10/2014 | Reid | B27B 5/30 451/359 |
| 9,997,000 | B2 | 6/2018 | Kimura et al. | |
| 10,040,160 | B2 | 8/2018 | Zandonella Necca et al. | |
| 10,898,989 | B2 | 1/2021 | Li | |
| 2002/0004362 | A1 | 1/2002 | Lubke | |
| 2004/0023599 | A1 | 2/2004 | Tunstall | |
| 2006/0159545 | A1 | 7/2006 | Humpert et al. | |
| 2007/0141970 | A1 | 6/2007 | MacKay | |
| 2009/0017736 | A1 | 1/2009 | Block et al. | |
| 2009/0305614 | A1 * | 12/2009 | Nauche | B24B 9/146 451/43 |
| 2011/0229278 | A1 | 9/2011 | Sjöö | |
| 2011/0281508 | A1 | 11/2011 | Reid | |
| 2012/0301240 | A1 | 11/2012 | Jäger et al. | |
| 2013/0004250 | A1 | 1/2013 | Gamble | |
| 2013/0217315 | A1 | 8/2013 | Wiand et al. | |
| 2017/0239841 | A1 | 8/2017 | Rifaut | |
| 2018/0290264 | A1 | 10/2018 | Li | |

FOREIGN PATENT DOCUMENTS

| | | | |
|---|---|---|---|
| CN | 102601455 | A | 7/2012 |
| CN | 106181650 | A | 12/2016 |
| DE | 1088408 | B | 9/1960 |
| DE | 2851737 | A1 | 7/1980 |
| DE | 4301048 | A1 | 7/1994 |
| DE | 20315796 | U1 | 2/2004 |
| JP | S59118376 | A | 7/1984 |
| JP | H071342 | A | 1/1995 |
| JP | H09155736 | A | 6/1997 |
| JP | 2001105310 | A | 4/2001 |
| JP | 2001105330 | A | 4/2001 |
| JP | 2002-200565 | A | 7/2002 |
| JP | 2003326515 | A | 11/2003 |
| JP | 2007-518578 | A | 7/2007 |
| JP | 2016209980 | A | 12/2016 |
| JP | 60-75504 | A | 2/2017 |
| KR | 1020020002385 | A | 1/2002 |
| KR | 1020070091354 | A | 9/2007 |
| KR | 1020170142723 | A | 12/2017 |
| WO | 9857771 | A1 | 12/1998 |
| WO | 2004062846 | A2 | 7/2004 |
| WO | 2008002145 | A1 | 1/2008 |
| WO | 2012092093 | A1 | 7/2012 |
| WO | 2017147035 | A1 | 8/2017 |
| WO | 2018183724 | A1 | 10/2018 |

OTHER PUBLICATIONS

Material Data Sheet for PA 6.6 GF30, 2 pages, Schmidt + Bartl, DE.
International Search Report and Written Opinion for PCT/US2018/025215, dated Jul. 19, 2018, 12 pages.
International Search Report and Written Opinion for PCT/US2019/056888, dated Feb. 7, 2020.

* cited by examiner

GRINDING WHEEL ASSEMBLY

CROSS-REFERENCE TO RELATED APPLICATION(S)

This application claims priority under 35 U.S.C. § 119(e) to U.S. Provisional Patent Application No. 62/868,143, entitled "GRINDING WHEEL ASSEMBLY", by Samuel H. ODEH, filed Jun. 28, 2019, and this application claims priority under 35 U.S.C. § 119(e) to U.S. Provisional Patent Application No. 62/748,099, entitled "GRINDING WHEEL ASSEMBLY", by Samuel H. ODEH, filed Oct. 19, 2018, both of which are assigned to the current assignees hereof and incorporated herein by reference in their entireties.

FIELD OF THE DISCLOSURE

The present invention relates, in general, to grinding wheels and multi-piece grinding wheel assemblies.

BACKGROUND

Abrasive grinding wheels can be used to smooth and contour the edges of certain flat materials, e.g., sheets of glass, for safety and cosmetic reasons. Such abrasive grinding wheels may include diamond-containing abrasive wheels and may be used to shape the edges of materials for various industries, including but not limited to automotive, architectural, furniture, and appliance industries.

The industry continues to demand improved grinding wheel assemblies, particularly for applications of grinding the edges of flat materials.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
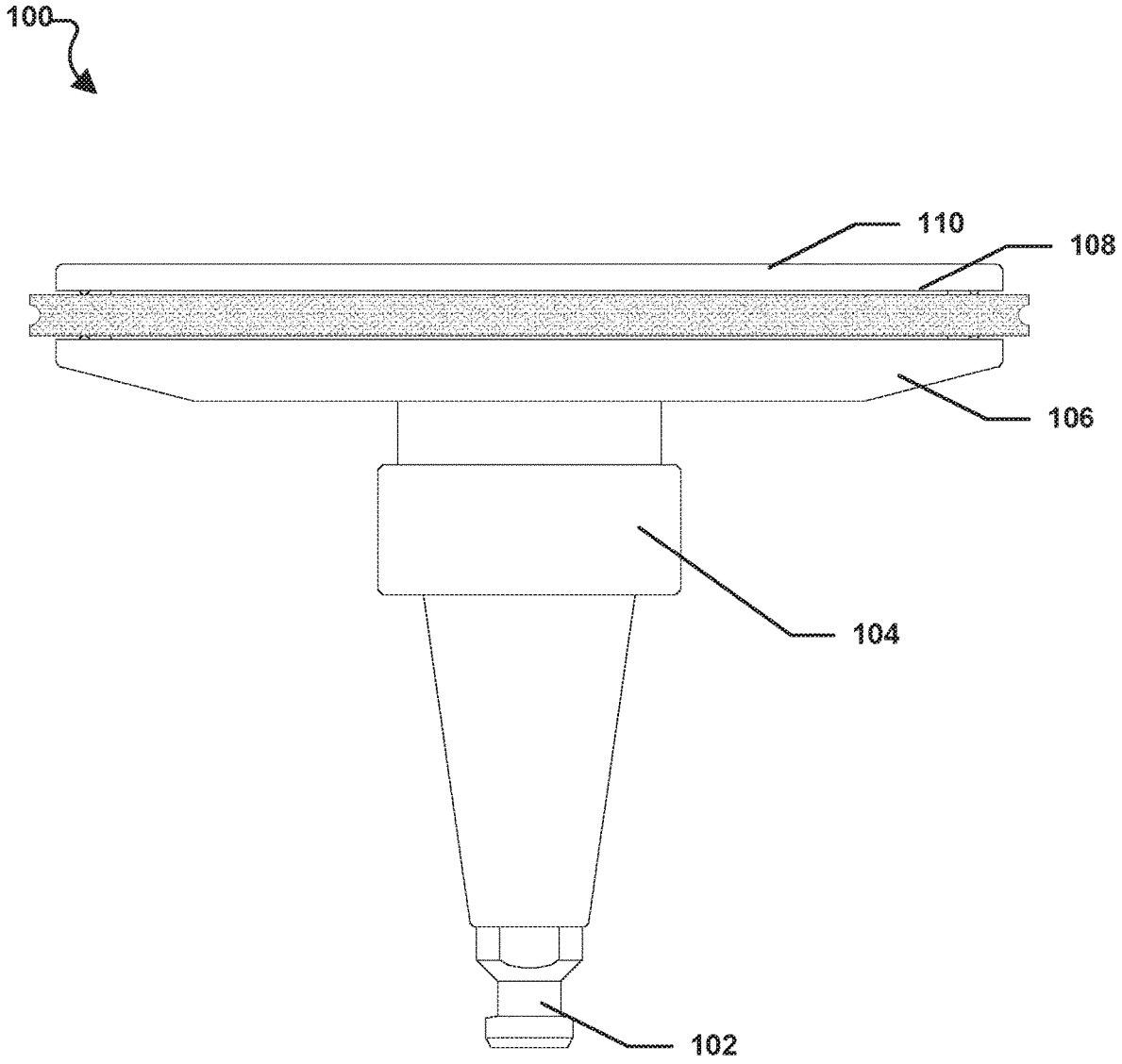
FIG. 1 includes an illustration of a side plan view of a grinding wheel assembly in accordance with an embodiment.
Figure 2:
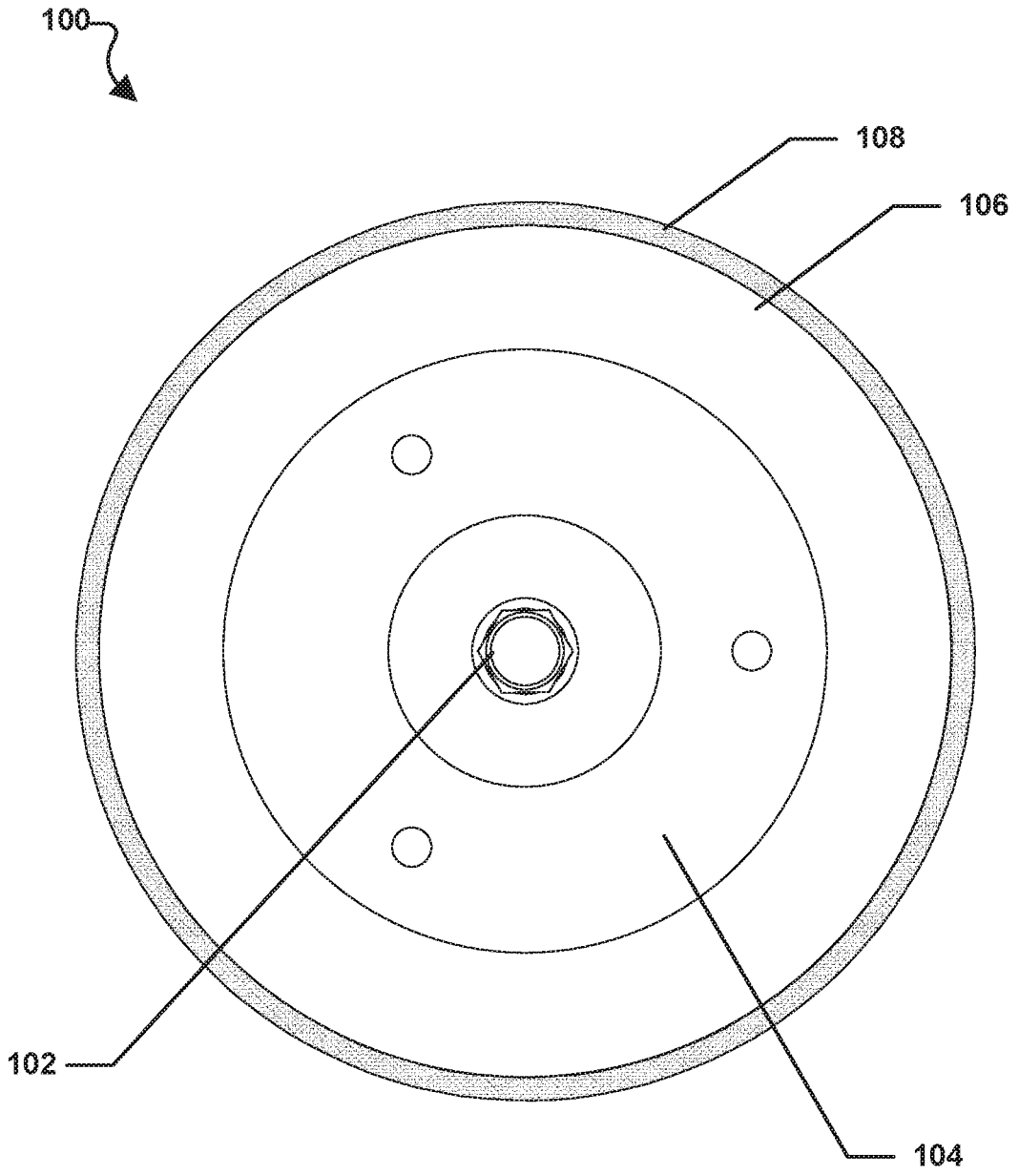
FIG. 2 includes an illustration of a bottom plan view of a grinding wheel assembly in accordance with an embodiment.
Figure 3:
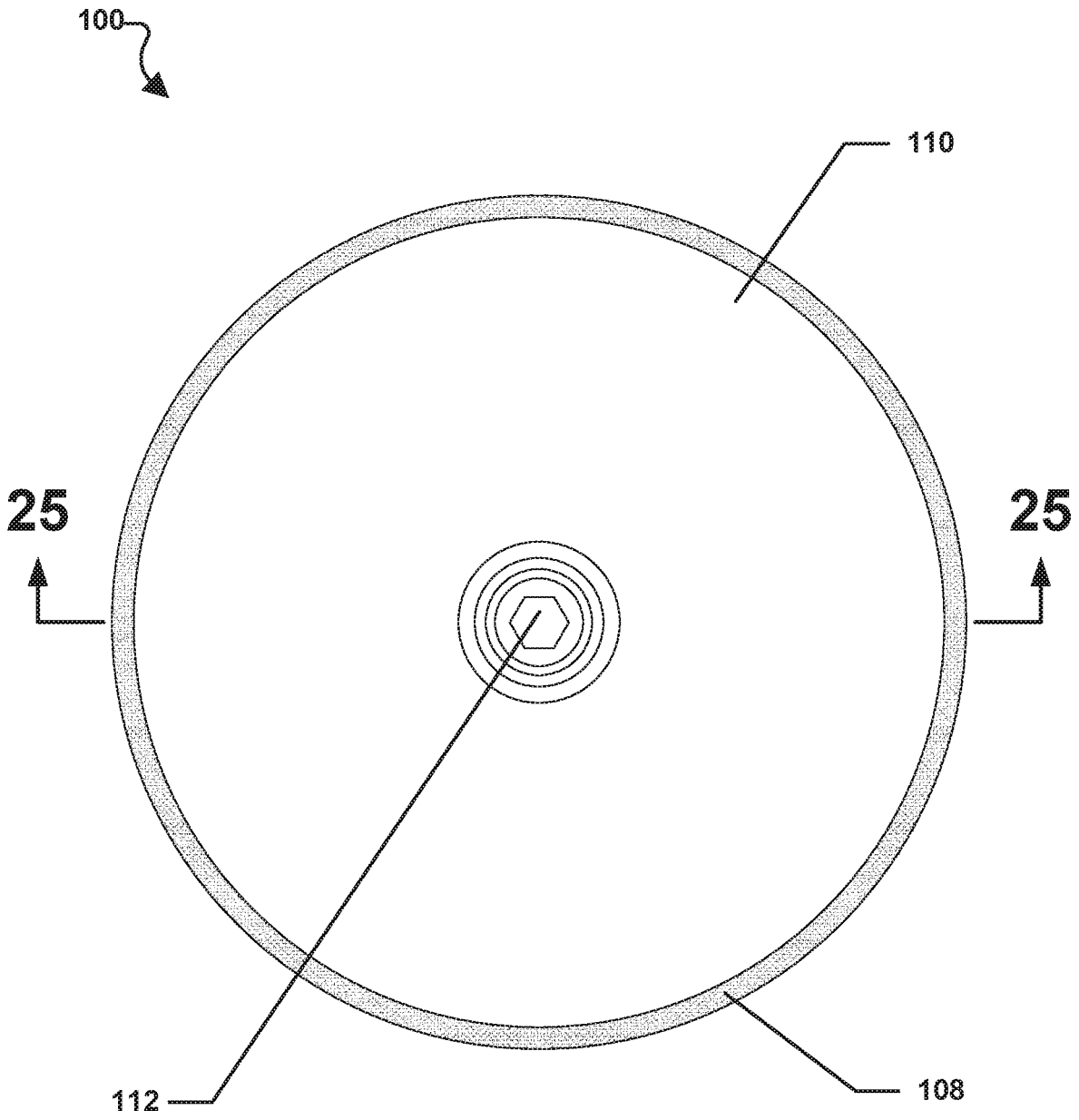
FIG. 3 includes an illustration of a top plan view of a grinding wheel assembly in accordance with an embodiment.

The following is generally directed to grinding wheel assemblies that are particularly suitable for grinding and smoothing the edges of brittle materials, such as glass.

Embodiments are directed to abrasive articles which may be in the form of grinding wheels. In one aspect, the grinding wheel assembly can include an arbor in which a pull stud can be installed. The arbor can further provide support for an abrasive body. For example, a mounting plate can be installed on the arbor and the abrasive body can be held between the mounting plate and a cover plate. The arbor can include a resilient member installed therein to facilitate vibration dampening through the center of the abrasive body and to act as a compressible object to ensure proper coupling of the various components of the grinding wheel assembly. The grinding wheel assembly can also include a single, central fastener that serves to couple the cover plate, the mounting plate, and the abrasive body to the arbor.

The grinding wheel assembly can be particular suitable for operations of grinding the edges of glass, such as automobile glass and flat glass. Further, the grinding wheel assembly can allow for relatively quicker removal and replacement of the abrasive body after the abrasive body is no longer useful. The pull stud, the arbor, the mounting plate, and the cover plate need not be replaced after the abrasive body is no longer useful.

Grinding Wheel Assembly

Referring initially to FIG. 1 through FIG. 4, an abrasive tool, i.e., a grinding wheel assembly is illustrated and is generally designated 100. As shown, the grinding wheel assembly 100 can include a pull stud 102, an arbor 104, a mounting plate 106, an abrasive article 108, a cover plate 110, and at least one fastener 112, e.g., a threaded fastener. A socket head cap screw is illustrated in the FIGs., but it is to be understood that any other type of threaded fastener may be used. The pull stud 102, the arbor 104, the mounting plate 106, and the cover plate 110 can include a metal or a metal alloy. For example, the metal can be stainless steel or titanium. Further, the metal can include a hardened metal, such as hardened steel. It is to be understood that the material utilized for the pull stud 102, the arbor 104, the mounting plate 106, and the cover plate 110 will minimize wearing of these elements during use. The abrasive article 108, however, will wear during grinding operations performed on the edges of various workpieces. After the abrasive article 108 is sufficiently worn, the abrasive article 108 may be removed and replace with a new abrasive body. Alternatively, the abrasive article 108 may be removed and the outer periphery of the abrasive article 108 may be reground. Thereafter, the abrasive article 108 may be reinstalled and used to perform further grinding operations.

Figure 4:
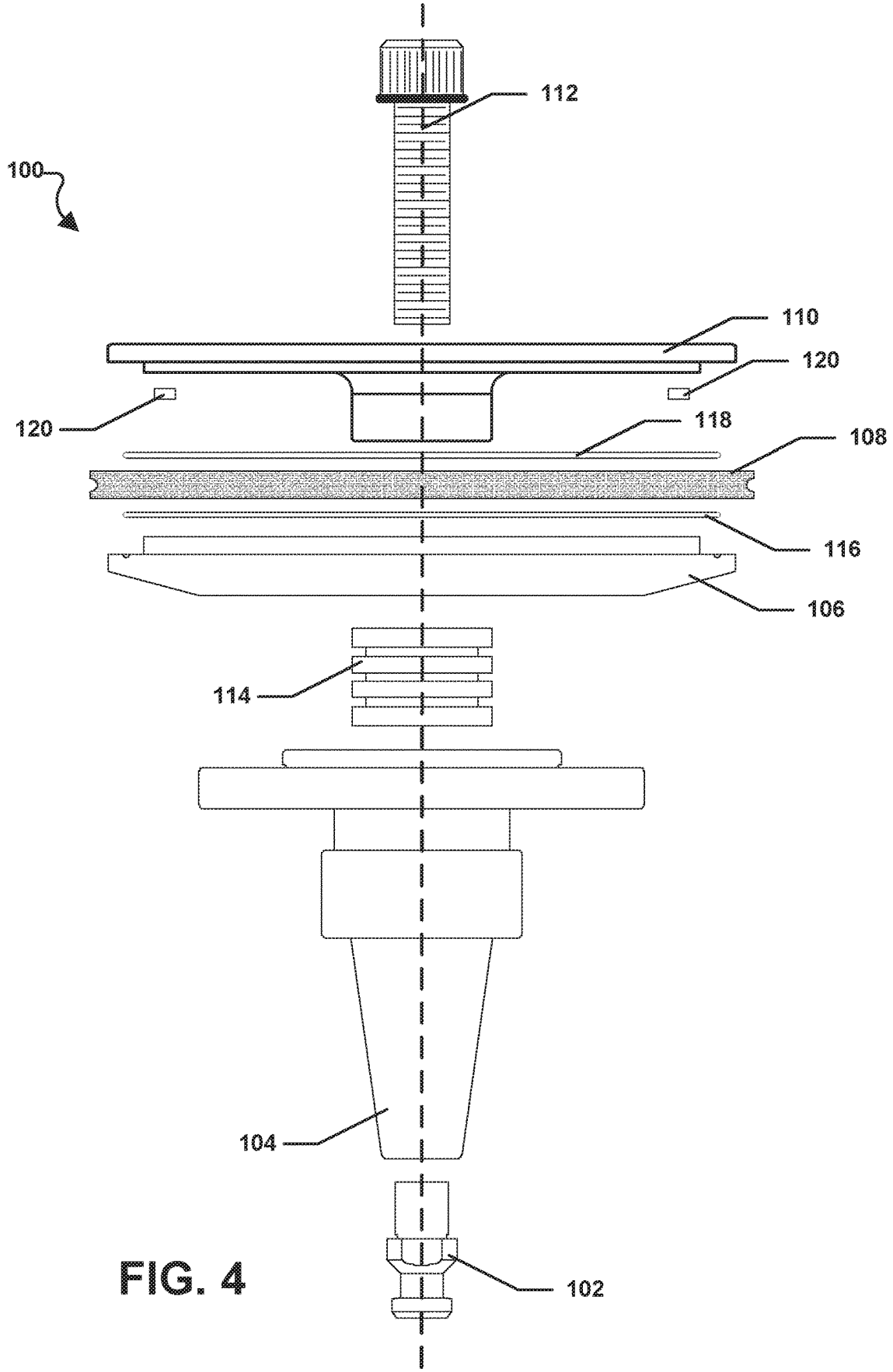
FIG. 4 includes an illustration of an exploded side plan view of a grinding wheel assembly in accordance with an embodiment.

FIG. 4 indicates that the grinding wheel assembly 100 can further include a first resilient member 114 that can be installed within the arbor 104 of the grinding wheel assembly 100, described in greater detail below. The first resilient member 114 can be considered an internal resilient member because it is installed within the arbor 104 of the grinding wheel assembly 100. Moreover, the grinding wheel assembly 100 can include a second resilient member 116 and a third resilient member 118 can be installed adjacent to the abrasive article 108 within the mounting plate 106 and the cover plate 110, respectively. The second and third resilient members 116, 118 can be considered external resilient members because they are not installed within the arbor 104 of the grinding wheel assembly 100.

In a particular aspect, the resilient members 114, 116, 118 can be a polymer. Further, the internal resilient member can be an elastomer. In another aspect, the internal resilient member comprises polychloroprene. Further, still the internal resilient member comprises a neoprene spring rubber and the neoprene spring rubber consists essentially of rubber, and more specifically, consists essentially of polychloroprene (e.g., neoprene). In another aspect, the internal resilient member can have a hardness of at least 50 as measured according to Shore A durometer. Moreover, the internal resilient member can have a hardness of at least 55, at least 60, at least 65, or at least 70. Further still the internal resilient member can have a hardness of not greater than 100, not greater than 90, not greater than 80, or not greater than 75. FIG. 4 also shows that the grinding wheel assembly 100 can also include at least one balancing weight 120 that can be installed within the cover plate 110.

Arbor

FIG. 5 through FIG. 8 illustrate the details of the arbor 104. As shown, the arbor 104 can include a body 500 that can define a proximal end 502 and a distal end 504. The body 500 of the arbor 104 can include a generally frustoconical drive shaft 506 that can extend from the proximal end 502 of the body 500 to a central flange 508 that extends outwardly from the body 130. Further, the body 500 of the arbor 104 can include an adapter plate 510 that can extend radially outward from the body 500 at, or near, the distal end 504 of the body 500 of the arbor 104.

Figure 5:
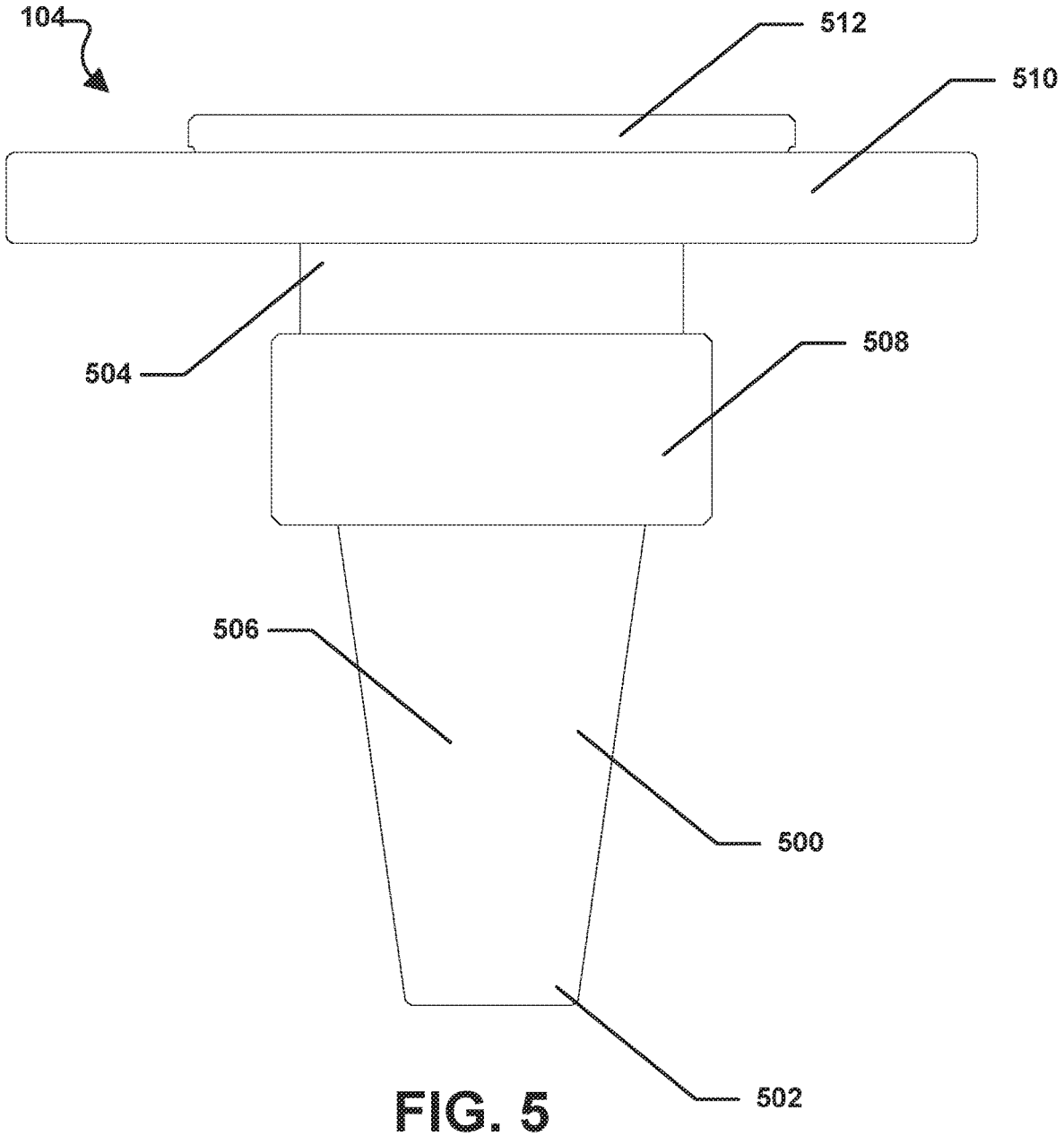
FIG. 5 includes an illustration of a side plan view of an arbor for a grinding wheel assembly in accordance with an embodiment.
Figure 7:
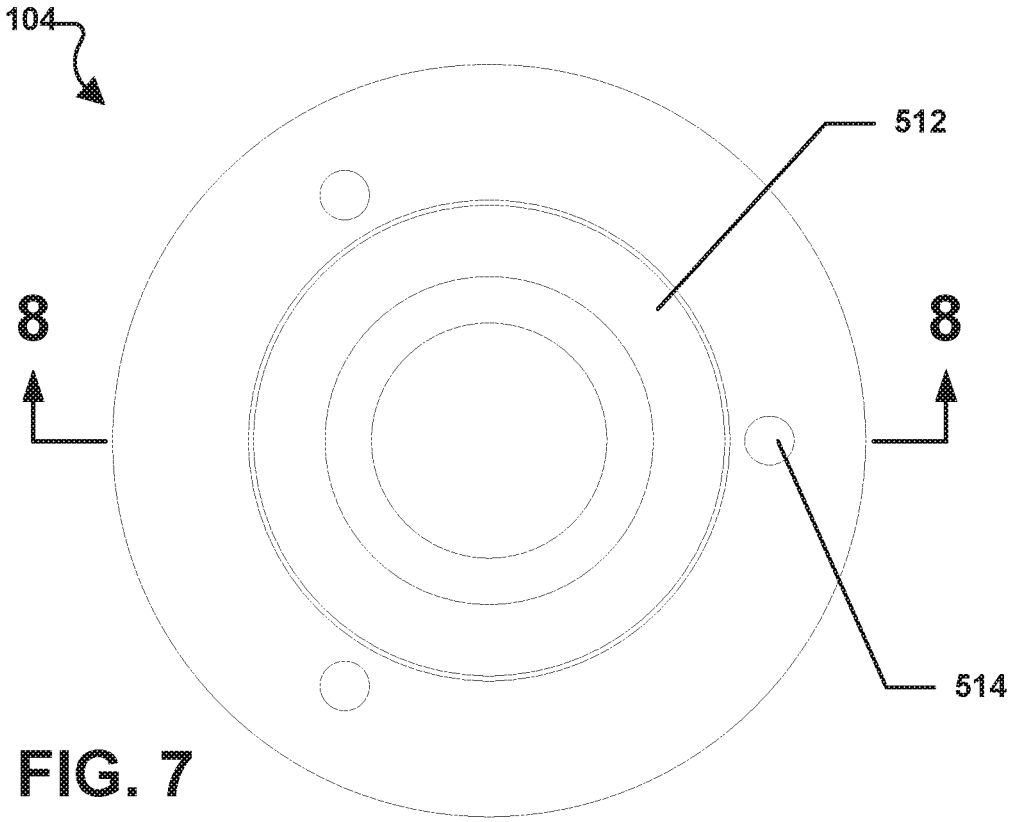
FIG. 7 includes an illustration of a top plan view of an arbor for a grinding wheel assembly in accordance with an embodiment.
Figure 8:
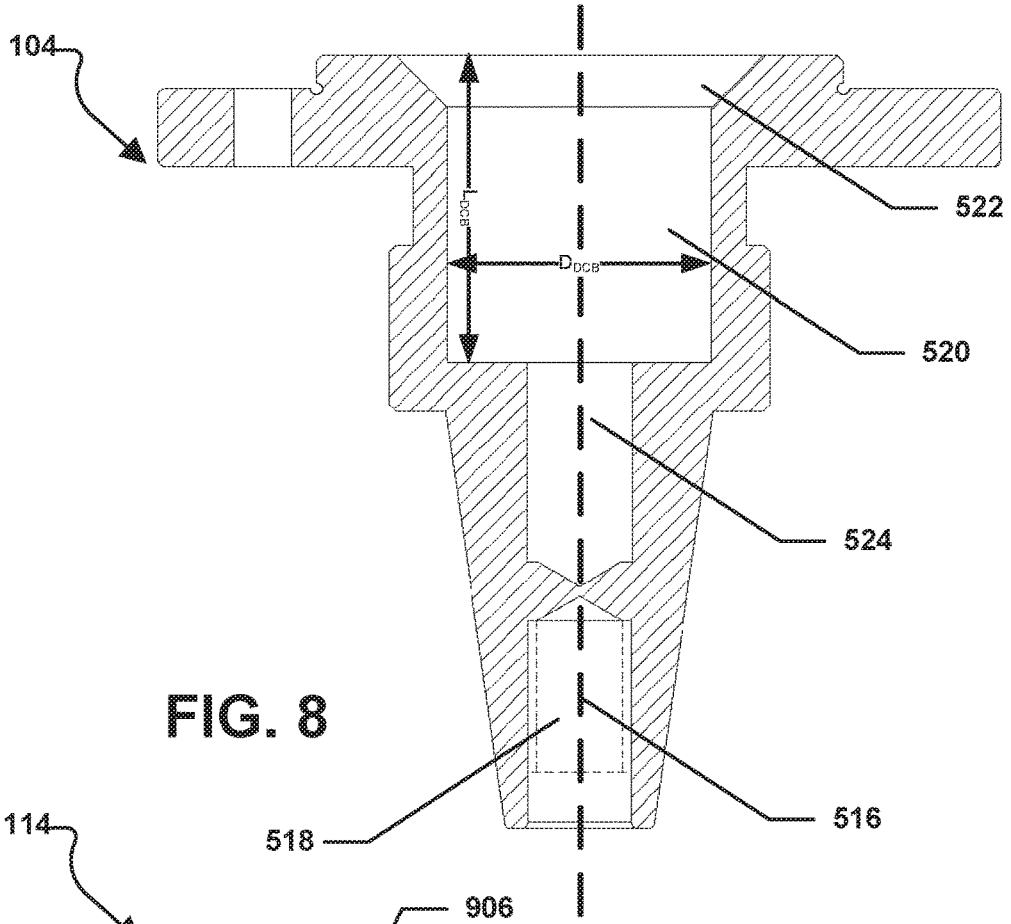
FIG. 8 includes an illustration of a cross-section view of an arbor for a grinding wheel assembly in accordance with an embodiment taken along line 8-8 in FIG. 6.

FIG. 5, FIG. 7, and FIG. 8 indicate that the adapter plate 510 can include an adapter hub 512. The adapter hub 512 can be generally cylindrical and can extend axially away from the distal end 134 of the body 130 of the arbor 104, e.g., from a contact surface of the mounting plate, wherein the contact surface of the adapter plate 510 is configured to engage a portion of the mounting plate 106 (FIG. 1) and the adapter hub 512 is configured to receive the mounting plate 106 (FIG. 1) there around. In a particular aspect, the adapter hub 512 can be configured to receive and engage the mounting plate 106 (FIG. 1) as described in greater detail herein.

Figure 6:
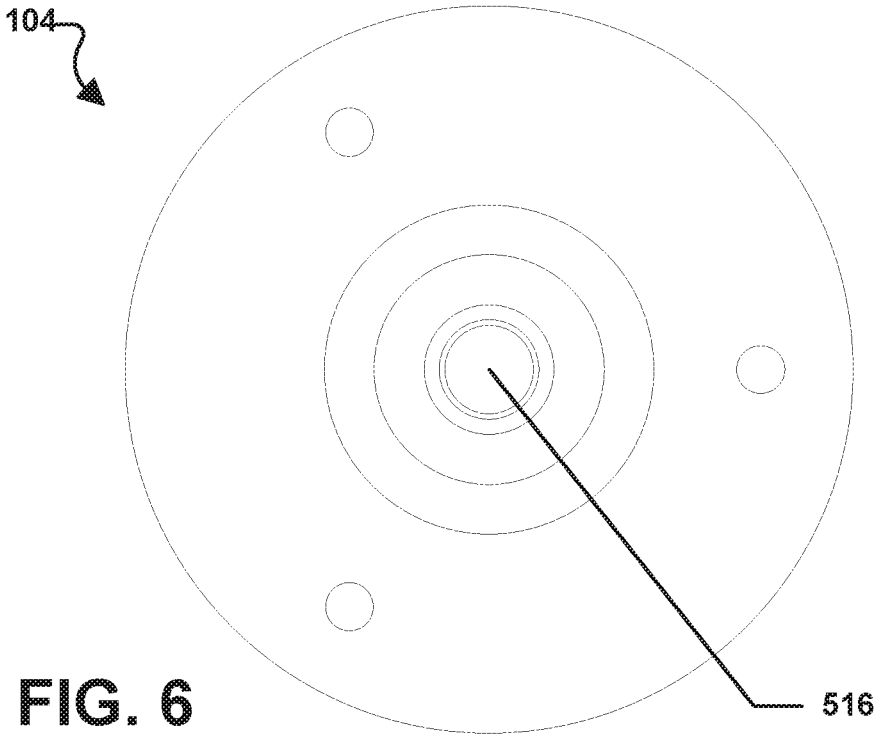
FIG. 6 includes an illustration of a bottom plan view of an arbor for a grinding wheel assembly in accordance with an embodiment.

As illustrated in FIG. 6 and FIG. 7, the adapter plate 510 of the arbor 104 can include at least one threaded bore 514 radially offset from a central axis 516.

FIG. 8 indicates that the body 500 of the arbor 104 can also include a proximal central bore 518 formed at, and extending into, the proximal end 502 of the body 500 of the arbor 104 along the central axis 516. Specifically, the proximal central bore 518 formed in the proximal end 502 of the body 500 of the arbor 104 can extend into the body 500 of the arbor 104 a predetermined length (depth). Moreover, the proximal central bore 518 can be formed with threads, i.e., screw threads, at least partially along the length of the proximal central bore 518. It can be appreciated that the proximal central bore 518 formed at the proximal end 502 of the body 500 of the arbor 104 can be configured to receive the pull stud 102, as previously shown in FIG. 1. More particularly, the proximal central bore 518 formed in the proximal end 502 of the body 500 of the arbor 104 can be configured to receive threads formed on the pull stud 102.

FIG. 8 further indicates that the body 500 of the arbor 104 can also include a distal central bore 520 formed at, and extending into, the distal end 504 of the body 500 of the arbor 104 along the central axis 516. Specifically, the distal central bore 520 formed in the distal end 504 of the body 500 of the arbor 104 can extend into the body 500 of the arbor 104 a predetermined length. As shown, the distal central bore 520 can be a smooth walled bore and an upper edge of the distal central bore 520 can be formed with an internal chamfer 522. In a particular aspect, the distal central bore 520 can be sized and shaped to removably engage a resilient member, described below.

Further, the distal central bore 520 can have a length, $L_{DCB}$, measured from the bottom of the distal central bore 520 to the top of the distal central bore 520 and an inner diameter, $ID_{DCB}$, measured in the lower straight walled portion of the distal central bore 522, i.e., not including the internal chamfer 522. In one aspect, $L_{DCB}$, can be greater than or equal to 30 millimeters (mm). Further, $L_{DCB}$ can be greater than or equal to 31 mm, such as greater than or equal to 32 mm, greater than or equal to 33 mm, greater than or equal to 34 mm, greater than or equal to 35 mm, greater than or equal to 36 mm, or greater than or equal to 37 mm. In another aspect, $L_{DCB}$ can be less than or equal to 55 mm, such as less than or equal to 50 mm, less than or equal to 45 mm, or less than or equal to 40 mm. It is to be understood that $L_{DCB}$ can be with a range between, and including, any of the values of $L_{DCB}$ described herein.

In another aspect, $ID_{DCB}$, can be greater than or equal to 20 millimeters (mm). Further, $ID_{DCB}$ can be greater than or equal to 21 mm, such as greater than or equal to 22 mm, greater than or equal to 23 mm, greater than or equal to 24 mm, or greater than or equal to 25 mm. In another aspect, $ID_{DCB}$ can be less than or equal to 40 mm, such as less than or equal to 35 mm, or less than or equal to 30 mm. It is to be understood that $ID_{DCB}$ can be with a range between, and including, any of the values of $ID_{DCB}$ described herein.

FIG. 8 further shows that the body 500 of the arbor 104 can be formed with a medial central bore 524 that extends into the body 500 of the arbor 104 along the central axis 516 from the bottom of the proximal central bore 520. The medial central bore 524 can be a threaded bore that is sized and shaped to receive the fastener 112.

Resilient Member

Figure 9:
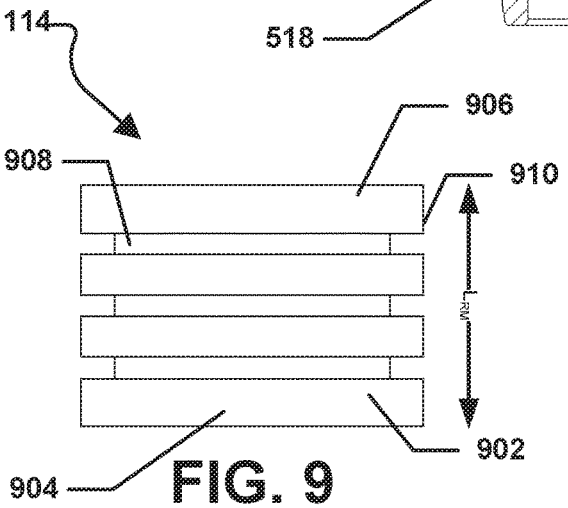
FIG. 9 includes an illustration of a side plan view of a resilient member for a grinding wheel assembly in accordance with an embodiment.
Figure 10:
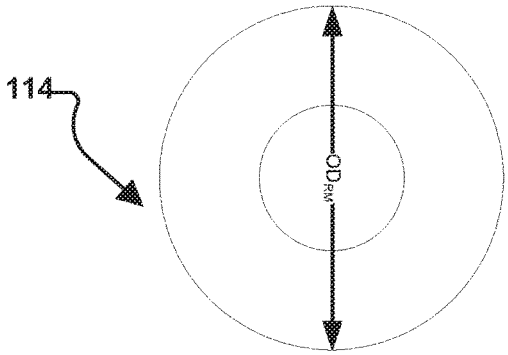
FIG. 10 includes an illustration of a top plan view of a resilient member for a grinding wheel assembly in accordance with an embodiment.
Figure 11:
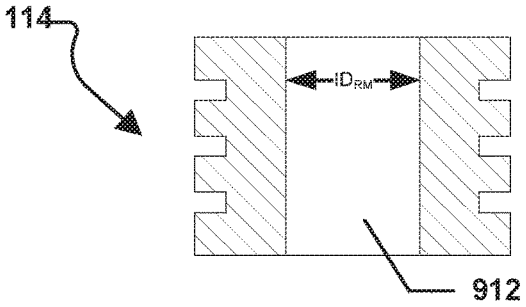
FIG. 11 includes an illustration of a cross-section view of a resilient member for a grinding wheel assembly in accordance with an embodiment taken along line 11-11 in FIG. 10.

FIG. 9 through FIG. 11 indicate that a first resilient member 114 that can be installed within the body 500 of the arbor 104. The first resilient member 114 can be considered a dampener, or dampening member, that acts on the fastener 112 when the grinding wheel assembly 100 is in the assembled state as described herein and used during grinding operations. A compressive force can be applied to the dampening member by the fastener 112 when the grinding wheel assembly 100 is in the assembled state. In a particular aspect, the first resilient member 114 can dampen vibrations that may emanate from a drive spindle of a tool that is used to drive the grinding wheel assembly 100. As shown, the first resilient member 114 can include a body 902 having a proximal end 904 and a distal end 906. The first resilient member 114 can include a plurality of grooves 908 formed in the body 902. Specifically, the grooves 908 can extend radially inward into the body 902 of the first resilient member 114 from an outer sidewall 910 of the body 902. As illustrated, the body 902 of the first resilient member 114 can be formed with three grooves 908. However, it can be appreciated that the body 902 of the first resilient member 114 can include one groove, two grooves, three grooves, four grooves, five grooves, six grooves, seven grooves, eight grooves, nine grooves, ten grooves, etc. In a particular aspect, the grooves 908 form a castellated pattern, or structure, in the outer sidewall 910 of the body 902 and can allow the first resilient member 114 to be compressed around and onto the fastener 112 when installed within the grinding wheel assembly 100, as shown and described below.

In a particular aspect, the first resilient member 114 can include an uncompressed length, $L_{RMU}$, measured from the top of the first resilient member 114 to the bottom of the first resilient member 114 while the first resilient member 114 is in an unassembled state and not subjected to any external compressive forces, e.g., those that occur when the first resilient member 114 is installed within the grinding wheel assembly 100 and the fastener 112 that extends therethrough is threadably engaged with the arbor 104. Further, the first resilient member 114 can be formed with an outer diameter, $OD_{RM}$, measured from the outer sidewall 910 to the outer sidewall 910 of the body 902 of the first resilient member 114 through the widest portion when the first resilient member 114 is not subjected to any external compressive forces. In one aspect, $L_{RMU}$, can be greater than or equal to 20 millimeters (mm). Further, $L_{RMU}$ can be greater than or equal to 21 mm, such as greater than or equal to 22 mm, greater than or equal to 23 mm, greater than or equal to 24 mm, or greater than or equal to 25 mm. In another aspect, $L_{RMU}$ can be less than or equal to 55 mm, such as less than or equal to 50 mm, less than or equal to 45 mm, or less than or equal to 40 mm. It is to be understood that $L_{RMU}$ can be with a range between, and including, any of the values of $L_{RMU}$ described herein.

In another aspect, $OD_{RM}$, can be greater than or equal to 25 millimeters (mm). Further, $OD_{RM}$ can be greater than or equal to 26 mm, such as greater than or equal to 27 mm, greater than or equal to 28 mm, greater than or equal to 29 mm, greater than or equal to 30 mm, or greater than or equal to 31 mm. In another aspect, $OD_{RM}$ can be less than or equal to 50 mm, such as less than or equal to 45 mm, or less than or equal to 40 mm. It is to be understood that $OD_{RM}$ can be with a range between, and including, any of the values of $OD_{RM}$ described herein.

Figure 25:
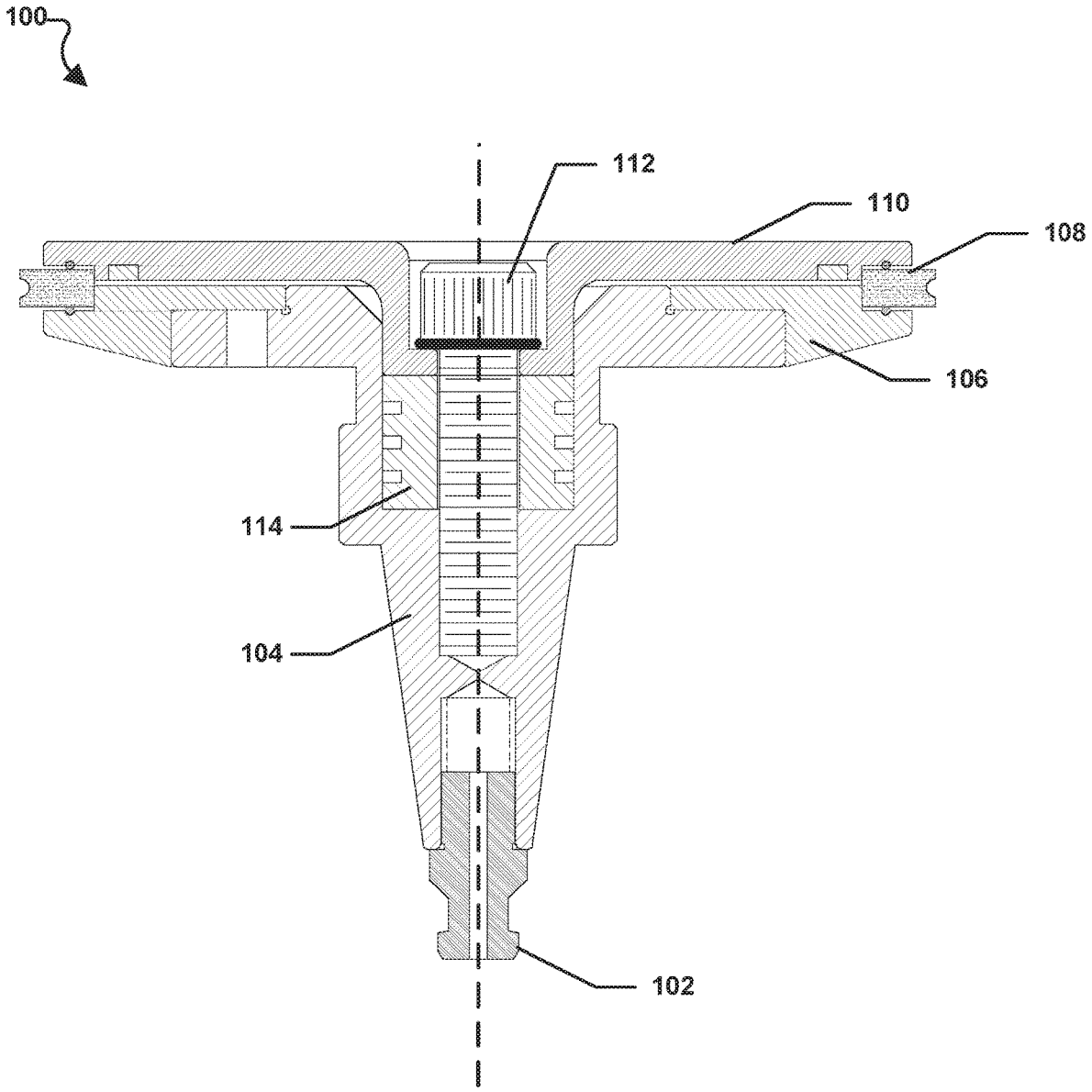
FIG. 25 includes an illustration of a cross-section view of a grinding wheel assembly in accordance with an embodiment taken along line 25-25 in FIG. 3.

In another aspect, the first resilient member 114 can also have a compressed length $L_{RMC}$, measured from the top of the first resilient member 114 to the bottom of the first resilient member 114 when installed within a grinding wheel assembly 100, as illustrated in FIG. 25, and compressed by the cover plate 110 and the fastener 112 when it is threaded into the medial central bore 524 formed in the body 500 of the arbor 104. In one aspect, $L_{RMC}$ can be less than or equal to 99% $L_{RMU}$. Further, $L_{RMC}$ can be less than or equal to 98% $L_{RMU}$, such as less than or equal to 97% $L_{RMU}$, less than or equal to 96% $L_{RMU}$, or less than or equal to 95% $L_{RMU}$. In another aspect, $L_{RMC}$ can be greater than or equal to 90% $L_{RMU}$, such as greater than or equal to 91% $L_{RMU}$, greater than or equal to 92% $L_{RMU}$, greater than or equal to 93% $L_{RMU}$, greater than or equal to 94% $L_{RMU}$, or greater than or equal to 95% $L_{RMU}$. It is to be understood that $L_{RMC}$ can be within a range between and including any of the minimum and maximum values of $L_{RMC}$ described herein.

In another aspect, $L_{RMU}$ can be less than $L_{DCB}$. For example, $L_{RMU}$ can be less than or equal to 90% $L_{DCB}$. Moreover, $L_{RMU}$ can be less than or equal to 85% $L_{DCB}$, such as less than or equal to 80% $L_{DCB}$, less than or equal to 75% $L_{DCB}$, or less than or equal to 70% $L_{DCB}$. Further, $L_{RMU}$ can be greater than or equal to 50% $L_{DCB}$, such as greater than or equal to 55% $L_{DCB}$, greater than or equal to 60% $L_{DCB}$, or greater than or equal to 65% $L_{DCB}$.

FIG. 10 and FIG. 11 show that the first resilient member 114 can also include a central bore 912 formed along the length of the body 902 of the first resilient member 114 from the distal end 904 of the body 902 of the first resilient member 114 to the proximal end 906 of the body 902 of the first resilient member 114 and circumscribed by an inner sidewall 914. As illustrated, the central bore 912 of the body 902 of the first resilient member 114 can have an inner diameter, $ID_{RM}$, measured from the inner sidewall 914 to the inner sidewall 914 through the largest width of the central bore 912 of the body 902 when the first resilient member 114 is not subjected to any external compressive forces. To allow the fastener 112 to pass through the first resilient member 114 during installation, but still allow the first resilient member 114 to engage the fastener 112 when compressed by the cover plate 110 and the fastener 112, the $ID_{RM}$ can be slightly larger than the outer diameter of the fastener 112, $OD_F$. For example, $ID_{RM}$ can be greater than or equal to 1.01 $OD_F$. Further, $ID_{RM}$ can be greater than or equal to 1.02 $OD_F$, such as greater than or equal to 1.03 $OD_F$, greater than or equal to 1.04 $OD_F$, greater than or equal to 1.05 $OD_F$, or greater than or equal to 1.06 $OD_F$. In another aspect, $ID_{RM}$ can be less than or equal to 1.10 $OD_F$, such as less than or equal to 1.09 $OD_F$, less than or equal to 1.08 $OD_F$, or less than or equal to 1.07 $OD_F$. It is to be understood that $ID_{RM}$ can be within a range between, and including, any of the minimum and maximum values of $ID_{RM}$ disclosed herein.

In another aspect, the first resilient member 114 can have an uncompressed outer diameter, $OD_{RMU}$, and $OD_{RMU}$ can be less than $ID_{DCB}$. For example, $OD_{RMU}$ can be less than or equal to 99.9% $ID_{DCB}$. Further, $OD_{RMU}$ can be less than or equal to 99.8% $ID_{DCB}$, such as less than or equal to 99.7% $ID_{DCB}$, less than or equal to 99.6% $ID_{DCB}$, or less than or equal to 99.5% $ID_{DCB}$. In another aspect, $OD_{RMU}$ can be greater than or equal to 99.0% $ID_{DCB}$, such as greater than or equal to 99.1% $ID_{DCB}$, greater than or equal to 99.2% $ID_{DCB}$, greater than or equal to 99.3% $ID_{DCB}$, or greater than or equal to 99.4% $ID_{DCB}$.

Mounting Plate

Figure 12:
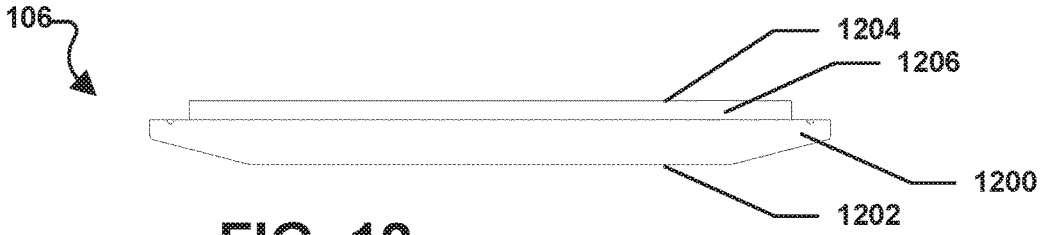
FIG. 12 includes an illustration of a side plan view of a mounting plate for a grinding wheel assembly in accordance with an embodiment.
Figure 13:
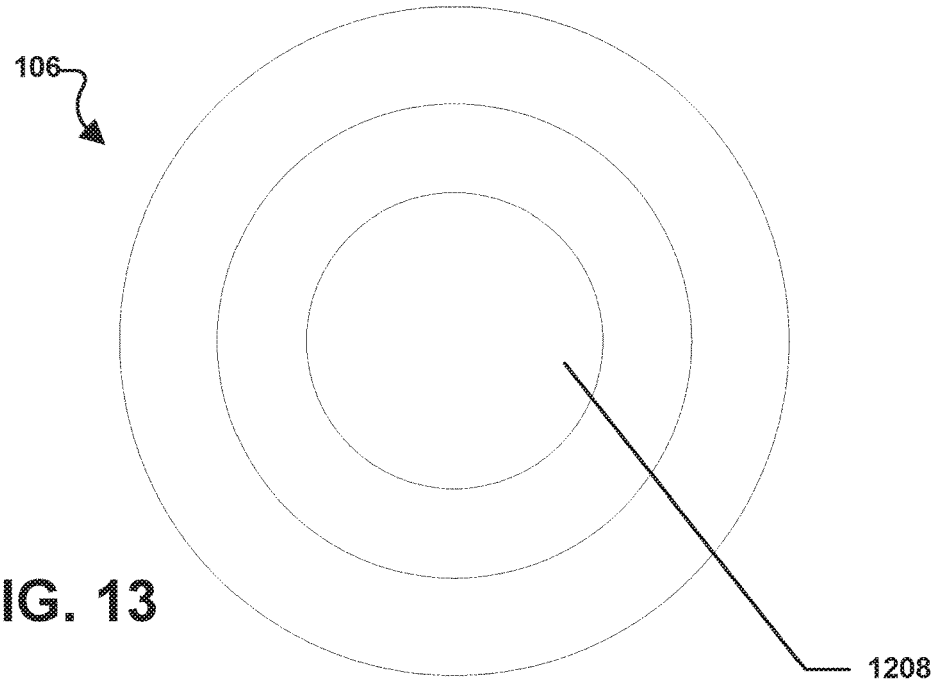
FIG. 13 includes an illustration of a bottom plan view of a mounting plate for a grinding wheel assembly in accordance with an embodiment.
Figure 14:
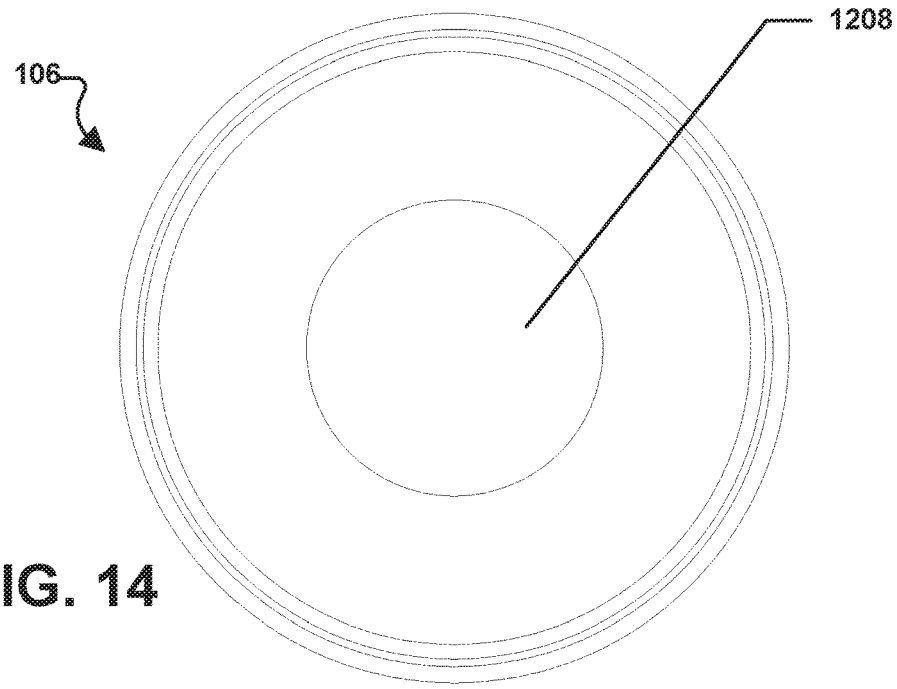
FIG. 14 includes an illustration of a top plan view of a mounting plate for a grinding wheel assembly in accordance with an embodiment.
Figure 15:
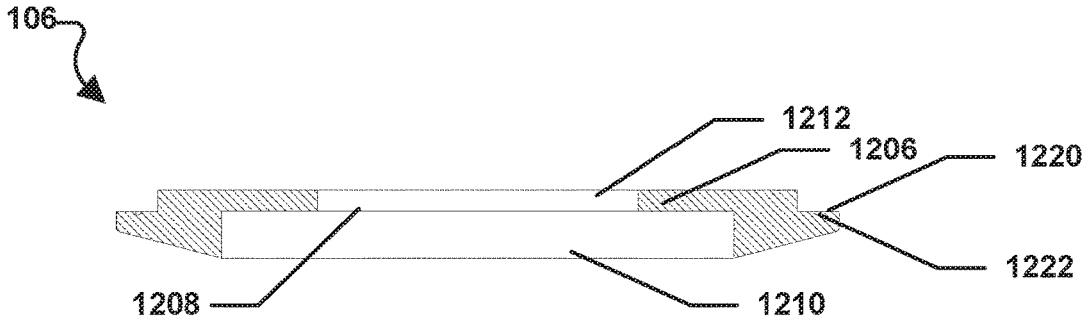
FIG. 15 includes an illustration of a cross-section view of a mounting plate for a grinding wheel assembly in accordance with an embodiment taken along line 15-15 in FIG. 14.

FIG. 12 through FIG. 15 illustrate the details of the mounting plate 106. As shown, the mounting plate 106 can include a body 1200 that is generally disk-shaped. Further, the body 1200 of the mounting plate 106 can include a proximal surface 1202 and a distal surface 1204. A generally cylindrical mounting hub 1206 can extend outwardly from the distal surface 1204 as indicated in FIG. 12 and FIG. 15. The mounting hub 1206 can be configured to extend into and support the abrasive article 108 when the grinding wheel assembly 100 is assembled, or in an assembled state, as indicated in FIG. 1.

As shown in FIG. 13, FIG. 14, and FIG. 15, the body 1200 of the mounting plate 106 can include a central bore 1208 extending through the mounting plate 106, i.e., between the proximal surface 1202 and the distal surface 1204. The central bore 1208 can be a smooth walled bore and can include a proximal portion 1210 and a distal portion 1212 that, together, are sized and shaped to fit over the adapter plate 140 and adapter hub 142 of the body 130 of the arbor 104, shown in FIG. 5. Specifically, the proximal portion 1210 of the bore 1208 formed in the mounting plate 106 can fit over and around the adapter plate 140 and the distal portion 1212 of the bore 1208 formed in the mounting plate 106 can fit over and around the adapter hub 142. Further, the mounting plate 106 can engage the arbor 104 in a slip fit.

FIG. 14 and FIG. 15 further indicate that the mounting plate 106 can include a central surface 1220 around the mounting hub 1206. Further, a groove 1222 can be formed in the central surface 1220 such that the groove 1222 circumscribes the mounting hub 1206 of the mounting plate 106. The groove 1222 can be generally semi-circular in cross-section and the groove 1222 can be configured to receive the second resilient member 116 described below.

Additional Resilient Members

Figure 16:
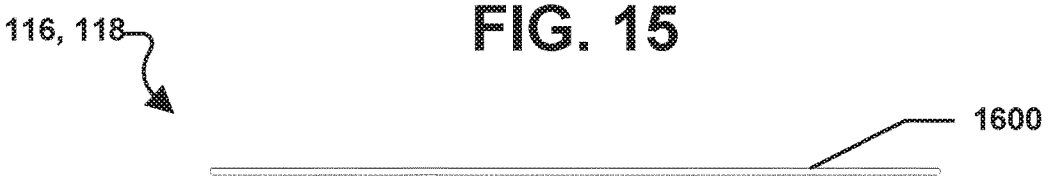
FIG. 16 includes an illustration of a side plan view of another resilient member for a grinding wheel assembly in accordance with an embodiment.
Figure 17:
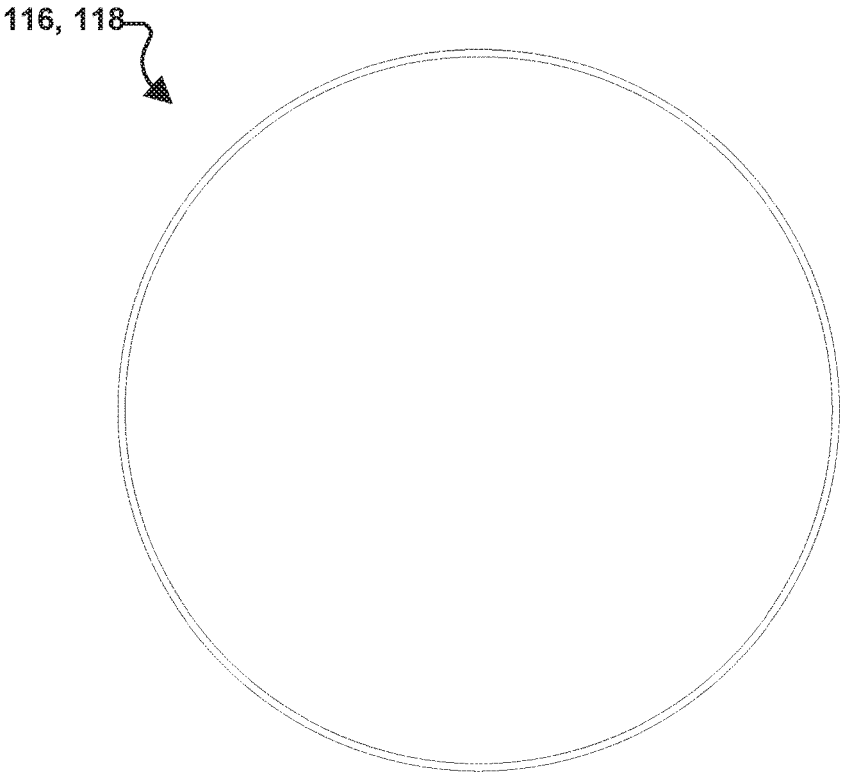
FIG. 17 includes an illustration of a top plan view of another resilient member for a grinding wheel assembly in accordance with an embodiment.

As illustrated in FIG. 16 and FIG. 17, the second resilient member 116 and the third resilient member 118 are substantially identical to each other. Further, the second and third resilient members 116, 118 can be O-rings made from an elastomeric, resilient material such as rubber, silicone, etc. As such, the second and third resilient members 116, 118 can have a generally toroidal body 1600 with a circular cross-section.

Abrasive Body

Figure 18:
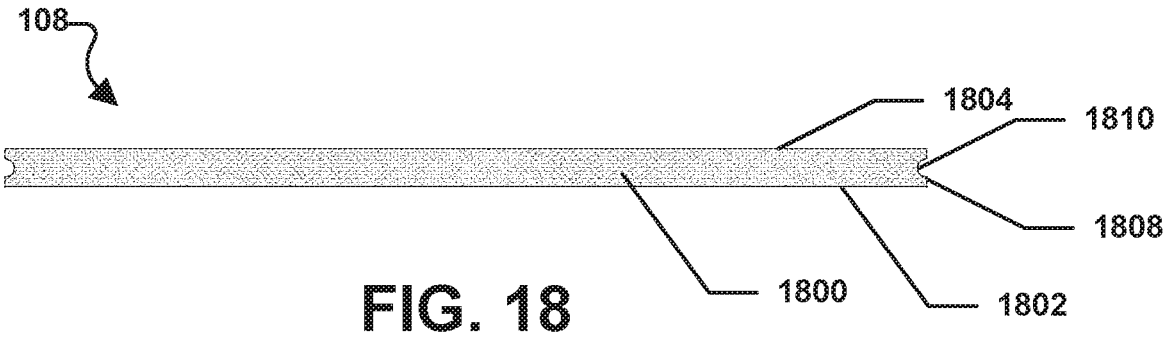
FIG. 18 includes an illustration of a side plan view of an abrasive body for a grinding wheel assembly in accordance with an embodiment.
Figure 19:
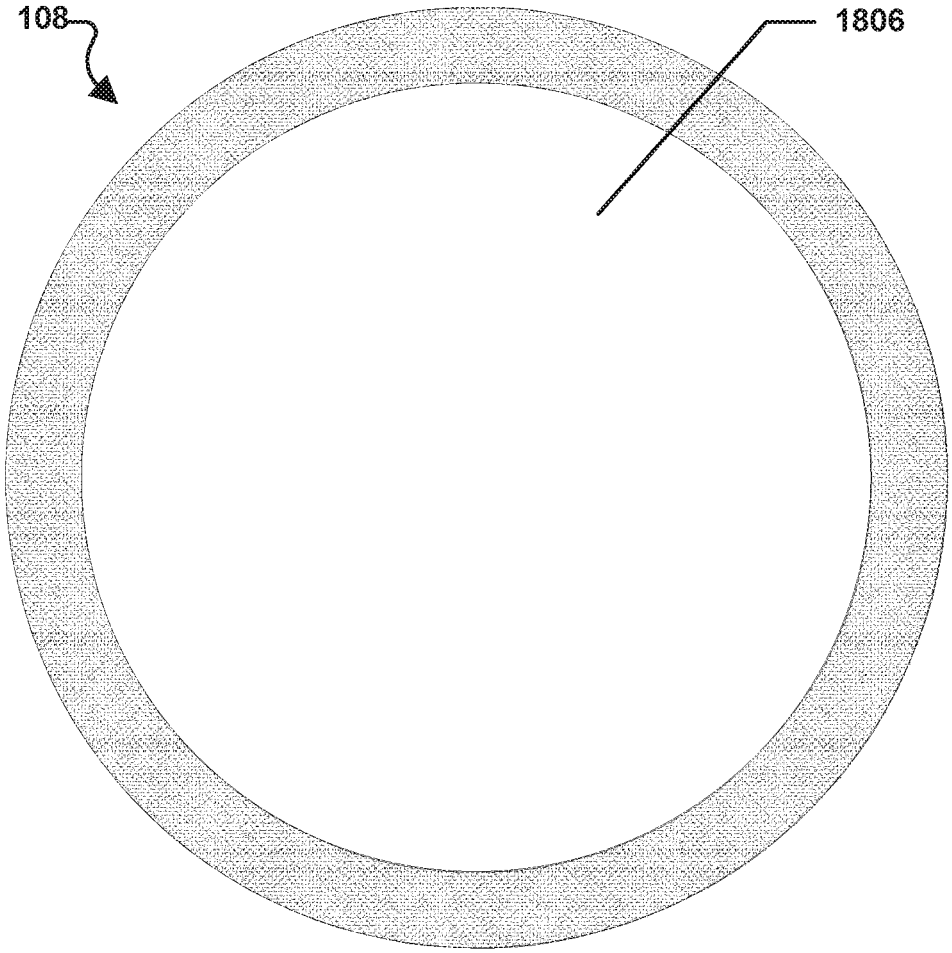
FIG. 19 includes an illustration of a top plan view of an abrasive body for a grinding wheel assembly in accordance with an embodiment.

Referring now to FIG. 18 and FIG. 19, details regarding the abrasive article 108 are shown. The abrasive article 108 can include a generally ring shaped body 1800 formed from an abrasive material. The body 1800 can include a proximal surface 1802 and a distal surface 1804. Further, the body 1800 of the abrasive article 108 can include a central bore 1806 that is sized and shaped to fit over the mounting hub 1206 of the mounting plate 106. Further, a support hub on the cover plate, described below, can also fit into the central bore 1806 of the body 1800 of the abrasive body 1802.

In a particular aspect, the abrasive material, from which the abrasive article 108 is formed, can include abrasive particles fixed in a bond material. Suitable abrasive particles can include, for example, oxides, carbides, nitrides, borides, diamond, cubic boron nitride, silicon carbide, boron carbide, alumina, silicon nitride, tungsten carbide, zirconia, or a combination thereof. In a particular aspect, the abrasive particles of the bonded abrasive are diamond particles. In at least one embodiment, the abrasive particles can consist essentially of diamond.

The abrasive particles contained in the bonded abrasive body can have an average particle size suitable to facilitate particular grinding performance. For example, the abrasive particles can have a size less than about 2000 μm, such as less than about 1000 μm, less than about 500 μm, or less than about 300 μm. In another aspect, the abrasive particles can have a size of at least 0.01 μm, such as at least 0.1 μm, at least about 1 μm, at least 5 μm or at least 10 μm. It will be appreciated that the size of the abrasive particles contained in the bonded abrasive can be within a range between any of the minimum and maximum values noted above, such as from about 0.01 μm to about 2000 μm, from about 1 μm to about 500 μm, from about 5 μm to about 300 μm or from about 50 μm to about 150 μm.

The bond material of the bonded abrasive body can include an inorganic material, an organic material or any combination thereof. Suitable inorganic materials for the use as bond material may include metals, glass, ceramics, glass-ceramics or any combination thereof. For example, an inorganic bond material can include one or more metal compositions or elements such as Cu, Sn, Fe, W, WC, Co or any combination thereof. Organic materials may include resins, for example thermosets, thermoplastics or any combination thereof. For example, some suitable resins can include phenolic resins, epoxies, polyesters, cyanate esters, shellacs, polyurethanes, rubber, polyimides or any combination thereof.

As illustrated in FIG. 16, the body 1800 of the abrasive article 108 can have outer peripheral surface 1808 that may have a profile 1810 ground therein. As shown, the profile 1810 may be concave, or U-shaped. However, in other aspects, the profile 1810 may be angular, or V-shaped. The profile 1810 of the outer peripheral surface 1808 of the body 1800 of the abrasive article 108 will be reproduced in reverse on the material to be shaped by the grinding wheel assembly 100.

The abrasive article 108 of the present disclosure may be selected from a range of suitable sizes to facilitate efficient grinding depending upon the workpiece. In one embodiment, the abrasive article 108 can include a diameter of at least about 25 mm, such as at least about 30 mm or at least about 50 mm. In another embodiment, the diameter may be not greater than 500 mm, such as not greater than 450 mm, not greater than 300 mm or not greater than 200 mm. It will be appreciated that the diameter can be within a range between any of the minimum and maximum values noted above, such as from about 25 mm to about 500 mm, from about 50 mm to about 250 mm, or from about 25 mm to about 150 mm.

Cover Plate

Figure 20:
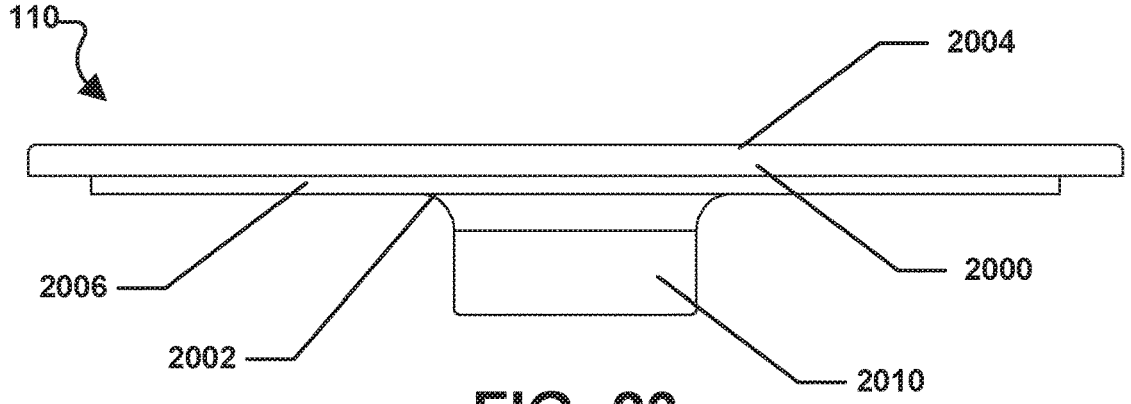
FIG. 20 includes an illustration of a side plan view of a cover plate for a grinding wheel assembly in accordance with an embodiment.
Figure 23:
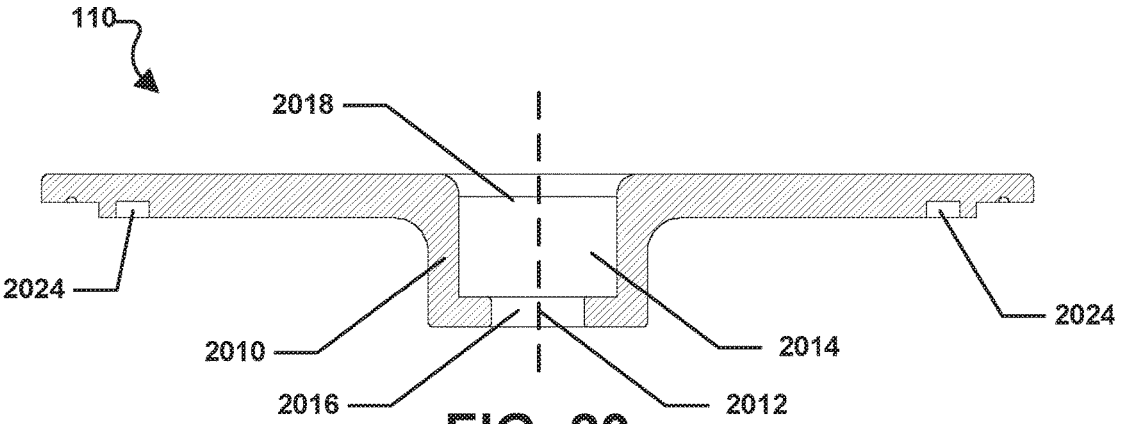
FIG. 23 includes an illustration of a cross-section view of a cover plate for a grinding wheel assembly in accordance with an embodiment taken along line 23-23 in FIG. 22.

FIG. 20 through FIG. 23 illustrate the details concerning the construction of the cover plate 110. The cover plate 110 can include a body 2000 that is generally disk-shaped. Further, the body 2000 of the cover plate 110 can include a proximal surface 2002 and a distal surface 2004. A generally cylindrical support hub 2006 can extend outwardly from the proximal surface 2002, in a downward direction, as indicated in FIG. 20 and FIG. 23. The support hub 2006 is configured to extend into and support the abrasive article 108 when the grinding wheel assembly 100 is assembled as shown in FIG. 1 and FIG. 25.

Figure 21:
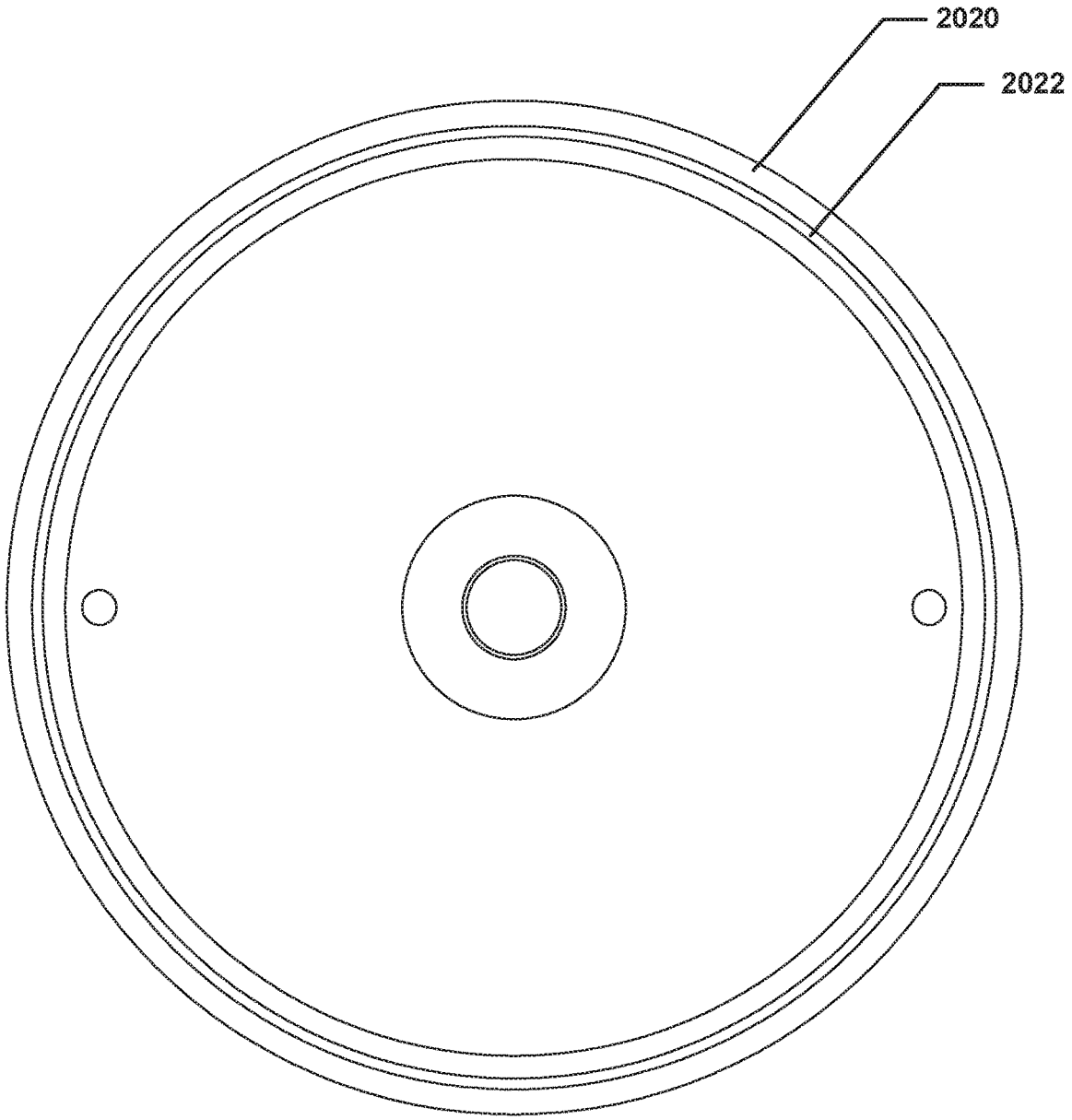
FIG. 21 includes an illustration of a bottom plan view of a cover plate for a grinding wheel assembly in accordance with an embodiment.
Figure 22:
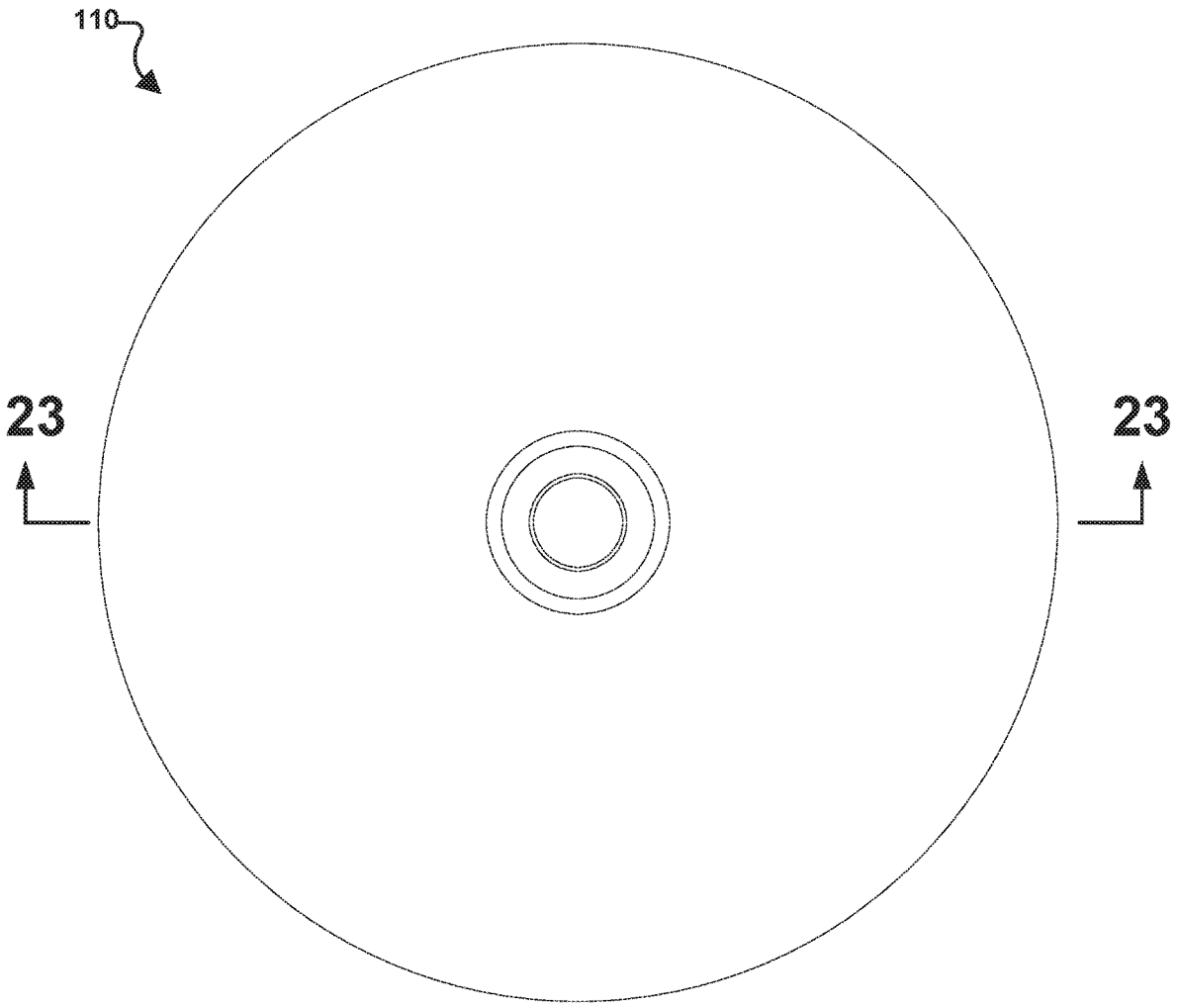
FIG. 22 includes an illustration of a top plan view of a cover plate for a grinding wheel assembly in accordance with an embodiment.

FIG. 20, FIG. 21, and FIG. 23 further show that the cover plate 110 can include a central engagement hub 2010 extending outwardly, in a downward direction, from the support hub 2006 along a central axis 2012. As shown in greater detail in FIG. 25, the engagement hub 2010 of the cover plate 110, when installed in the grinding wheel assembly 100, can extend through the abrasive article 108 and the mounting plate 106. Further, the engagement hub 2010 can extend into the distal central bore 520 of the body 500 of the arbor 104. The cover plate 110 can also include a central bore 2014 that extends through the cover plate 110, i.e., the body 2000 of the cover plate 110, the support hub 2006, and the engagement hub 2010, along the central axis 2012. The central bore 2014 can include a proximal portion 2016 that is sized and shaped to allow the fastener 112 to pass therethrough. Further, the central bore 2014 can include a distal portion 2018 that is sized and shaped to receive the head of the fastener 112, as shown in greater detail in FIG. 25.

FIG. 21 and FIG. 23 further illustrate that the cover plate 110 can include a central surface 2020 around the support hub 2006. The central surface 2020 can be substantially perpendicular to the central axis 2012. A groove 2022 can be formed in the central surface 2020 such that the groove 2022 circumscribes the support hub 2006 of the cover plate 110. The groove 2022 can be generally semi-circular in cross-section and the groove 2022 can be configured to receive the third resilient member 116 as shown in greater detail below. The cover plate 110 can also include at least one balancing weight bore 2024 formed in the surface of the support hub 2006. The balancing weight bore 2024 can be sized and shaped to receive the complementary shaped balancing weight 120, described above.

Assembled Grinding Wheel Assembly

Figure 24:
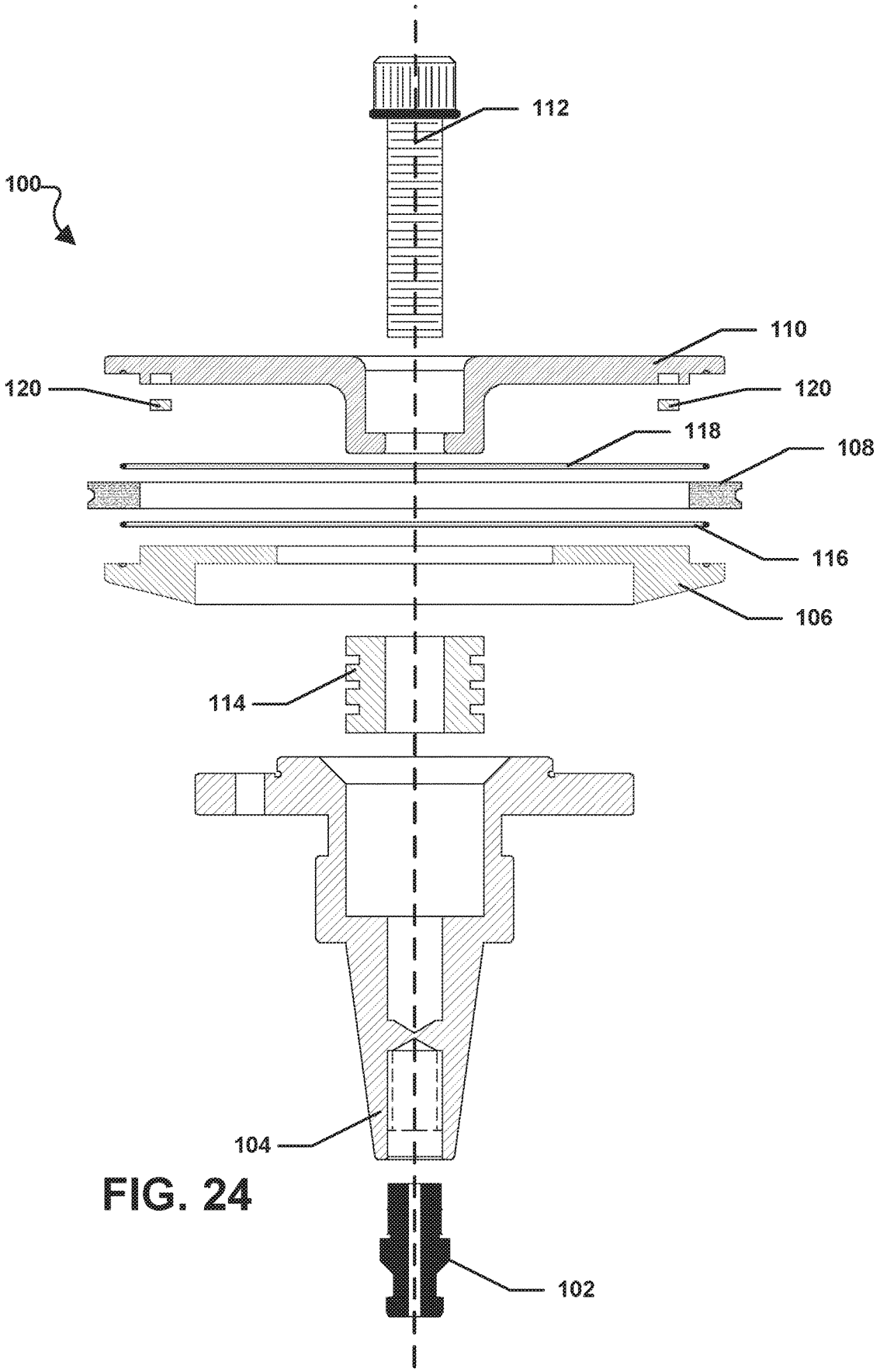
FIG. 24 includes an illustration of an exploded cross-section view of a grinding wheel assembly in accordance with an embodiment.

Referring now to FIG. 24 and FIG. 25, the grinding wheel assembly 100 is shown in an unassembled state, FIG. 24, and in an assembled state, FIG. 25. In the assembled state, shown in FIG. 25, the threads on the pull stud 102 can be inserted into, and engaged with, the proximal central bore 518 of the arbor 104. The mounting plate 106 can fit over the arbor 104. Specifically, the mounting plate 106 can fit over the adapter plate 510 and adapter hub 512 of the arbor 104 such that the central bore 1208 of the mounting plate 106 fits adapter plate 140 and adapter hub 142 of the body 130 of the arbor 104. In particular, the proximal portion 1210 of the central bore 1208 of the mounting plate 106 can fit over and around the adapter plate 140 and the distal portion 1212 of the central bore 1208 of the mounting plate 106 can fit over and around the adapter hub 142. In a particular aspect, the mounting plate 106 can engage the arbor 104 in a slip fit.

As shown in FIG. 25, the second resilient member 116 can fit into the groove 1222 formed in the mounting plate 106 and the abrasive article 108 can fit over the mounting plate 106 around the mounting hub 1206 of the mounting plate 106 and adjacent to the second resilient member 116. The abrasive article 108 can engage the mounting hub 1206 of the mounting plate 106 in a slip fit so that the abrasive article 108 can be relatively easily installed and removed from the mounting plate 106 and the grinding wheel assembly 100. FIG. 25 shows that the first resilient member 114 can be installed within the arbor 104 of the grinding wheel assembly 100

FIG. 25 shows that the first resilient member 114 can be installed within the arbor 104 of the grinding wheel assembly 100. Specifically, the first resilient member 114 can be installed within the distal central bore 520 formed in the body 500 of the arbor 104. Moreover, the first resilient member 114 can be installed within the distal central bore 520 prior to the installation of the mounting plate 106, the second resilient member 116, and the abrasive article 108. Alternatively, the first resilient member 114 can be installed after the mounting plate 106, the second resilient member 116, and the abrasive article 108.

After the mounting plate 106, the second resilient member 116, the abrasive article 108, and the first resilient member 114 are installed, as described above, the cover plate 110 with the third resilient member 118 installed therein can be installed over the mounting plate 106 so that the central engagement hub 2010 of the cover plate 110 extends through the abrasive article 108 and the mounting plate 106 and into the distal central bore 520 of the body 500 of the arbor 104. Thereafter, the fastener 112 can be installed and tightened. Specifically, the third resilient member 118 can be installed in the groove 2022 formed in the cover plate 110. Further, the fastener 1112 can be installed within the grinding wheel assembly 100 as illustrated in FIG. 25 and the fastener 112, i.e., the shank of the fastener, can extend through the central bore 2014 formed in the cover plate 100 and the central bore 912 formed in the first resilient member 114. Further, a portion of the threaded shank of the fastener 112 can engage the threads formed in the medial central bore 524 formed in the body 500 of the arbor 104. As the fastener 112 is tightened, the central engagement hub 2010 of the cover plate 110 can be drawn, or otherwise pulled, further into the arbor 104, i.e., further into the distal central bore 520 of the body 500 of the arbor 104.

As the fastener 112 is tightened and the central engagement hub 2010 moves further into the arbor 104, the first resilient member 114 can be compressed, i.e., by a compressive force provided by the fastener, so that the length of the first resilient member 114 is reduced. Specifically, the castellated pattern, or structure, formed by the grooves 908 in the outer sidewall 910 of the first resilient member 114 and the elastomeric material of the first resilient member 114 can allow the first resilient member 114 to be compressed, thereby reducing the overall length of the first resilient member 114 to one of the values of $L_{RMC}$ as described above. Further, the second and third resilient members 116, 118 adjacent to, or flanking, the abrasive article 108 can also be slightly compressed so that the cross-sectional shape of the second and third resilient members 116, 118 changes from a circular shape to an elliptical shape. The mounting plate 106 in conjunction with the cover plate 110 and the fastener 112 can hold the abrasive article 108 in place within the grinding wheel assembly 110. The second and third resilient members 116, 118 also help provide support for the abrasive article 108 and the abrasive article 108 can be keyed to the mounting plate 106, the cover plate 110, or both the mounting plate 106 and the cover plate 110 to prevent the abrasive article 108 from spinning with respect to the mounting plate 106.

In a particular aspect, the mounting plate 106 can be keyed to the arbor 104, e.g., to the adapter plate 510, adapter hub 512, or both the adapter plate 510 and the adapter hub 512, to prevent the mounting plate 106 from spinning relative to the arbor 104 during use. The resilient members 114, 116, 118 can substantially reduce vibration of the grinding wheel assembly 100 during use. More specifically, the first resilient member 114, installed within the arbor 104, as described herein, can facilitate vibration dampening through the center of the grinding wheel assembly 100 and can act as a compressible object to ensure proper coupling of the various components of the grinding wheel assembly 100. The single central fastener 112 simplifies assembly and disassembly of the grinding wheel assembly 100 and provides a compressive force, when properly tightened, on the first resilient member 114 to ensure proper assembly and engagement of the first resilient member 114 for vibration dampening.

Alternative Embodiment of a Grinding Wheel Assembly

Referring now to FIG. 26 through FIG. 34, another embodiment of a grinding wheel assembly is illustrated and is generally designated 2600. As shown, the grinding wheel assembly 2600 can include a pull stud 2602, an arbor 2604, a mounting plate 2606, an abrasive article 2608, a cover plate 2610, and at least one fastener 2612, e.g., a threaded fastener. A socket head cap screw is illustrated in the FIGs., but it is to be understood that any other type of threaded fastener may be used. The pull stud 2602, the arbor 2604, the mounting plate 2606, and the cover plate 2610 can include a metal or a metal alloy. For example, the metal can be stainless steel or titanium. Further, the metal can include a hardened metal, such as hardened steel. It is to be understood that the material utilized for the pull stud 2602, the arbor 2604, the mounting plate 2606, and the cover plate 2610 will minimize wearing of these elements during use. The abrasive article 2608, however, will wear during grinding operations performed on the edges of various workpieces. After the abrasive article 2608 is sufficiently worn, the abrasive article 2608 may be removed and replace with a new abrasive body. Alternatively, the abrasive article 2608 may be removed and the outer periphery of the abrasive article 2608 may be reground. Thereafter, the abrasive article 2608 may be reinstalled and used to perform further grinding operations.

Figure 34:
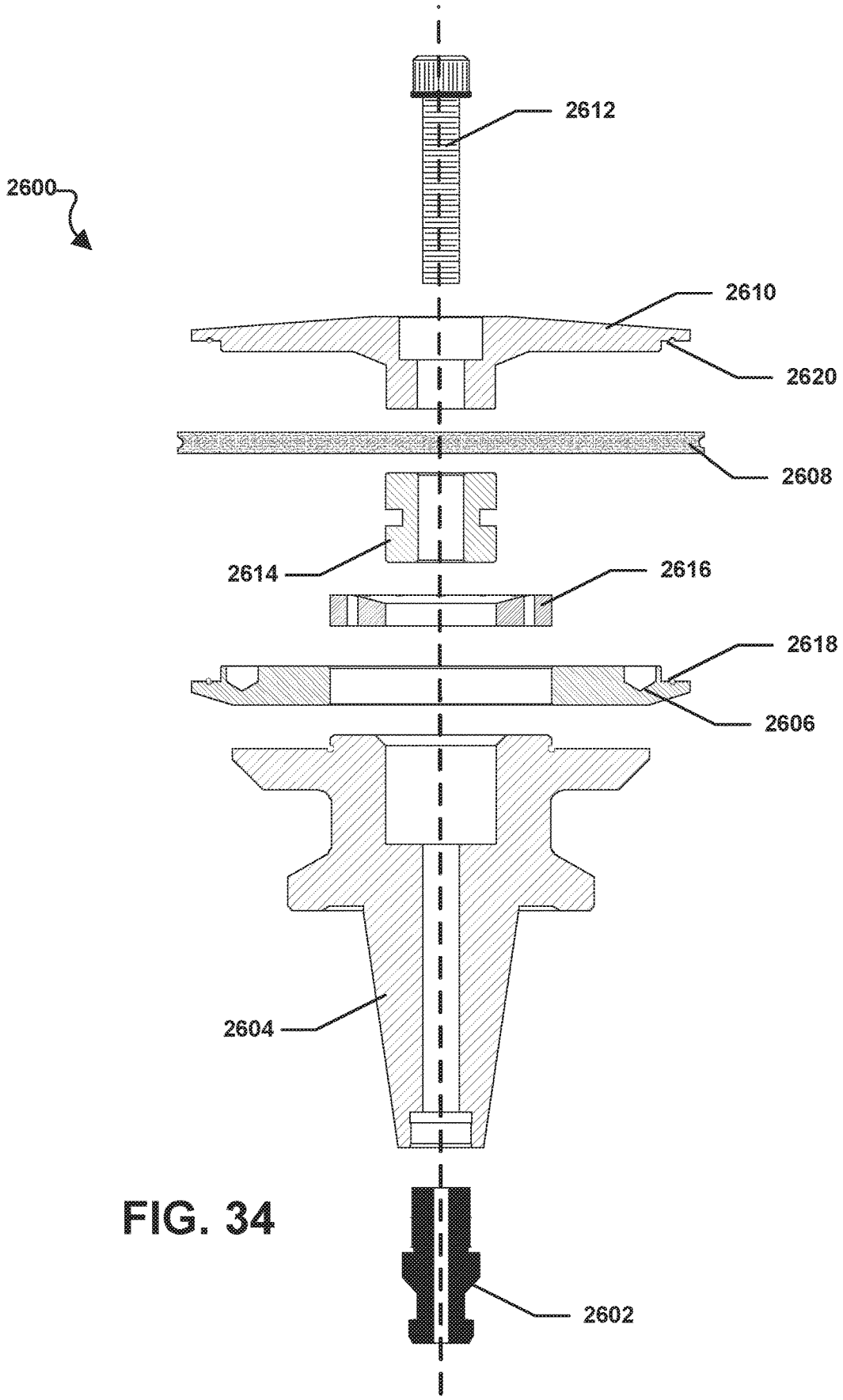
FIG. 34 includes an illustration of an exploded cross-section view of another grinding wheel assembly in accordance with an embodiment.

FIG. 34 indicates that the grinding wheel assembly 2600 can further include a first resilient member 2614 that can be installed within the arbor 2604 of the grinding wheel assembly 2600. Further, the grinding wheel assembly 2600 can include a second resilient member 2616 that can be installed within the mounting plate 2606. As shown in FIG. 34, the mounting plate 2606 can include a central bore in which the second resilient member 2616 can be installed. The second resilient member 2616 can be compressed longitudinally and radially outward during installation by the cover plate 2610. Specifically, the cover plate 2610 can include a central hub 2620 that is circumscribed by an angled surface 2622. The angled surface 2622 can force the second resilient member 2616 radially outward during assembly of the grinding wheel assembly 2600.

Figure 27:
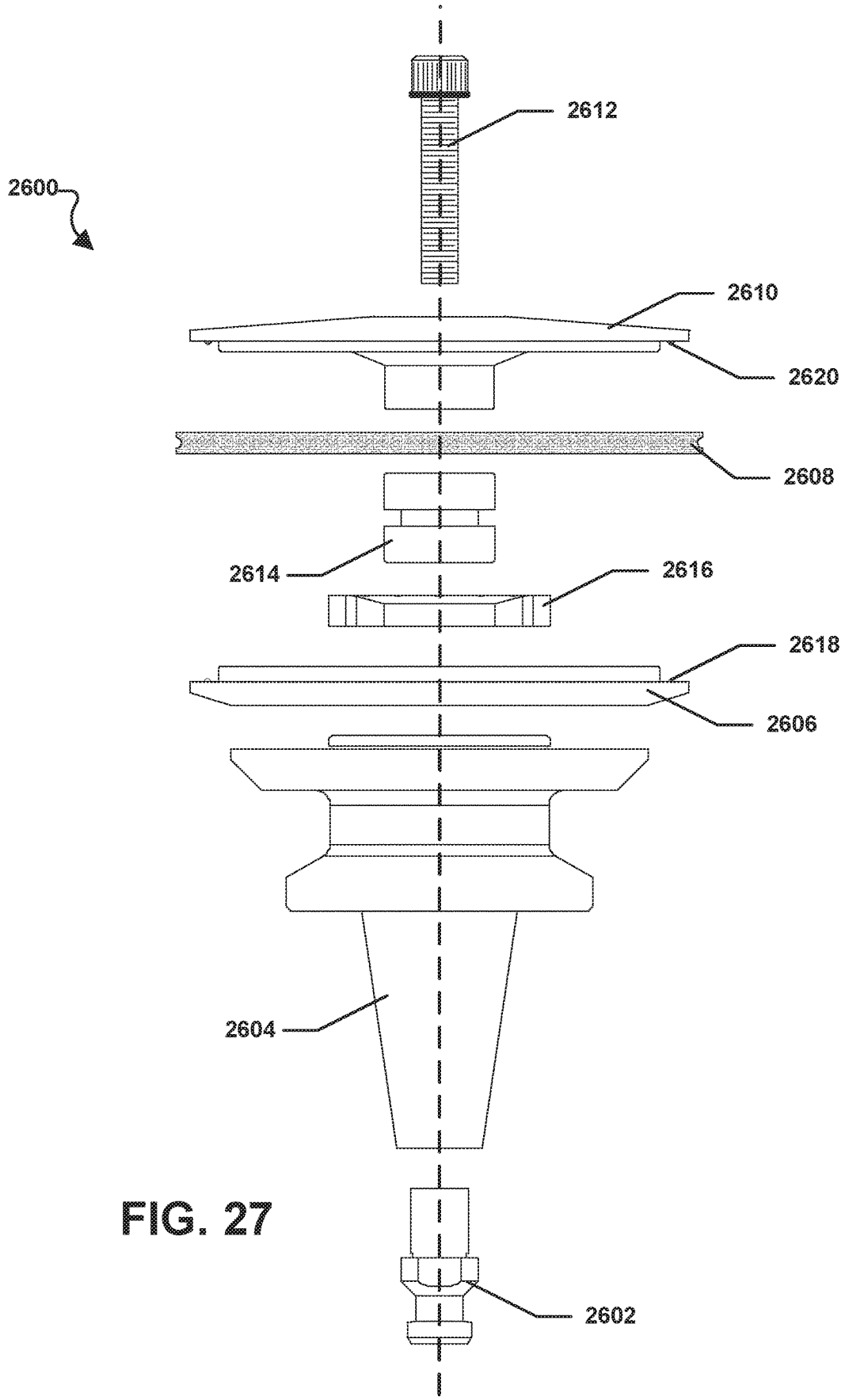
FIG. 27 includes an illustration of an exploded side plan view of another grinding wheel assembly in accordance with an embodiment.

As shown in FIG. 27 and FIG. 34, the grinding wheel assembly 2600 can include a third resilient member 2630 and a fourth resilient member 2632 that can be installed adjacent to the abrasive article 2608 within the mounting plate 2606 and the cover plate 2610, respectively. It is to be understood that the third and fourth resilient members 2632 are substantially identical to the O-rings described above in conjunction with the grinding wheel assembly 100. It is to be understood that the first and second resilient members 2614, 2616 can be considered internal resilient members and the third and fourth resilient members 2630, 2632 can be considered external resilient members.

Figure 29:
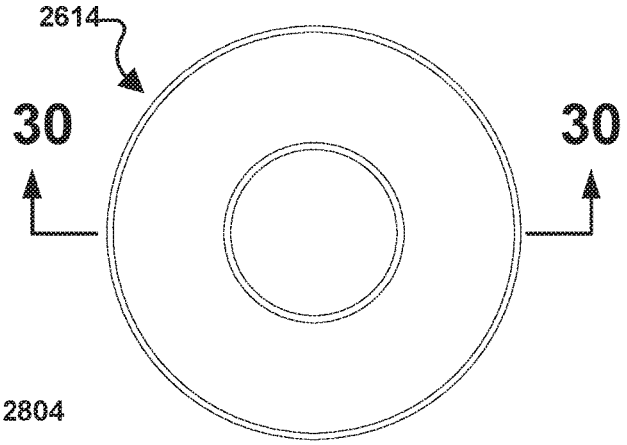
FIG. 29 includes an illustration of a top plan view of a resilient member for another grinding wheel assembly in accordance with an embodiment.
Figure 30:
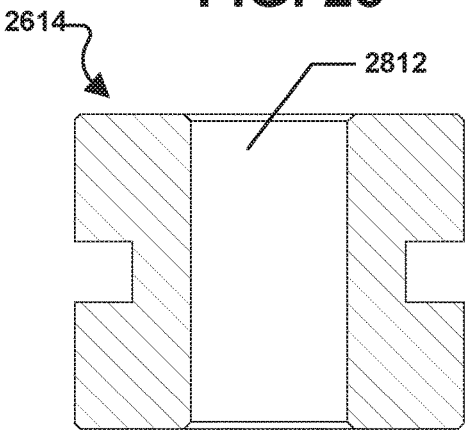
FIG. 30 includes an illustration of a cross-section view of a resilient member for another grinding wheel assembly in accordance with an embodiment taken along line 30-30 in FIG. 29.
Figure 31:
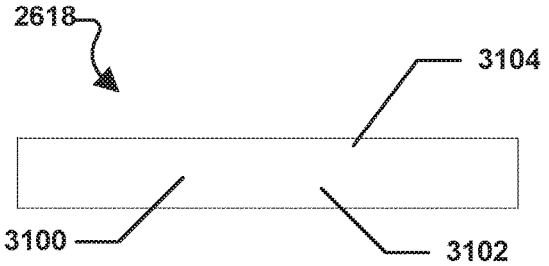
FIG. 31 includes an illustration of a side plan view of another resilient member for another grinding wheel assembly in accordance with an embodiment.

Referring to FIG. 29 to FIG. 30, the first resilient member 2614 is very similar to the first resilient member 114 described above. As shown, the first resilient member 2614 can include a body 2802 having a proximal end 2804 and a distal end 2806. The first resilient member 2614 can include a single groove 2808 formed in the body 2802. Specifically, the groove 2808 can extend radially inward into the body 2802 of the first resilient member 2614 from an outer sidewall 2810 of the body 2802. The grooves 2808 can allow the first resilient member 2614 to be compressed when installed within the grinding wheel assembly 100, as shown and described below.

In a particular aspect, the first resilient member 2614 can include an uncompressed length, $L_{RMU}$, measured from the top of the first resilient member 2614 to the bottom of the first resilient member 2614 while the first resilient member 2614 is not subjected to any external compressive forces, e.g., those that occur when the first resilient member 2614 is installed within the grinding wheel assembly 100. Further, the first resilient member 2614 can be formed with an outer diameter, $OD_{RM}$, measured from the outer sidewall 2810 to the outer sidewall 2810 of the body 2802 of the first resilient member 2614 through the widest portion when the first resilient member 2614 is not subjected to any external compressive forces. In one aspect, $L_{RMU}$, can be greater than or equal to 20 millimeters (mm). Further, $L_{RMU}$ can be greater than or equal to 21 mm, such as greater than or equal to 22 mm, greater than or equal to 23 mm, greater than or equal to 24 mm, or greater than or equal to 25 mm. In another aspect, $L_{RMU}$ can be less than or equal to 55 mm, such as less than or equal to 50 mm, less than or equal to 45 mm, or less than or equal to 40 mm. It is to be understood that $L_{RMU}$ can be with a range between, and including, any of the values of $L_{RMU}$ described herein.

In another aspect, $OD_{RM}$, can be greater than or equal to 25 millimeters (mm). Further, $OD_{RM}$ can be greater than or equal to 26 mm, such as greater than or equal to 27 mm, greater than or equal to 28 mm, greater than or equal to 29 mm, greater than or equal to 30 mm, or greater than or equal to 31 mm. In another aspect, $OD_{RM}$ can be less than or equal to 50 mm, such as less than or equal to 45 mm, or less than or equal to 40 mm. It is to be understood that $OD_{RM}$ can be with a range between, and including, any of the values of $OD_{RM}$ described herein.

In another aspect, the first resilient member 2414 can also have a compressed length $L_{RMC}$, measured from the top of the first resilient member 2414 to the bottom of the first resilient member 2414 when installed within a grinding wheel assembly 2400 and compressed by the cover plate 2410 and the fastener 2412 when it is threaded into the arbor 2404. In one aspect, $L_{RMC}$ can be less than or equal to 99% $L_{RMU}$. Further, $L_{RMC}$ can be less than or equal to 98% $L_{RMU}$, such as less than or equal to 97% $L_{RMU}$, less than or equal to 96% $L_{RMU}$, or less than or equal to 95% $L_{RMU}$. In another aspect, $L_{RMC}$ can be greater than or equal to 90% $L_{RMU}$, such as greater than or equal to 91% $L_{RMU}$, greater than or equal to 92% $L_{RMU}$, greater than or equal to 93% $L_{RMU}$, greater than or equal to 94% $L_{RMU}$, or greater than or equal to 95% $L_{RMU}$. It is to be understood that $L_{RMC}$ can be within a range between and including any of the minimum and maximum values of $L_{RMC}$ described herein.

Figure 28:
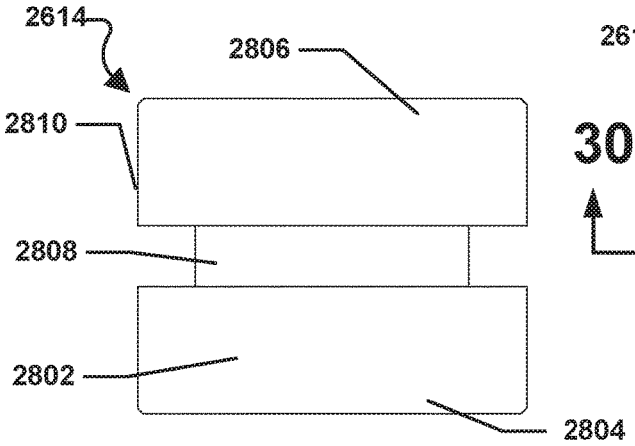
FIG. 28 includes an illustration of a side plan view of a resilient member for another grinding wheel assembly in accordance with an embodiment.

FIG. 28 and FIG. 30 show that the first resilient member 2414 can also include a central bore 2812 formed along the length of the body 2802 of the first resilient member 2414 from the distal end 2804 of the body 2802 of the first resilient member 2414 to the proximal end 2806 of the body 2802 of the first resilient member 2414 and circumscribed by an inner sidewall 2814. As illustrated, the central bore 2812 of the body 2802 of the first resilient member 2414 can have an inner diameter, $ID_{RM}$, measured from the inner sidewall 2814 to the inner sidewall 2814 through the largest width of the central bore 2812 of the body 2802 when the first resilient member 2414 is not subjected to any external compressive forces. To allow the fastener 2412 to pass through the first resilient member 2414 during installation, but still allow the first resilient member 2414 to engage the fastener 2412 when compressed by the cover plate 110 and the fastener 2412, the $ID_{RM}$ can be slightly larger than the outer diameter of the fastener 2412, $OD_F$. For example, $ID_{RM}$ can be greater than or equal to 1.01 $OD_F$. Further, $ID_{RM}$ can be greater than or equal to 1.02 $OD_F$, such as greater than or equal to 1.03 $OD_F$, greater than or equal to 1.04 $OD_F$, greater than or equal to 1.05 $OD_F$, or greater than or equal to 1.06 $OD_F$. In another aspect, $ID_{RM}$ can be less than or equal to 1.10 $OD_F$, such as less than or equal to 1.09 $OD_F$, less than or equal to 1.08 $OD_F$, or less than or equal to 1.07 $OD_F$. It is to be understood that $ID_{RM}$ can be within a range between, and including, any of the minimum and maximum values of $ID_{RM}$ disclosed herein.

Figure 26:
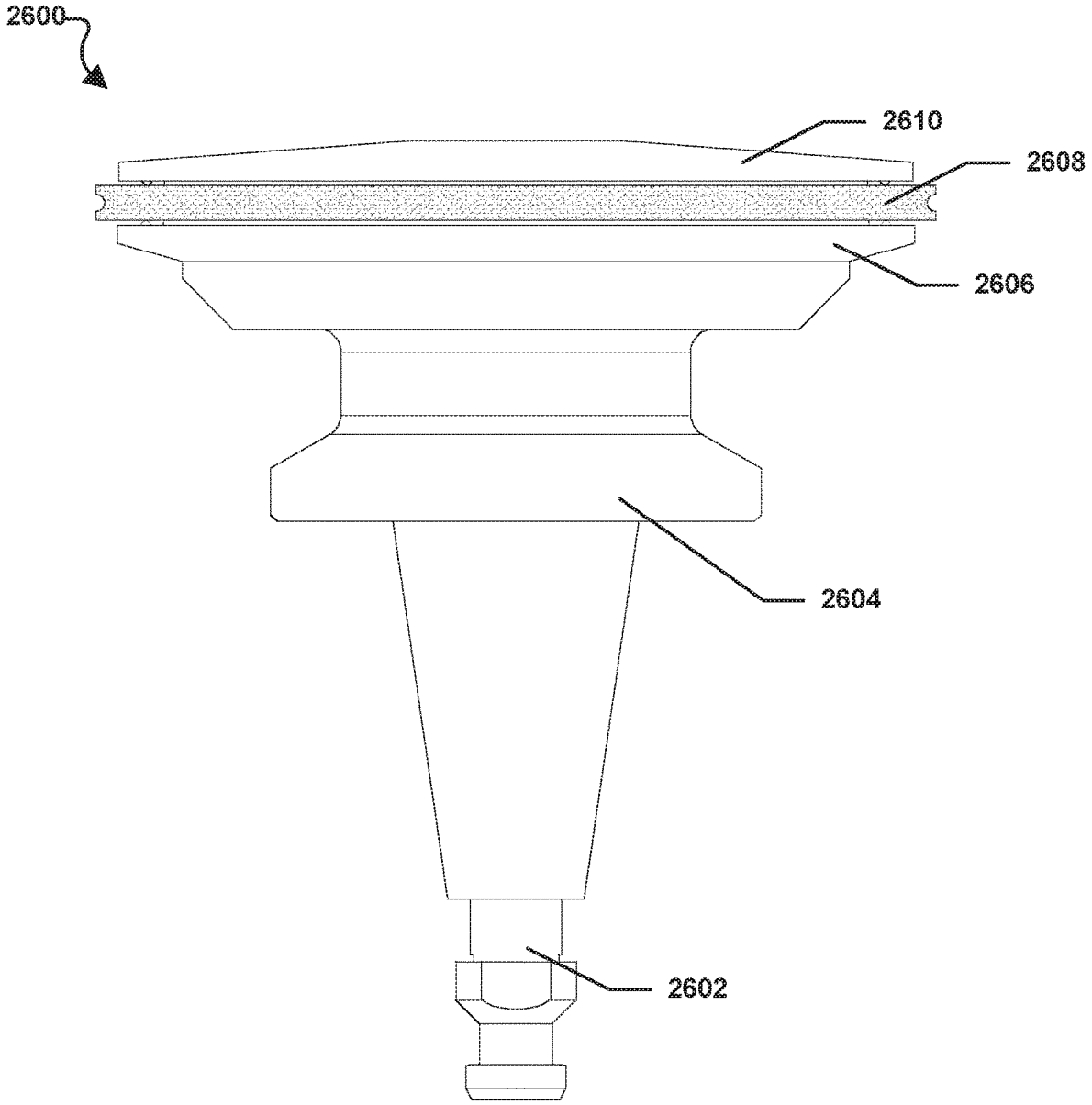
FIG. 26 includes an illustration of a side plan view of another grinding wheel assembly in accordance with an embodiment.
Figure 32:
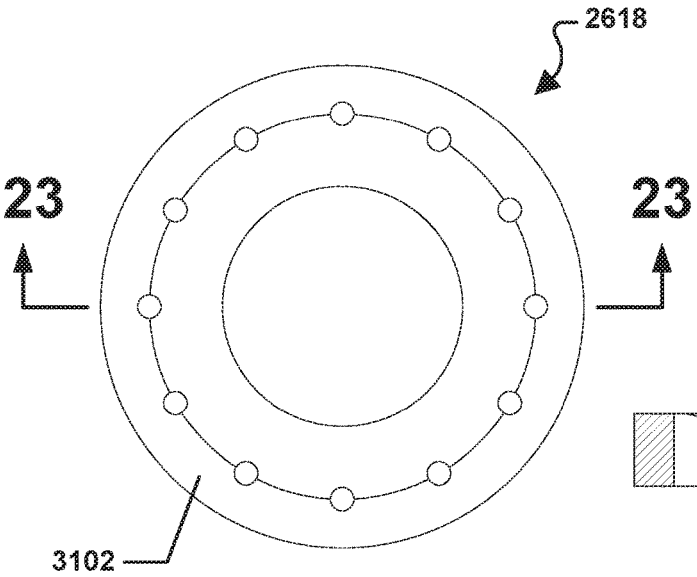
FIG. 32 includes an illustration of a top plan view of another resilient member for another grinding wheel assembly in accordance with an embodiment.
Figure 33:
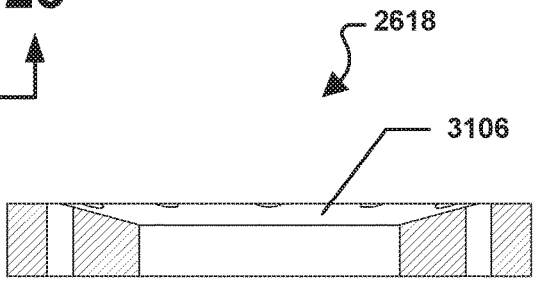
FIG. 33 includes an illustration of a cross-section view of another resilient member for another grinding wheel assembly in accordance with an embodiment taken along line 33-33 in FIG. 32.

FIG. 32 through FIG. 33 illustrate the second resilient member 2616. As shown, the second resilient member 2616 includes a body 3100 having a proximal surface 3102 and a distal surface 3104. The distal surface 3104 includes an angled portion 3106 that is configured to engage a complementary shaped surface on the cover plate 2610. This will allow the cover plate 2610 to engage the second resilient member 2616 and bias the second resilient member 2616 radially outward when the grinding wheel assembly 2600 is assembled as illustrated in FIG. 26. The second resilient member 2616 also includes a central bore 3108 extend entirely through the body 3100 of the second resilient member 2616. Moreover, the second resilient member 2616 includes a series of equi-radially spaced offset bores 3110 around the central bore 3108. As shown, the offset bores 3110 are offset from a center of the second resilient member 2616. Further, the offset bores 3110 extend entirely through the body 3100 of the second resilient member 2616. FIG. 32 shows twelve offset bores 3110. However, it can be appreciated that the second resilient member 2616 can include any number of offset bores 3110, e.g., one, two, three, four, five, six, seven, eight, nine, ten, eleven, twelve, thirteen, fourteen, fifteen, sixteen, seventeen, eighteen, nineteen, twenty, etc.

As illustrated, the second resilient member 2616 has an outer diameter, $OD_{RM}$, and each of the offset bores 3110 has an inner diameter, $ID_{OB}$. In a particular aspect, $ID_{OB}$ is greater than or equal to 1% $OD_{RM}$. Further, $ID_{OB}$ is greater than or equal to 2% $OD_{RM}$, such as greater than or equal to 3% $OD_{RM}$, greater than or equal to 4% $OD_{RM}$, or greater than or equal to 5% $OD_{RM}$. In another aspect, $ID_{OB}$ is less than or equal to 20% $OD_{RM}$, such as less than or equal to 15% $OD_{RM}$, less than or equal to 10% $OD_{RM}$, or less than or equal to 7.5% $OD_{RM}$. It is to be understood that $ID_{OB}$ can be within a range between and including any of the values of $ID_{OB}$ described herein.

Another Alternative Embodiment of Grinding Wheel Assembly

Referring now to FIG. 35 through FIG. 38, an abrasive tool, i.e., a grinding wheel assembly is illustrated and is generally designated 3500. As shown, the grinding wheel assembly 3500 can include an arbor 3504, an abrasive article 3508, a cover plate 3510, and at least one fastener 3512, e.g., a threaded fastener. A socket head cap screw is illustrated in the FIGs., but it is to be understood that any other type of threaded fastener may be used. The arbor 3504 and the cover plate 3510 can include a metal or a metal alloy. For example, the metal can be stainless steel or titanium. Further, the metal can include a hardened metal, such as hardened steel. Additionally, the metal can be conductive.

It is to be understood that the material utilized for the arbor 3504 and the cover plate 3510 will minimize wearing of these elements during use. The abrasive article 3508, however, will wear during grinding operations performed on the edges of various workpieces. After the abrasive article 3508 is sufficiently worn, the abrasive article 3508 may be removed and replaced with a new abrasive body. Alternatively, the abrasive article 3508 may be removed and the outer periphery of the abrasive article 3508 may be reground, re-dressed, or re-profiled. Thereafter, the abrasive article 3508 may be reinstalled and used to perform further grinding operations. In another aspect, as described below, the entire grinding wheel assembly 3500 can be installed in an EDM and the abrasive article 3508 may be reground, re-dressed, or re-profiled.

Figure 38:
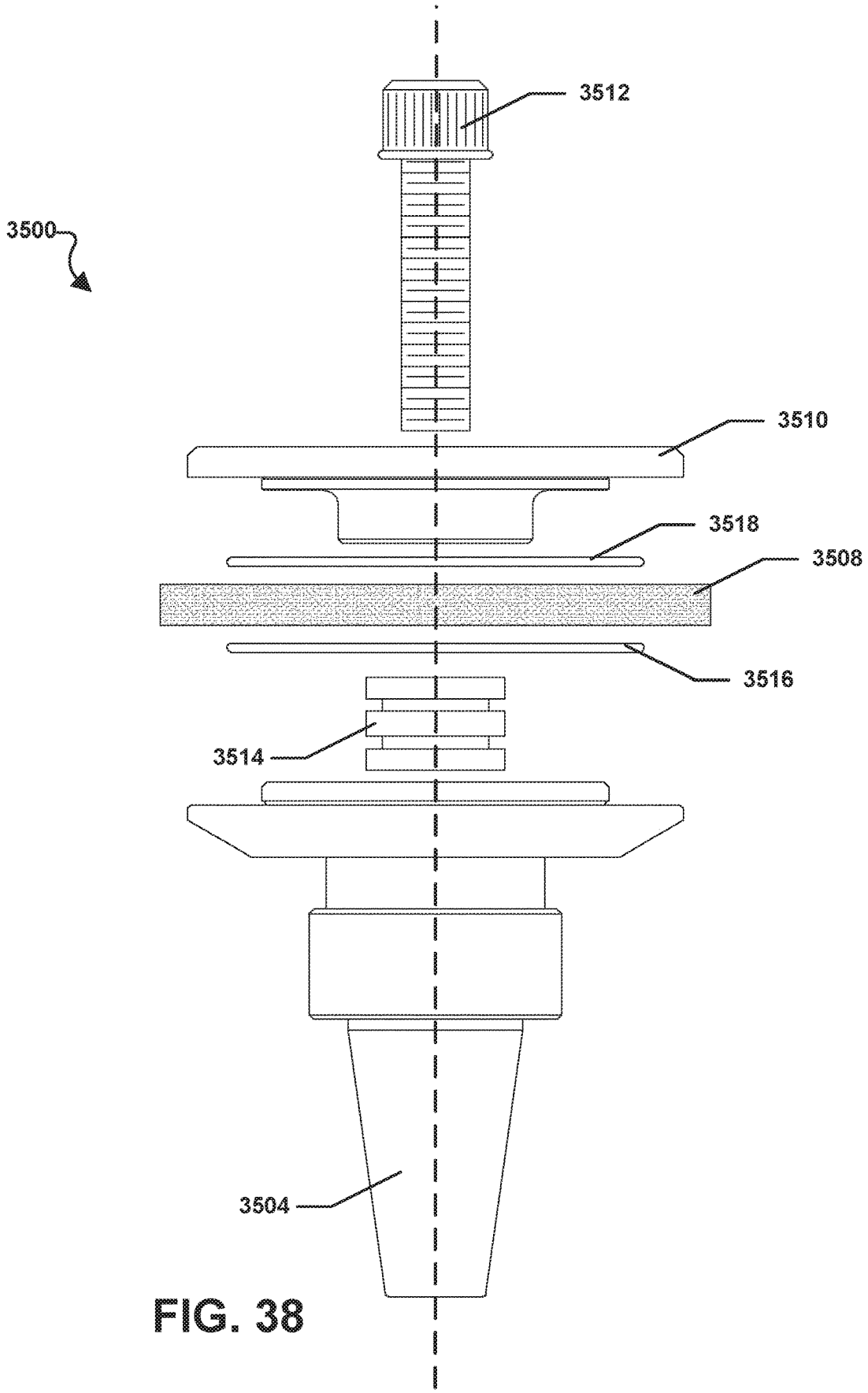
FIG. 38 includes an illustration of an exploded side plan view of a grinding wheel assembly in accordance with an embodiment.

FIG. 38 indicates that the grinding wheel assembly 3500 can further include a first resilient member 3514 that can be installed within the arbor 3504 of the grinding wheel assembly 3500, described in greater detail below. The first resilient member 3514 can be considered an internal resilient member because it is installed within the arbor 3504 of the grinding wheel assembly 3500. Moreover, the grinding wheel assembly 3500 can include a second resilient member 3516 and a third resilient member 3518 can be installed adjacent to the abrasive article 3508 within the mounting plate 3506 and the cover plate 3510, respectively. The second and third resilient members 3516, 3518 can be considered external resilient members because they are not installed within the arbor 3504 of the grinding wheel assembly 3500.

In a particular aspect, the resilient members 3514, 3516, 3518 can be a polymer. Further, the resilient members 3514, 3516, 3518 can be an elastomer. In another aspect, the resilient members 3514, 3516, 3518 comprise polychloroprene. Further, still the resilient members 3514, 3516, 3518 comprise a neoprene spring rubber and the neoprene spring rubber consists essentially of rubber, and more specifically, consists essentially of polychloroprene (e.g., neoprene). In another aspect, the resilient members 3514, 3516, 3518 can have a hardness of at least 50 as measured according to Shore A durometer. Moreover, the resilient members 3514, 3516, 3518 can have a hardness of at least 55, at least 60, at least 65, or at least 70. Further still the resilient members 3514, 3516, 3518 can have a hardness of not greater than 100, not greater than 90, not greater than 80, or not greater than 75.

Arbor

Figure 39:
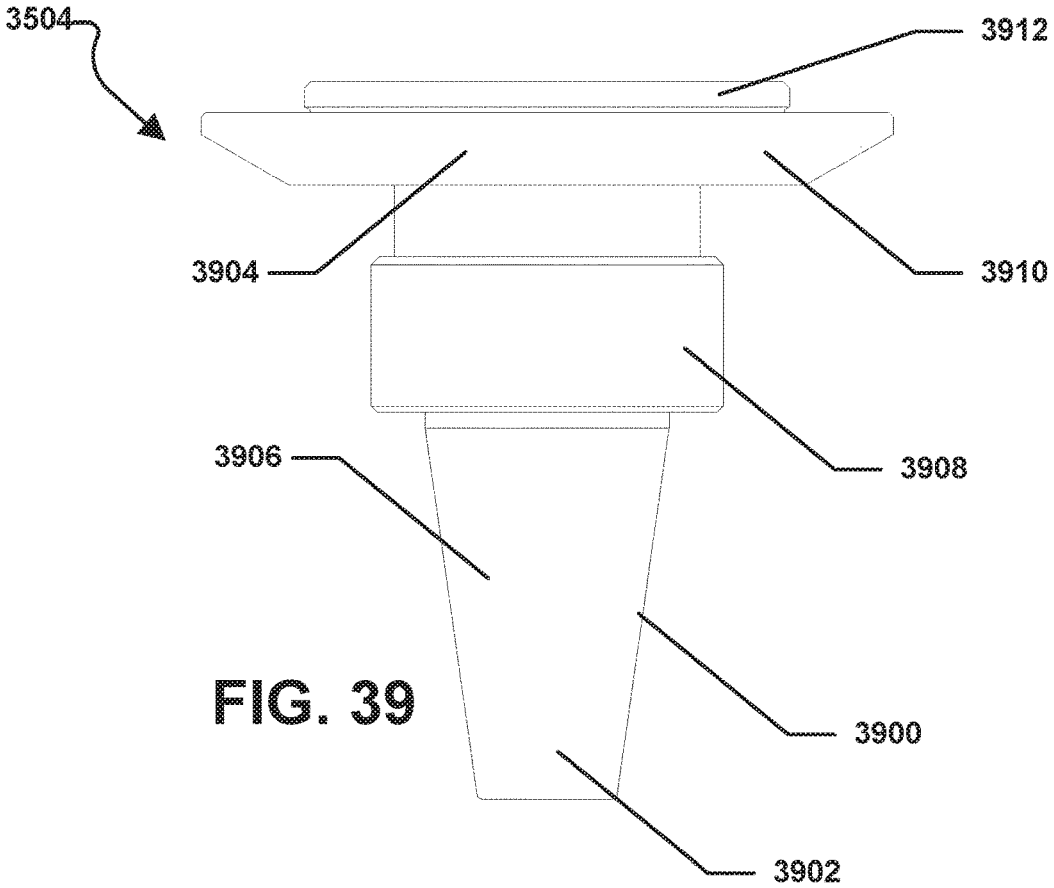
FIG. 39 includes an illustration of a side plan view of an arbor for a grinding wheel assembly in accordance with an embodiment.
Figure 40:
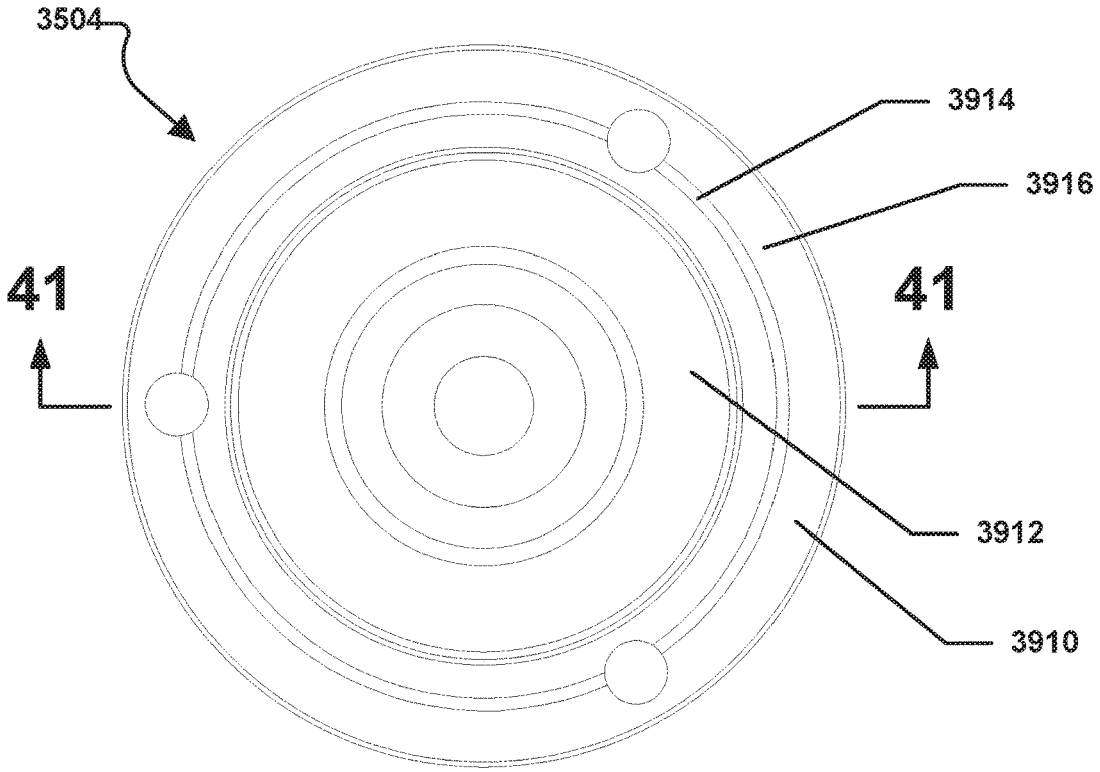
FIG. 40 includes an illustration of a top plan view of an arbor for a grinding wheel assembly in accordance with an embodiment.
Figure 41:
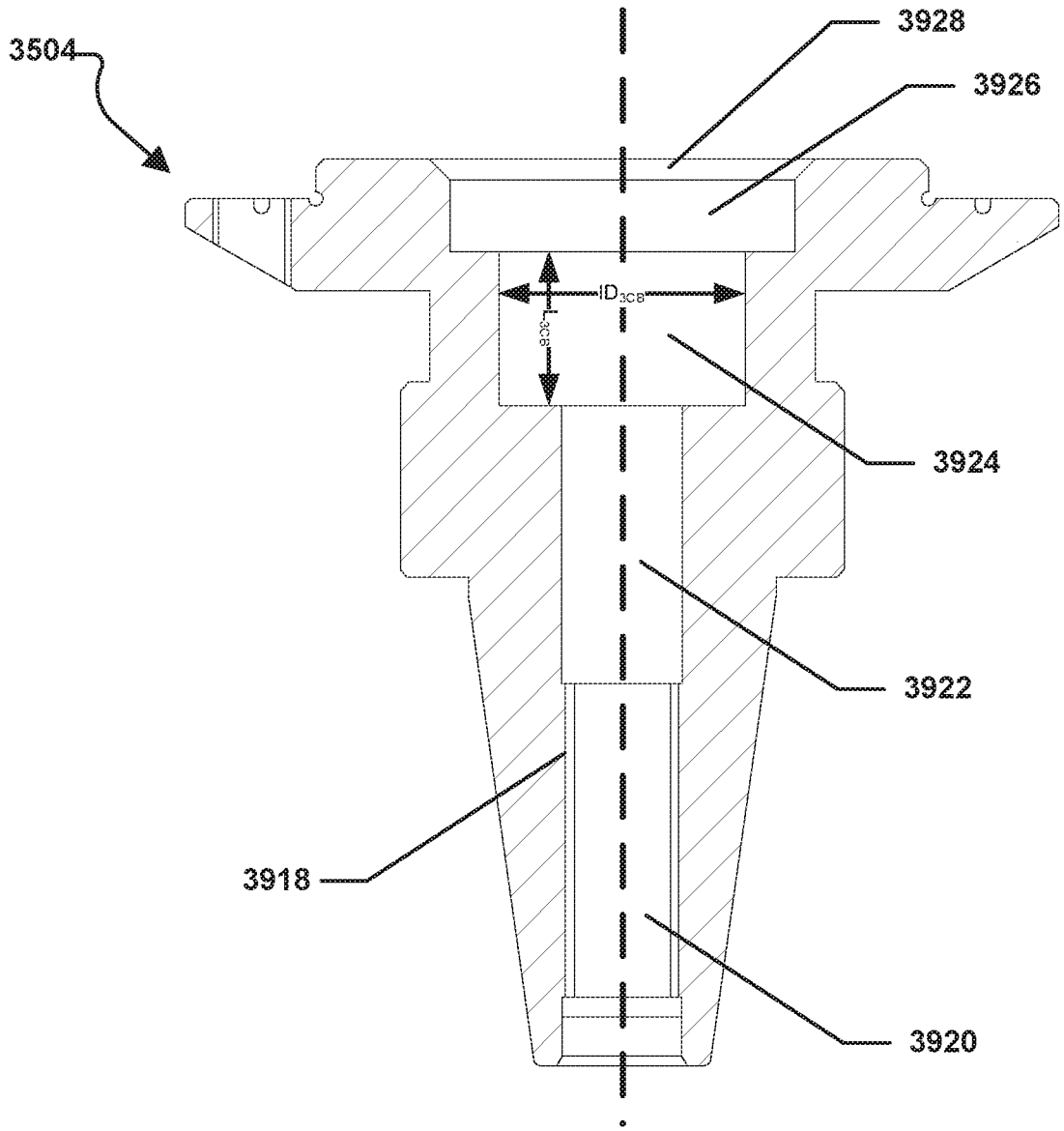
FIG. 41 includes an illustration of a cross-section view of an arbor for a grinding wheel assembly in accordance with an embodiment taken along line 41-41 in FIG. 40.

FIG. 39 through FIG. 41 illustrate the details of the arbor 3504. As shown, the arbor 3504 can include a body 3900 that can define a proximal end 3902 and a distal end 3904. The body 3900 of the arbor 3504 can include a generally frustoconical drive shaft 3906 that can extend from the proximal end 3902 of the body 3900 to a central flange 3908 that extends outwardly from the body 3900. Further, the body 3900 of the arbor 3504 can include a mounting plate 3910 that can extend radially outward from the body 3900 at, or near, the distal end 3904 of the body 3900 of the arbor 3504. In this aspect, the mounting plate 3910 is integrally formed with the arbor 3504. In other words, the mounting plate 3910 and the arbor 3504 are a single, continuous piece.

FIG. 39, FIG. 40, and FIG. 41 indicate that the mounting plate 3910 can include a mounting hub 3912. The mounting hub 3912 can be generally cylindrical and can extend axially away from the distal end 3534 of the body 3500 of the arbor 3504, e.g., from a contact surface of the mounting plate 3910, wherein the contact surface of the mounting plate 3910 is configured to engage a portion of the abrasive article 3508 (FIG. 35) and the mounting hub 3912 is configured to receive the abrasive article 3508 (FIG. 35) there around. In a particular aspect, the mounting hub 3912 can be configured to receive and engage the abrasive article 3508 (FIG. 35) as described in greater detail herein. The arbor 3504 can also include a groove 3914 formed in an upper surface 3916 of the mounting plate 3910. The groove 3914 can circumscribe the mounting hub 3912 and can be sized and shaped to receive a resilient member, e.g., the second resilient member 3516 described above.

FIG. 41 indicates that the body 3900 of the arbor 3504 can also include a central bore 3918 extending from the proximal end 3902 of the body 3900 of the arbor 3504 to the distal end 3904 of the body 3900 of the arbor 3504 along the central axis 3916. The central bore 3918 can include a first portion 3920 adjacent to the proximal end 3902 of the body 3900. The first portion 3920 of the central bore 3918 can be formed with threads, i.e., screw threads, at least partially along the length of the first portion 3920 of central bore 3918. It can be appreciated that the first portion 3920 of the central bore 3918 can be configured to receive a pull stud (not shown in FIG. 41). More particularly, the first portion 3920 of the central bore 3918 can be configured to receive threads formed on the pull stud.

FIG. 41 further indicates that the central bore 3918 can include a second portion 3922 adjacent to the first portion 3920 of the central bore 3918. The second portion 3922 of the central bore 3918 can be a threaded bore that is sized and shaped to receive the fastener 3512. The central bore 3918 can further include a third portion 3924 adjacent to the second portion 3922 of the central bore 3918. The third portion 3924 of the central bore 3918 can be a smooth walled bore that can be sized and shaped to removably engage the first resilient member 3514, described above.

Further, the third portion 3924 of the central bore 3918 can have a length, $L_{3CB}$, measured from the bottom of the third portion 3924 of the central bore 3918 to the top of the third portion 3924 of the central bore 3918 and an inner diameter, $ID_{3CB}$. In one aspect, $L_{3CB}$, can be greater than or equal to 10 millimeters (mm). Further, $L_{3CB}$ can be greater than or equal to 11 mm, such as greater than or equal to 12 mm, greater than or equal to 13 mm, greater than or equal to 14 mm, greater than or equal to 15 mm, or greater than or equal to 16 mm. In another aspect, $L_{3CB}$ can be less than or equal to 35 mm, such as less than or equal to 30 mm, less than or equal to 25 mm, or less than or equal to 20 mm. It is to be understood that $L_{3CB}$ can be with a range between, and including, any of the values of $L_{3CB}$ described herein.

In another aspect, $ID_{3CB}$, can be greater than or equal to 20 millimeters (mm). Further, $ID_{3CB}$ can be greater than or equal to 21 mm, such as greater than or equal to 22 mm, greater than or equal to 23 mm, greater than or equal to 24 mm, or greater than or equal to 25 mm. In another aspect, $ID_{3CB}$ can be less than or equal to 40 mm, such as less than or equal to 35 mm, or less than or equal to 30 mm. It is to be understood that $ID_{3CB}$ can be with a range between, and including, any of the values of $ID_{3CB}$ described herein.

FIG. 41 further shows that the central bore 3918 can also include a fourth portion 3926 adjacent to the third portion 3924. As shown, the fourth portion 3926 of the central bore 3918 can be a smooth walled bore and an upper edge of the fourth portion 3926 of the central bore 3918 can be formed with an internal chamfer 3928. In a particular aspect, the fourth portion 3926 of the central bore 3918 can be sized and shaped to removably engage a central engagement hub of the cover plate 3510, described below. In a particular aspect, the central engagement hub of the cover plate 3510 can engage the fourth portion 3926 of the central bore 3918 in a slip fit arrangement.

Resilient Member

Figure 48:
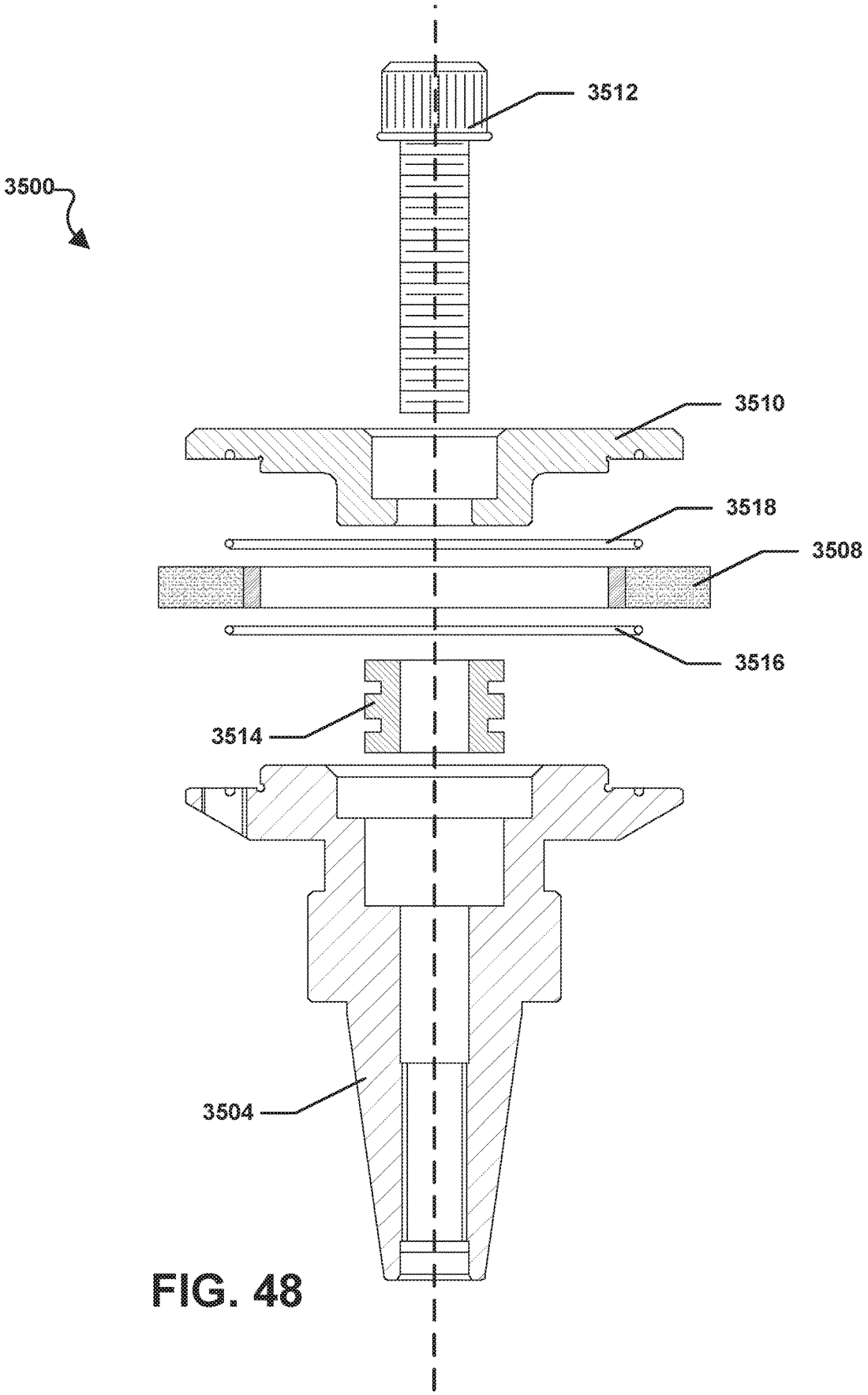
FIG. 48 includes an illustration of an exploded cross-section view of a grinding wheel assembly in accordance with an embodiment.
Figure 49:
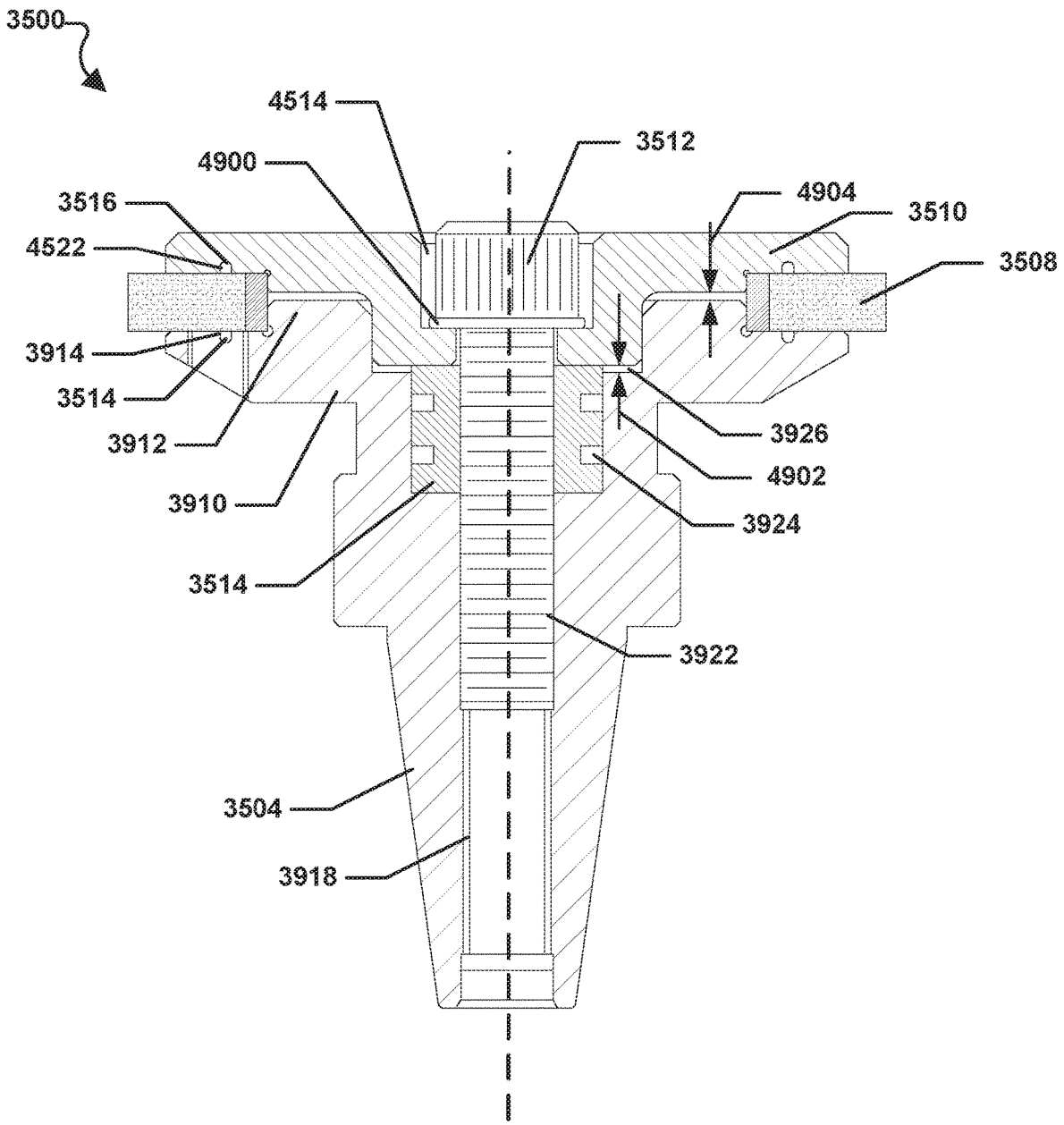
FIG. 49 includes an illustration of a cross-section view of a grinding wheel assembly in accordance with an embodiment taken along line 48-48 in FIG. 36.

FIG. 38, FIG. 48, and FIG. 49 indicate that a resilient member 3514 that can be installed within the body 3900 of the arbor 3504. The resilient member 3514 can be considered a dampener, or dampening member, that acts on the fastener 3512 when the grinding wheel assembly 3500 is in the assembled state as described herein and used during grinding operations. A compressive force can be applied to the dampening member by the fastener 3512, via the cover plate 3510, when the grinding wheel assembly 3500 is in the assembled state. In a particular aspect, the resilient member 3514 can dampen vibrations that may emanate from a drive spindle of a tool that is used to drive the grinding wheel assembly 3500.

Figure 42:
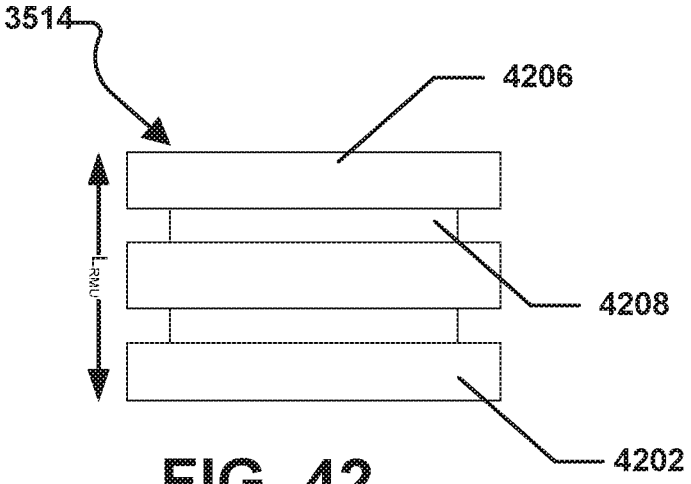
FIG. 42 includes an illustration of a side plan view of a resilient member for a grinding wheel assembly in accordance with an embodiment.
Figure 43:
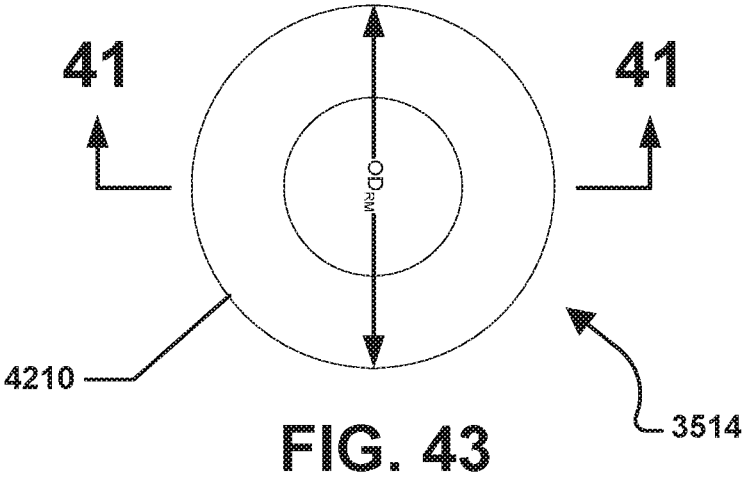
FIG. 43 includes an illustration of a top plan view of a resilient member for a grinding wheel assembly in accordance with an embodiment.
Figure 44:
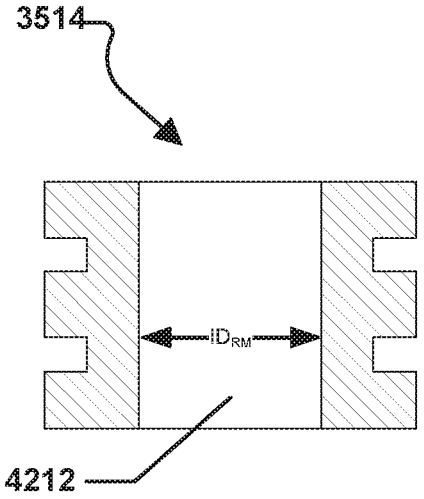
FIG. 44 includes an illustration of a cross-section view of a resilient member for a grinding wheel assembly in accordance with an embodiment taken along line 44-44 in FIG. 43.

As shown in FIG. 42, FIG. 43, and FIG. 44, the resilient member 3514 can include a body 4202 having a proximal end 4204 and a distal end 4206. The resilient member 3514 can include a plurality of grooves 4208 formed in the body 4202. Specifically, the grooves 4208 can extend radially inward into the body 4202 of the resilient member 3514 from an outer sidewall 4210 of the body 4202. As illustrated, the body 4202 of the resilient member 3514 can be formed with two grooves 4208. However, it can be appreciated that the body 4202 of the resilient member 3514 can include one groove, two grooves, three grooves, four grooves, five grooves, six grooves, seven grooves, eight grooves, nine grooves, ten grooves, etc. In a particular aspect, the grooves 4208 form a castellated pattern, or structure, in the outer sidewall 4210 of the body 4202 and can allow the resilient member 3514 to be compressed around and onto the fastener 3512 when installed within the grinding wheel assembly 3500, as shown and described below.

In a particular aspect, the resilient member 3514 can include an uncompressed length, $LR_{MU}$, measured from the top of the resilient member 3514 to the bottom of the resilient member 3514 while the resilient member 3514 is in an unassembled state and not subjected to any external compressive forces, e.g., those that occur when the resilient member 3514 is installed within the grinding wheel assembly 3500 and the fastener 3512 that extends therethrough is threadably engaged with the arbor 3504. Further, the resilient member 3514 can be formed with an outer diameter, $OD_{RM}$, measured from the outer sidewall 4210 to the outer sidewall 4210 of the body 4202 of the resilient member 3514 through the widest portion when the resilient member 3514 is not subjected to any external compressive forces. In one aspect, $L_{RMU}$, can be greater than or equal to 10 millimeters (mm). Further, $L_{RMU}$ can be greater than or equal to 11 mm, such as greater than or equal to 12 mm, greater than or equal to 13 mm, greater than or equal to 14 mm, greater than or equal to 15 mm, or greater than or equal to 16 mm. In another aspect, $L_{DCB}$ can be less than or equal to 35 mm, such as less than or equal to 30 mm, less than or equal to 25 mm, or less than or equal to 20 mm. It is to be understood that $L_{RMU}$ can be with a range between, and including, any of the values of $L_{RMU}$ described herein.

In another aspect, $OD_{RM}$, can be greater than or equal to 20 millimeters (mm). Further, $OD_{RM}$ can be greater than or equal to 21 mm, such as greater than or equal to 22 mm, greater than or equal to 23 mm, greater than or equal to 24 mm, or greater than or equal to 25 mm. In another aspect, $OD_{RM}$ can be less than or equal to 40 mm, such as less than or equal to 35 mm, or less than or equal to 30 mm. It is to be understood that $OD_{RM}$ can be with a range between, and including, any of the values of $OD_{RM}$ described herein.

In another aspect, the resilient member 3514 can also have a compressed length $L_{RMC}$, measured from the top of the resilient member 3514 to the bottom of the resilient member 3514 when installed within a grinding wheel assembly 3500, as illustrated in FIG. 49, and compressed by the cover plate 3510 and the fastener 3512 when the fastener 3512 is threaded into the second portion 3922 of the central bore 3918 formed in the body 3900 of the arbor 3504. In one aspect, $L_{RMC}$ can be less than or equal to 99% $L_{RMU}$. Further, $L_{RMC}$ can be less than or equal to 98% $L_{RMU}$, such as less than or equal to 97% $L_{RMU}$, less than or equal to 96% $L_{RMU}$, or less than or equal to 95% $L_{RMU}$. In another aspect, $L_{RMC}$ can be greater than or equal to 90% $L_{RMU}$, such as greater than or equal to 91% $L_{RMU}$, greater than or equal to 92% $L_{RMU}$, greater than or equal to 93% $L_{RMU}$, greater than or equal to 94% $L_{RMU}$, or greater than or equal to 95% $L_{RMU}$. It is to be understood that $L_{RMC}$ can be within a range between and including any of the minimum and maximum values of $L_{RMC}$ described herein.

In another aspect, $L_{RMU}$ can be greater than $L_{3CB}$. For example, $L_{RMU}$ can be greater than or equal to 101% $L_{3CB}$. Moreover, $L_{RMU}$ can be greater than or equal to 102% $L_{3CB}$, such as greater than or equal to 103% $L_{3CB}$, greater than or equal to 104% $L_{3CB}$, or greater than or equal to 105% $L_{3CB}$. Further, $L_{RMU}$ can be less than or equal to 125% $L_{3CB}$, such as less than or equal to 120% $L_{3CB}$, less than or equal to 115% $L_{3CB}$, or less than or equal to 110% $L_{3CB}$.

FIG. 43 and FIG. 44 show that the resilient member 3514 can also include a central bore 4212 formed along the length of the body 4202 of the resilient member 3514 from the distal end 4204 of the body 4202 of the resilient member 3514 to the proximal end 4206 of the body 4202 of the resilient member 3514 and circumscribed by an inner sidewall 4214. As illustrated, the central bore 4212 of the body 4202 of the resilient member 3514 can have an inner diameter, $ID_{RM}$, measured from the inner sidewall 4214 to the inner sidewall 4214 through the largest width of the central bore 4212 of the body 4202 when the resilient member 3514 is not subjected to any external compressive forces. To allow the fastener 3512 to pass through the resilient member 3514 during installation, but still allow the resilient member 3514 to engage the fastener 3512 when compressed by the cover plate 3510 and the fastener 3512, the $ID_{RM}$ can be slightly larger than the outer diameter of the fastener 3512, $OD_F$. For example, $ID_{RM}$ can be greater than or equal to 1.01 $OD_F$. Further, $ID_{RM}$ can be greater than or equal to 1.02 $OD_F$, such as greater than or equal to 1.03 $OD_F$, greater than or equal to 1.04 $OD_F$, greater than or equal to 1.05 $OD_F$, or greater than or equal to 1.06 $OD_F$. In another aspect, $ID_{RM}$ can be less than or equal to 1.10 $OD_F$, such as less than or equal to 1.09 $OD_F$, less than or equal to 1.08 $OD_F$, or less than or equal to 1.07 $OD_F$. It is to be understood that $ID_{RM}$ can be within a range between, and including, any of the minimum and maximum values of $ID_{RM}$ disclosed herein.

In another aspect, the resilient member 3514 can have an uncompressed outer diameter, $OD_{RMU}$, and $OD_{RMU}$ can be less than $ID_{3CB}$. For example, $OD_{RMU}$ can be less than or equal to 99.9% $ID_{3CB}$. Further, $OD_{RMU}$ can be less than or equal to 99.8% $ID_{3CB}$, such as less than or equal to 99.7% $ID_{3CB}$, less than or equal to 99.6% $ID_{3CB}$, or less than or equal to 99.5% $ID_{3CB}$. In another aspect, $OD_{RMU}$ can be greater than or equal to 99.0% $ID_{3CB}$, such as greater than or equal to 99.1% $ID_{3CB}$, greater than or equal to 99.2% $ID_{3CB}$, greater than or equal to 99.3% $ID_{3CB}$, or greater than or equal to 99.4% $ID_{3CB}$. It is to be understood that $OD_{RMU}$ can be within a range between, and including, any of the maximum and minimum values of $OD_{RMU}$ disclosed herein.

Cover Plate

Figure 35:
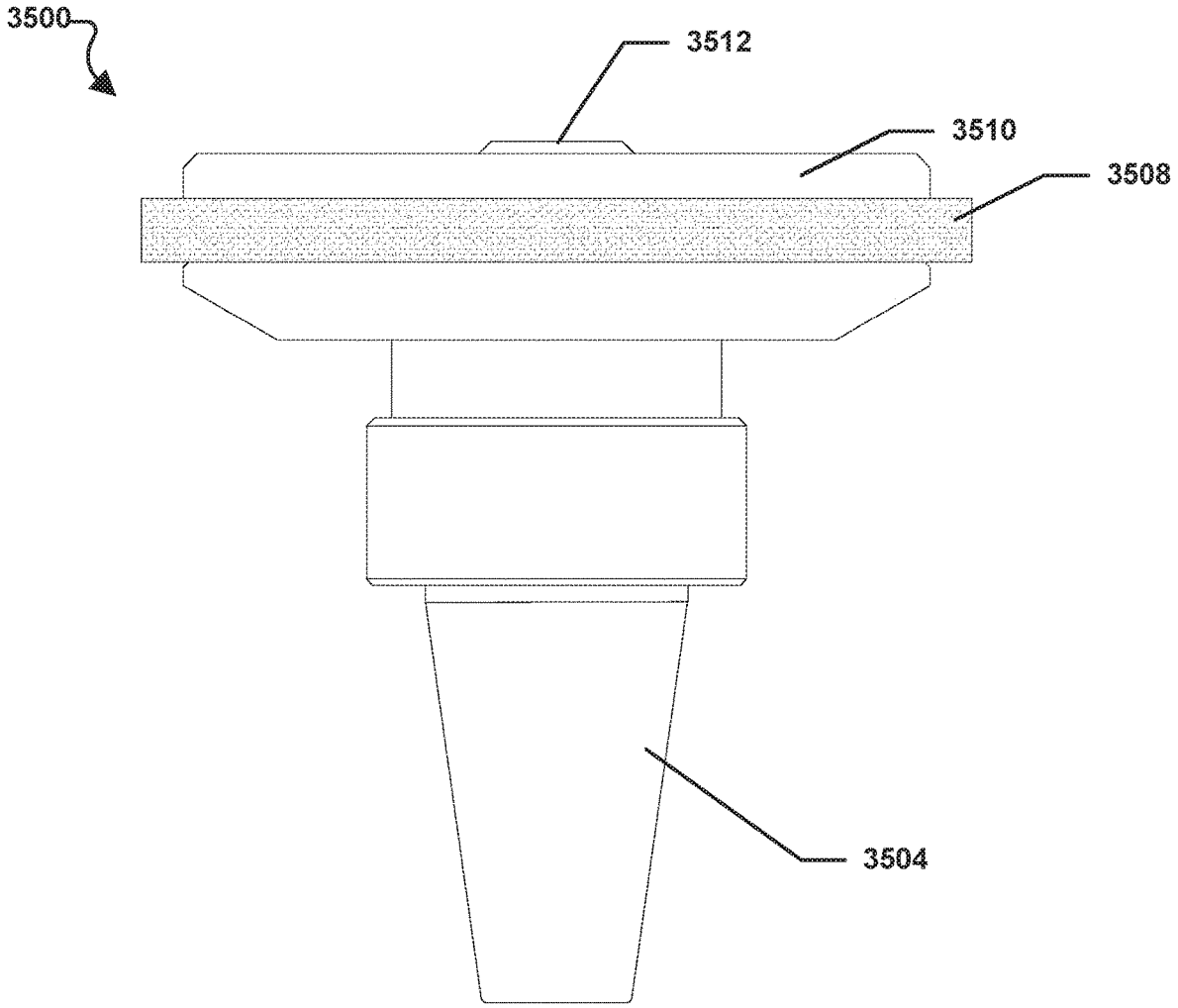
FIG. 35 includes an illustration of a side plan view of a grinding wheel assembly in accordance with an embodiment.
Figure 36:
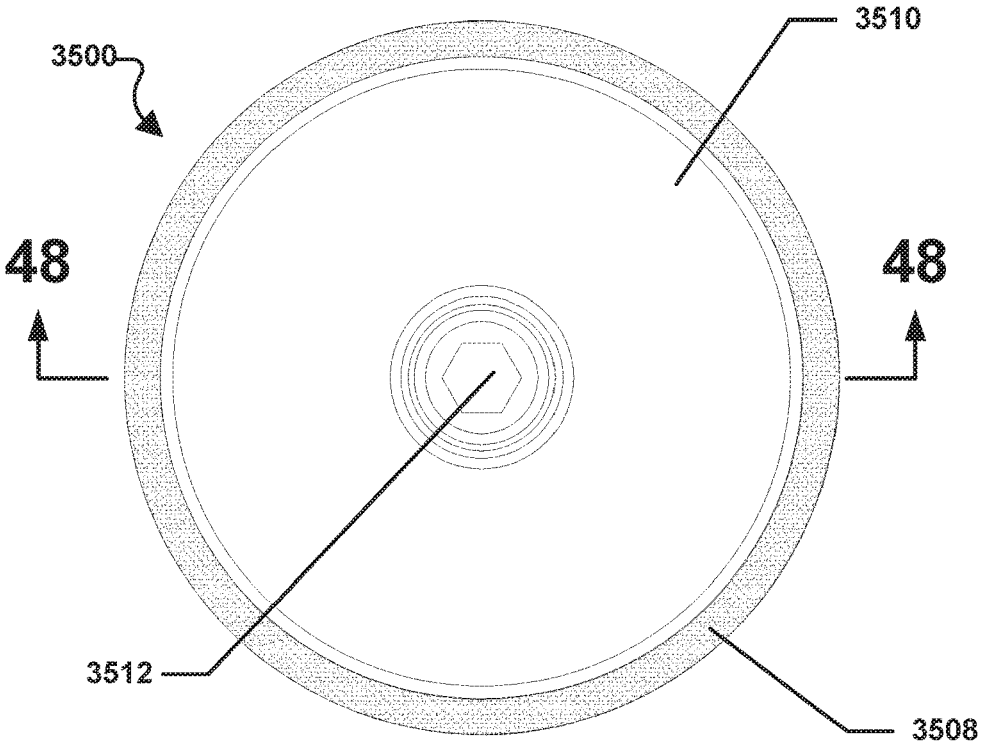
FIG. 36 includes an illustration of a top plan view of a grinding wheel assembly in accordance with an embodiment.
Figure 37:
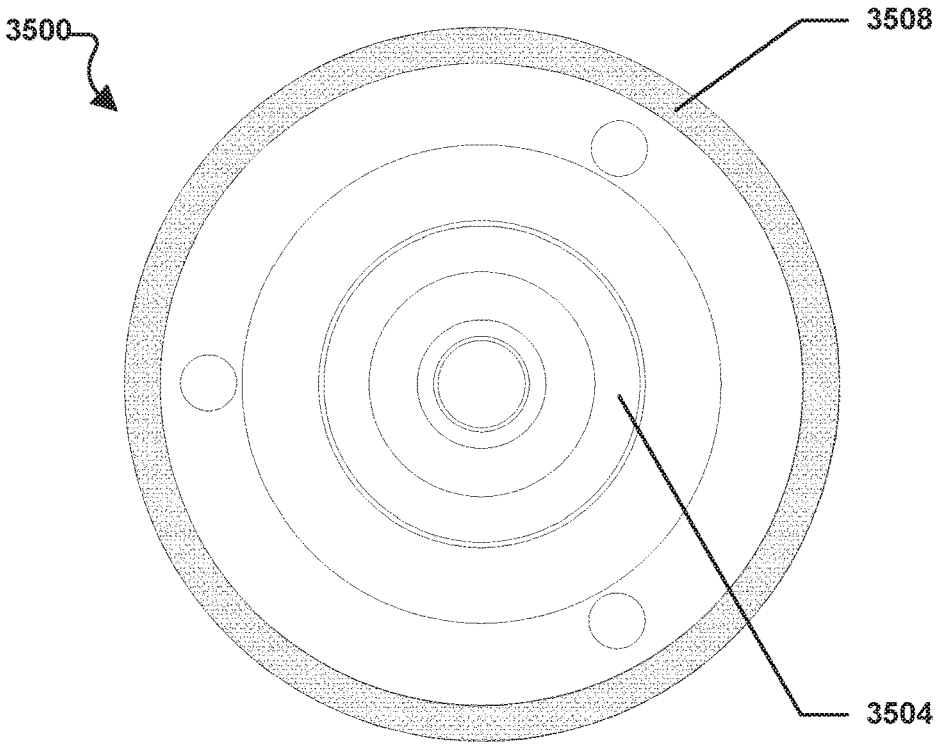
FIG. 37 includes an illustration of a bottom plan view of a grinding wheel assembly in accordance with an embodiment.
Figure 45:
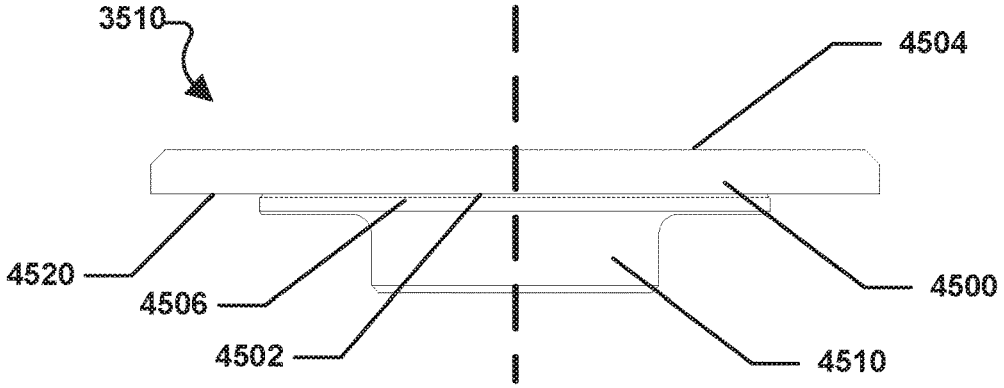
FIG. 45 includes an illustration of a side plan view of a cover plate for a grinding wheel assembly in accordance with an embodiment.
Figure 46:
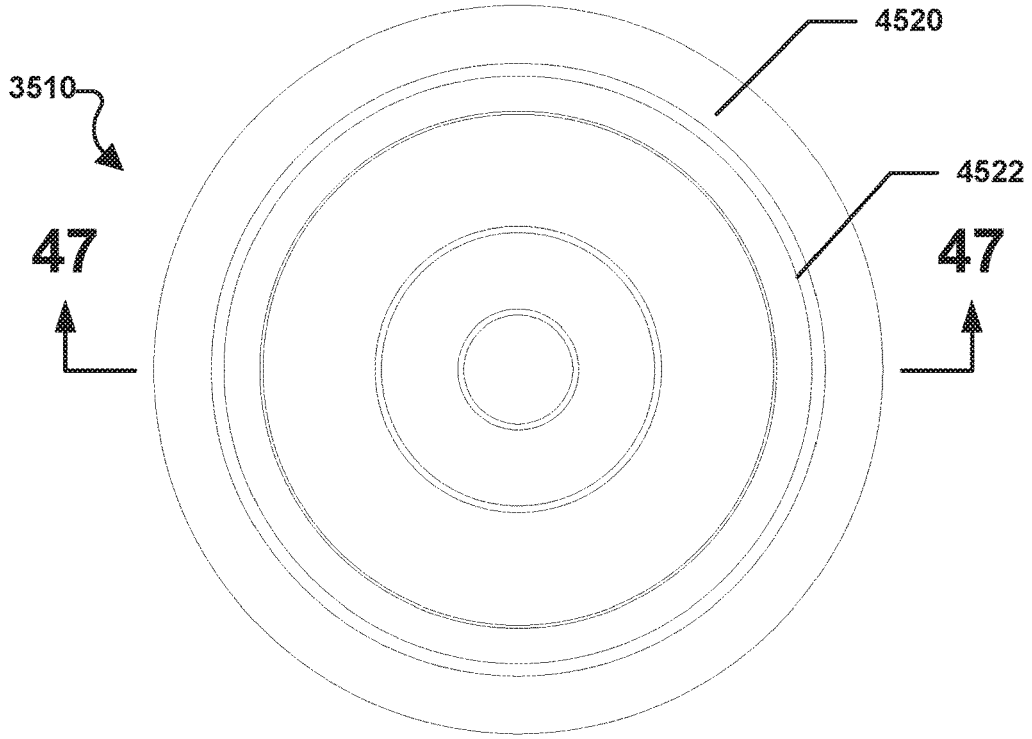
FIG. 46 includes an illustration of a bottom plan view of a cover plate for a grinding wheel assembly in accordance with an embodiment.
Figure 47:
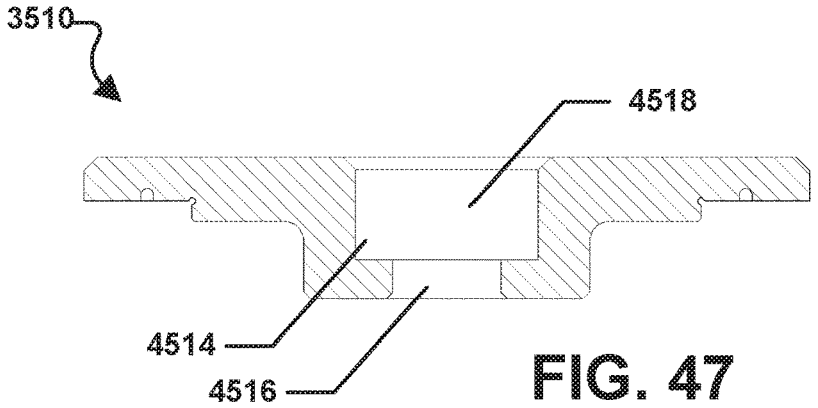
FIG. 47 includes an illustration of a cross-section view of a cover plate for a grinding wheel assembly in accordance with an embodiment taken along line 47-47 in FIG. 46.

FIG. 45 and FIG. 46 illustrate the details concerning the construction of the cover plate 3510. The cover plate 3510 can include a body 4500 that is generally disk-shaped. Further, the body 4500 of the cover plate 3510 can include a proximal surface 4502 and a distal surface 4504. A generally cylindrical support hub 4506 can extend outwardly from the proximal surface 4502, in a downward direction, as indicated in FIG. 45 and FIG. 46. The support hub 4506 is configured to extend into and support the abrasive article 3508 when the grinding wheel assembly 3500 is assembled as shown in FIG. 35 and FIG. 49.

FIG. 45 and FIG. 46 further show that the cover plate 3510 can include a central engagement hub 4510 extending outwardly, in a downward direction, from the support hub 4506 along a central axis 4512. As shown in greater detail in FIG. 48, the engagement hub 4510 of the cover plate 3510, when installed in the grinding wheel assembly 3500, can extend through the abrasive article 3508 and into the fourth portion 3926 of the central bore 3918 formed in the body 3900 of the arbor 3504.

The cover plate 3510 can also include a central bore 4514 that extends through the cover plate 3510, i.e., the body 4500 of the cover plate 3510, the support hub 4506, and the engagement hub 4510, along the central axis 4512. The central bore 4514 can include a proximal portion 4516 that is sized and shaped to allow the fastener 3512 to pass therethrough. Further, the central bore 4514 can include a distal portion 4518 that is sized and shaped to receive the head of the fastener 3512, as shown in greater detail in FIG. 49.

FIG. 45 and FIG. 46 further illustrate that the cover plate 3510 can include a central surface 4520 around the support hub 4506. The central surface 4520 can be substantially perpendicular to the central axis 4512. A groove 4522 can be formed in the central surface 4520 such that the groove 4522 circumscribes the support hub 4506 of the cover plate 3510. The groove 4522 can be generally semi-circular in cross-section and the groove 4522 can be configured to receive the third resilient member 3516 as shown in greater detail below.

Assembled Grinding Wheel Assembly

Referring now to FIG. 48 and FIG. 49, the grinding wheel assembly 3500 is shown in an unassembled state, FIG. 48, and in an assembled state, FIG. 48. As shown in FIG. 48, the second resilient member 3516 can fit into the groove 3914 formed in the mounting plate 3910 of the arbor 3504 and the abrasive article 3508 can fit on the mounting plate 3910 of the arbor 3504 around the mounting hub 3912 and adjacent to the second resilient member 3516. The abrasive article 3508 can engage the mounting hub 3912 of the arbor 3504 in a slip fit so that the abrasive article 3508 can be relatively easily installed and removed from the arbor 3504 and the grinding wheel assembly 3500.

FIG. 49 shows that the first resilient member 3514 can be installed within the arbor 3504 of the grinding wheel assembly 3500. Specifically, the first resilient member 3514 can be installed within the third portion 3924 of the central bore 3918 formed in the body 3900 of the arbor 3504. Moreover, the first resilient member 3514 can be installed within the third portion 3924 of the central bore 3918 prior to the installation of the second resilient member 3516 and the abrasive article 3508. Alternatively, the first resilient member 3514 can be installed after the second resilient member 3516 and the abrasive article 3508.

After the second resilient member 3516, the abrasive article 3508, and the resilient member 3514 are installed, as described above, the cover plate 3510 with the third resilient member 3518 installed therein can be installed on the arbor 3504 so that the central engagement hub 4510 of the cover plate 3510 extends through the abrasive article 3508 and into the fourth portion 3926 of the central bore 3918 formed in the body 3900 of the arbor 3504. Thereafter, the fastener 3512 can be installed and tightened. Specifically, the third resilient member 3518 can be installed in the groove 4522 formed in the cover plate 3510. Further, the fastener 3512 can be installed within the grinding wheel assembly 3500 as illustrated in FIG. 49 and the fastener 3512, i.e., the shank of the fastener, can extend through the central bore 4514 formed in the cover plate 3500 and the central bore 4212 formed in the resilient member 3514. Further, a portion of the threaded shank of the fastener 3512 can engage the threads formed in the second portion 3922 of the central bore 3918 formed in the body 3900 of the arbor 3504. As the fastener 3512 is tightened, the central engagement hub 4510 of the cover plate 3510 can be drawn, or otherwise pulled, further into the arbor 3504, i.e., further into the fourth portion 3924 of the central bore 3918 of the body 3900 of the arbor 3504.

As the fastener 3512 is tightened and the central engagement hub 4510 moves further into the arbor 3504, the resilient member 3514 can be compressed, i.e., by a compressive force provided by the fastener, so that the length of the resilient member 3514 is reduced. Specifically, the castellated pattern, or structure, formed by the grooves 4208 in the outer sidewall 4210 of the resilient member 3514 and the elastomeric material of the resilient member 3514 can allow the resilient member 3514 to be compressed, thereby reducing the overall length of the resilient member 3514 to one of the values of $L_{RMC}$ as described above. Further, the second and third resilient members 3516, 3518 adjacent to, or flanking, the abrasive article 3508 can also be slightly compressed so that the cross-sectional shape of the second and third resilient members 3516, 3518 changes from a circular shape to an elliptical shape. The mounting plate 3506 in conjunction with the cover plate 3510 and the fastener 3512 can hold the abrasive article 3508 in place within the grinding wheel assembly 3510. The second and third resilient members 3516, 3518 also help provide support for the abrasive article 3508 and the abrasive article 3508 can be keyed to the mounting plate 3910 of the arbor 3504, the cover plate 3510, or both the mounting plate 3910 of the arbor and the cover plate 3510 to prevent the abrasive article 3508 from spinning with respect to the arbor 3504.

The resilient members 3514, 3516, 3518 can substantially reduce vibration of the grinding wheel assembly 3500 during use. More specifically, the resilient member 3514, installed within the arbor 3504, as described herein, can facilitate vibration dampening through the center of the grinding wheel assembly 3500 and can act as a compressible object to ensure proper coupling of the various components of the grinding wheel assembly 3500. The single central fastener 3512 simplifies assembly and disassembly of the grinding wheel assembly 3500 and provides a compressive force, when properly tightened, on the resilient member 3514 to ensure proper assembly and engagement of the resilient member 3514 for vibration dampening.

As shown in FIG. 49, the grinding wheel assembly 3500 can also include a spring washer 4900 installed between the central fastener 3512 and the cover plate 3510. Moreover, when the grinding wheel assembly 3500 is properly assembled a first gap 4902 can be formed between the central engagement hub 4510 of the cover plate 3510 and the bottom face of the fourth portion 3926 of the central bore 3918 formed in the arbor 3504. Moreover, a second gap 4904 can be formed between the support hub 3912 of the arbor 3504 and the support hub 4506 of the cover plate 3510. In a particular embodiment, the first gap 4902 can include a gap height, $H_G$, and the second gap 4904 can include a gap height that is the same as $H_G$. Further, in a particular aspect, $H_G$ can be less than or equal to 2.5 mm. Further, $H_G$ can be less than or equal to 2.0 mm, such as less than or equal to 1.75 mm, less than or equal to 1.5 mm, or less than or equal to 1.25 mm. In another aspect, $H_G$ can be greater than or equal to 0.25 mm, such as greater than or equal to 0.5 mm, greater than or equal to 0.75 mm, or greater than or equal to 1.0 mm. It is to be understood that $H_G$ can be within a range between, and including, any of the values of $H_G$ described herein.

In another aspect, the grinding wheel assembly can have an overall diameter, $D_O$, and an overall height, $H_O$, and a ratio, $D_O$:$H_O$, can be less than or equal to 1.0. Further, $D_O$:$H_O$ can be less than or equal to 0.99, such as less than or equal to 0.98, less than or equal to 0.97, or less than or equal to 0.96. In another aspect, $D_O$:$H_O$ can be greater than or equal to 0.20, such as greater than or equal to 0.21, greater than or equal to 0.22, greater than or equal to 0.23, greater than or equal to 0.24, or greater than or equal to 0.25. It is to be understood that $D_O$:$H_O$ can be within a range between, and including, any of the maximum and minimum values of $D_O$:$H_O$ described herein.

Another Alternative Embodiment of Grinding Wheel Assembly

Figure 50:
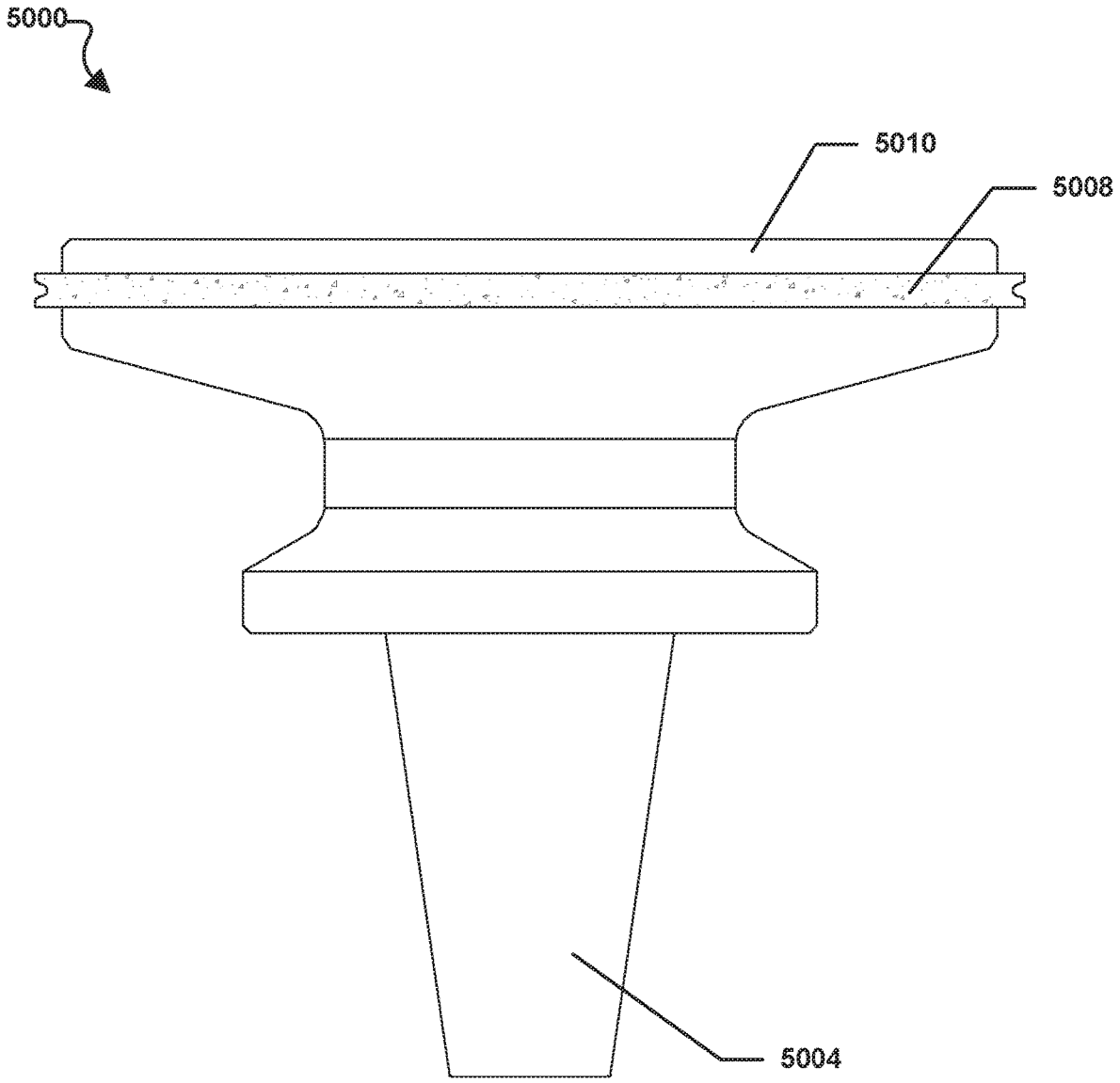
FIG. 50 includes an illustration of a side plan view of another grinding wheel assembly in accordance with an embodiment.
Figure 51:
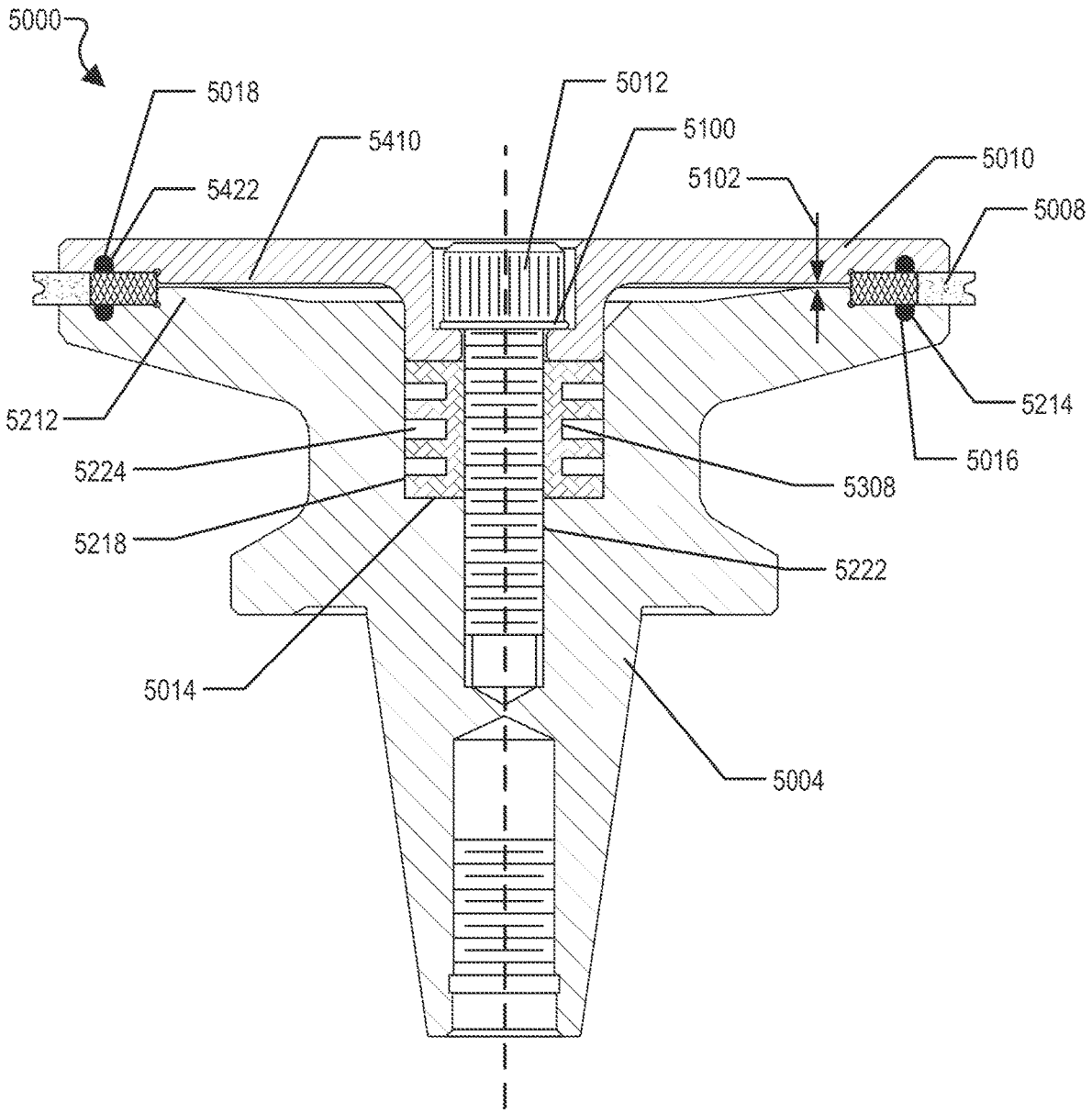
FIG. 51 includes an illustration of a cross-section view of a grinding wheel assembly in accordance with an embodiment.

Referring now to FIG. 50 and FIG. 51, another abrasive tool, i.e., a grinding wheel assembly is illustrated and is generally designated 5000. As shown, the grinding wheel assembly 5000 can include an arbor 5004, an abrasive article 5008, a cover plate 5010, and at least one fastener 5012, e.g., a threaded fastener. A socket head cap screw is illustrated in the FIGs., but it is to be understood that any other type of threaded fastener may be used. The arbor 5004 and the cover plate 5010 can include a metal or a metal alloy. For example, the metal can be stainless steel or titanium. Further, the metal can include a hardened metal, such as hardened steel. Additionally, the metal can be conductive.

It is to be understood that the material utilized for the arbor 5004 and the cover plate 5010 will minimize wearing of these elements during use. The abrasive article 5008, however, will wear during grinding operations performed on the edges of various workpieces. After the abrasive article 5008 is sufficiently worn, the abrasive article 5008 may be removed and replaced with a new abrasive body. Alternatively, the abrasive article 5008 may be removed and the outer periphery of the abrasive article 5008 may be reground, re-dressed, or re-profiled. Thereafter, the abrasive article 5008 may be reinstalled and used to perform further grinding operations. In another aspect, as described below, the entire grinding wheel assembly 5000 can be installed in an EDM and the abrasive article 5008 may be reground, re-dressed, or re-profiled.

FIG. 51 indicates that the grinding wheel assembly 5000 can further include a first resilient member 5014 that can be installed within the arbor 5004 of the grinding wheel assembly 5000, described in greater detail below. The first resilient member 5014 can be considered an internal resilient member because it is installed within the arbor 5004 of the grinding wheel assembly 5000. Moreover, the grinding wheel assembly 5000 can include a second resilient member 5016 and a third resilient member 5018 can be installed adjacent to the abrasive article 5008 within the mounting plate 5006 and the cover plate 5010, respectively. The second and third resilient members 5016, 5018 can be considered external resilient members because they are not installed within the arbor 5004 of the grinding wheel assembly 5000.

In a particular aspect, the resilient members 5014, 5016, 5018 can be a polymer. Further, the resilient members 5014, 5016, 5018 can be an elastomer. In another aspect, the resilient members 5014, 5016, 5018 comprise polychloroprene. Further, still the resilient members 5014, 5016, 5018 comprise a neoprene spring rubber and the neoprene spring rubber consists essentially of rubber, and more specifically, consists essentially of polychloroprene (e.g., neoprene). In another aspect, the resilient members 5014, 5016, 5018 can have a hardness of at least 50 as measured according to Shore A durometer. Moreover, the resilient members 5014, 5016, 5018 can have a hardness of at least 55, at least 60, at least 65, or at least 70. Further still the resilient members 5014, 5016, 5018 can have a hardness of not greater than 100, not greater than 90, not greater than 80, or not greater than 75.

Arbor

Figure 52:
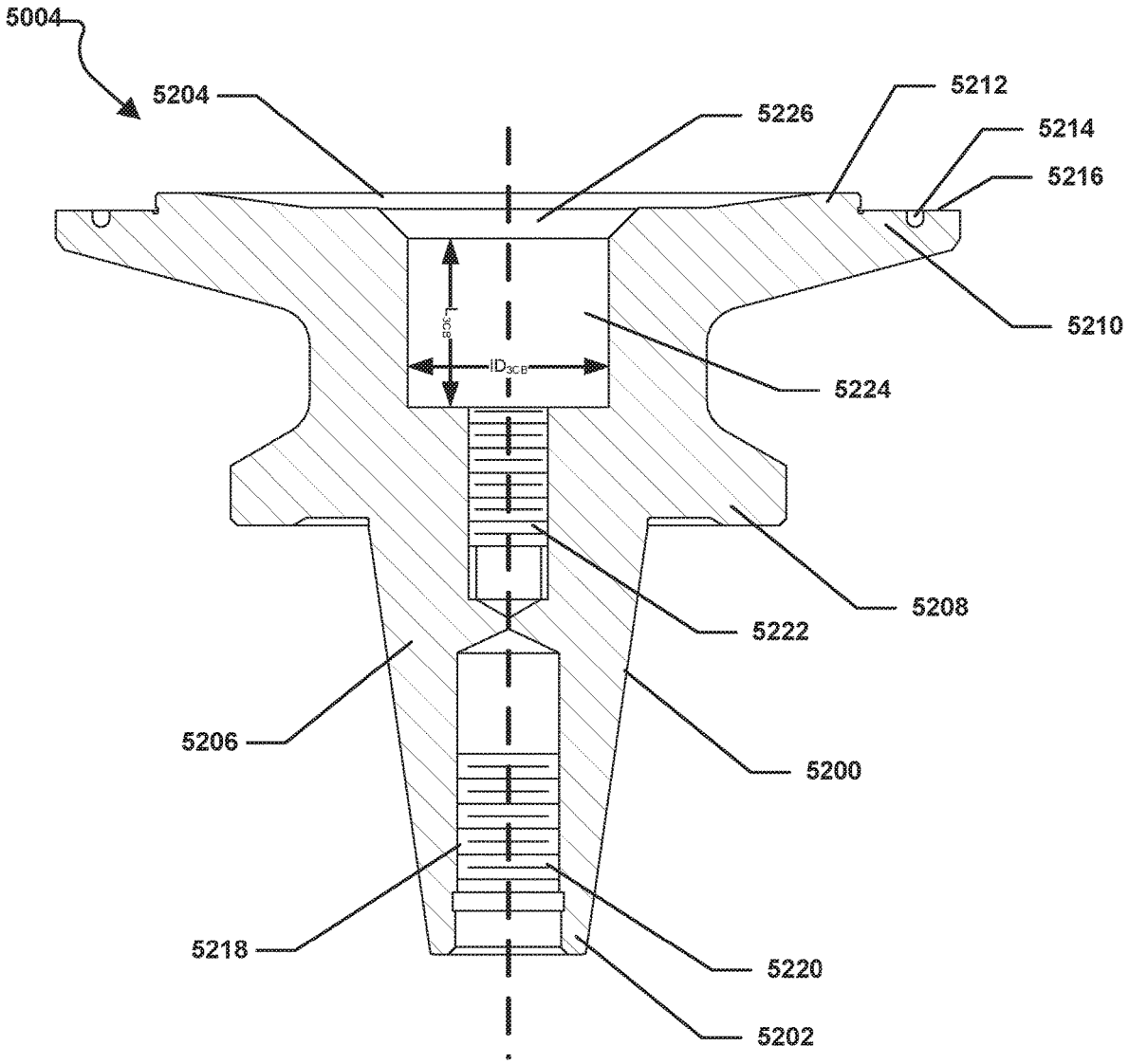
FIG. 52 includes an illustration of a cross-section view of an arbor for a grinding wheel assembly in accordance with an embodiment.

FIG. 52 illustrates the details of the arbor 5004. As shown, the arbor 5004 can include a body 5200 that can define a proximal end 5202 and a distal end 5204. The body 5200 of the arbor 5004 can include a generally frustoconical drive shaft 5206 that can extend from the proximal end 5202 of the body 5200 to a central flange 5208 that extends outwardly from the body 5200. Further, the body 5200 of the arbor 5004 can include a mounting plate 5210 that can extend radially outward from the body 5200 at, or near, the distal end 5204 of the body 5200 of the arbor 5004. In this aspect, the mounting plate 5210 is integrally formed with the arbor 5004. In other words, the mounting plate 5210 and the arbor 5004 are a single, continuous piece.

FIG. 52 indicates that the mounting plate 5210 can include a mounting hub 5212. The mounting hub 5212 can be generally cylindrical and can extend axially away from the distal end 5204 of the body 5200 of the arbor 5004, e.g., from a contact surface of the mounting plate 5210, wherein the contact surface of the mounting plate 5210 is configured to engage a portion of the abrasive article 5008 (FIG. 50) and the mounting hub 5212 is configured to receive the abrasive article 5008 (FIG. 50) there around. In a particular aspect, the mounting hub 5212 can be configured to receive and engage the abrasive article 5008 (FIG. 50) as described in greater detail herein. The arbor 5004 can also include a groove 5214 formed in an upper surface 5216 of the mounting plate 5210. The groove 5214 can circumscribe the mounting hub 5212 and can be sized and shaped to receive a resilient member, e.g., the second resilient member 5016 described above.

FIG. 41 indicates that the body 5200 of the arbor 5004 can also include a central bore 5218 extending from the proximal end 5202 of the body 5200 of the arbor 5004 to the distal end 5204 of the body 5200 of the arbor 5004 along the central axis 5216. The central bore 5218 can include a first portion 5220 adjacent to the proximal end 5202 of the body 5200. The first portion 5220 of the central bore 5218 can be formed with threads, i.e., screw threads, at least partially along the length of the first portion 5220 of central bore 5218. It can be appreciated that the first portion 5220 of the central bore 5218 can be configured to receive a pull stud (not shown in FIG. 41). More particularly, the first portion 5220 of the central bore 5218 can be configured to receive threads formed on the pull stud.

FIG. 41 further indicates that the central bore 5218 can include a second portion 5222 adjacent to the first portion 5220 of the central bore 5218. The second portion 5222 of the central bore 5218 can be a threaded bore that is sized and shaped to receive the fastener 5012. The central bore 5218 can further include a third portion 5224 adjacent to the second portion 5222 of the central bore 5218. The third portion 5224 of the central bore 5218 can be a smooth walled bore that can be sized and shaped to removably engage the first resilient member 5014, described above. As shown, the central bore 5218 can include a fourth portion 5226 adjacent to the third portion 5224. The fourth portion 5226 of the central bore 5218 can be an internal chamfer that circumscribes the upper edge of the third portion 5224 of the central bore 5218. In a particular aspect, the third portion 5224 of the central bore 5218 can also be sized and shaped to removably engage a central engagement hub of the cover plate 5010, described below. In a particular aspect, the central engagement hub of the cover plate 5010 can engage the third portion 5224 of the central bore 5218 in a slip fit arrangement.

In a particular aspect, the third portion 5224 of the central bore 5218 can have a length, $L_{3CB}$, measured from the bottom of the third portion 5224 of the central bore 5218 to the top of the third portion 5224 of the central bore 5218 and an inner diameter, $ID_{3CB}$. In one aspect, $L_{3CB}$, can be greater than or equal to 10 millimeters (mm). Further, $L_{3CB}$ can be greater than or equal to 11 mm, such as greater than or equal to 12 mm, greater than or equal to 13 mm, greater than or equal to 14 mm, greater than or equal to 15 mm, or greater than or equal to 16 mm. In another aspect, $L_{3CB}$ can be less than or equal to 50 mm, such as less than or equal to 30 mm, less than or equal to 25 mm, or less than or equal to 20 mm. It is to be understood that $L_{3CB}$ can be with a range between, and including, any of the values of $L_{3CB}$ described herein.

In another aspect, $ID_{3CB}$, can be greater than or equal to 20 millimeters (mm). Further, $ID_{3CB}$ can be greater than or equal to 21 mm, such as greater than or equal to 22 mm, greater than or equal to 23 mm, greater than or equal to 24 mm, or greater than or equal to 25 mm. In another aspect, $ID_{3CB}$ can be less than or equal to 40 mm, such as less than or equal to 50 mm, or less than or equal to 30 mm. It is to be understood that $ID_{3CB}$ can be with a range between, and including, any of the values of $ID_{3CB}$ described herein.

Resilient Member

FIG. 51 indicates that a resilient member 5014 that can be installed within the body 5200 of the arbor 5004. The resilient member 5014 can be considered a dampener, or dampening member, that acts on the fastener 5012 when the grinding wheel assembly 5000 is in the assembled state as described herein and used during grinding operations. A compressive force can be applied to the dampening member by the fastener 5012, via the cover plate 5010, when the grinding wheel assembly 5000 is in the assembled state. In a particular aspect, the resilient member 5014 can dampen vibrations that may emanate from a drive spindle of a tool that is used to drive the grinding wheel assembly 5000.

Figure 53:
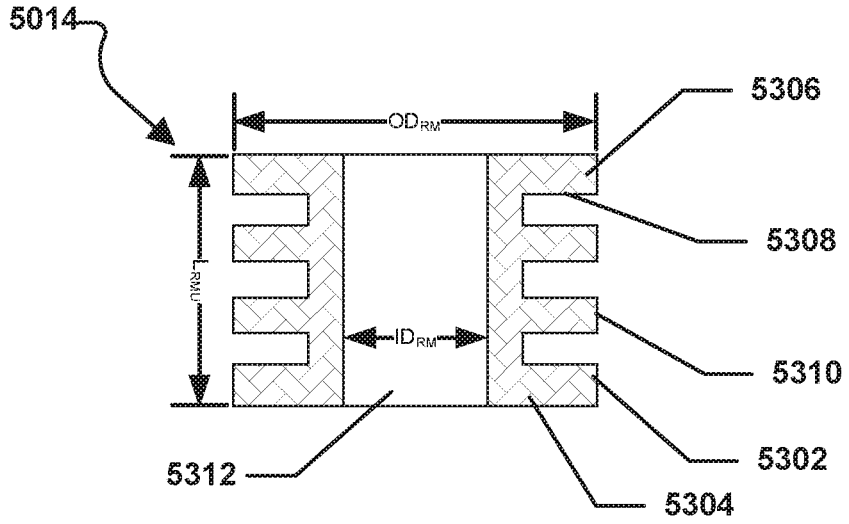
FIG. 53 includes an illustration of a cross-section view of a resilient member for a grinding wheel assembly in accordance with an embodiment.

As shown in FIG. 53, the resilient member 5014 can include a body 5302 having a proximal end 5304 and a distal end 5306. The resilient member 5014 can include a plurality of grooves 5308 formed in the body 5302. Specifically, the grooves 5308 can extend radially inward into the body 5302 of the resilient member 5014 from an outer sidewall 5310 of the body 5302. As illustrated, the body 5302 of the resilient member 5014 can be formed with three grooves 5308. However, it can be appreciated that the body 5302 of the resilient member 5014 can include one groove, two grooves, three grooves, four grooves, five grooves, six grooves, seven grooves, eight grooves, nine grooves, ten grooves, etc. In a particular aspect, the grooves 5308 form a castellated pattern, or structure, in the outer sidewall 5310 of the body 5302 and can allow the resilient member 5014 to be compressed around and onto the fastener 5012 when installed within the grinding wheel assembly 5000, as shown and described below.

In a particular aspect, the resilient member 5014 can include an uncompressed length, $L_{RMU}$, measured from the top of the resilient member 5014 to the bottom of the resilient member 5014 while the resilient member 5014 is in an unassembled state and not subjected to any external compressive forces, e.g., those that occur when the resilient member 5014 is installed within the grinding wheel assembly 5000 and the fastener 5012 that extends therethrough is threadably engaged with the arbor 5004. Further, the resilient member 5014 can be formed with an outer diameter, $OD_{RM}$, measured from the outer sidewall 910 to the outer sidewall 910 of the body 902 of the resilient member 5014 through the widest portion when the resilient member 5014 is not subjected to any external compressive forces. In one aspect, $L_{RMU}$, can be greater than or equal to 10 millimeters (mm). Further, $L_{RMU}$ can be greater than or equal to 11 mm, such as greater than or equal to 12 mm, greater than or equal to 13 mm, greater than or equal to 14 mm, greater than or equal to 15 mm, or greater than or equal to 16 mm. In another aspect, $L_{DCB}$ can be less than or equal to 50 mm, such as less than or equal to 30 mm, less than or equal to 25 mm, or less than or equal to 20 mm. It is to be understood that $L_{RMU}$ can be with a range between, and including, any of the values of $L_{RMU}$ described herein.

In another aspect, $OD_{RM}$, can be greater than or equal to 20 millimeters (mm). Further, $OD_{RM}$ can be greater than or equal to 21 mm, such as greater than or equal to 22 mm, greater than or equal to 23 mm, greater than or equal to 24 mm, or greater than or equal to 25 mm. In another aspect, $OD_{RM}$ can be less than or equal to 40 mm, such as less than or equal to 50 mm, or less than or equal to 30 mm. It is to be understood that $OD_{RM}$ can be with a range between, and including, any of the values of $OD_{RM}$ described herein.

In another aspect, the resilient member 5014 can also have a compressed length $L_{RMC}$, measured from the top of the resilient member 5014 to the bottom of the resilient member 5014 when installed within a grinding wheel assembly 5000, as illustrated in FIG. 51, and compressed by the cover plate 5010 and the fastener 5012 when the fastener 5012 is threaded into the second portion 5222 of the central bore 5218 formed in the body 5200 of the arbor 5004. In one aspect, $L_{RMC}$ can be less than or equal to 99% $L_{RMU}$. Further, $L_{RMC}$ can be less than or equal to 98% $L_{RMU}$, such as less than or equal to 97% $L_{RMU}$, less than or equal to 96% $L_{RMU}$, or less than or equal to 95% $L_{RMU}$. In another aspect, $L_{RMC}$ can be greater than or equal to 90% $L_{RMU}$, such as greater than or equal to 91% $L_{RMU}$, greater than or equal to 92% $L_{RMU}$, greater than or equal to 93% $L_{RMU}$, greater than or equal to 94% $L_{RMU}$, or greater than or equal to 95% $L_{RMU}$. It is to be understood that $L_{RMC}$ can be within a range between and including any of the minimum and maximum values of $L_{RMC}$ described herein.

In another aspect, $L_{RMU}$ can be greater than $L_{3CB}$. For example, $L_{RMU}$ can be greater than or equal to 101% $L_{3CB}$. Moreover, $L_{RMU}$ can be greater than or equal to 102% $L_{3CB}$, such as greater than or equal to 103% $L_{3CB}$, greater than or equal to 104% $L_{3CB}$, or greater than or equal to 105% $L_{3CB}$. Further, $L_{RMU}$ can be less than or equal to 125% $L_{3CB}$, such as less than or equal to 120% $L_{3CB}$, less than or equal to 115% $L_{3CB}$, or less than or equal to 110% $L_{3CB}$.

FIG. 53 shows that the resilient member 5014 can also include a central bore 5312 formed along the length of the body 5302 of the resilient member 5014 from the distal end 5304 of the body 5302 of the resilient member 5014 to the proximal end 5306 of the body 5302 of the resilient member 5014 and circumscribed by an inner sidewall 5314. As illustrated, the central bore 5312 of the body 5302 of the resilient member 5014 can have an inner diameter, $ID_{RM}$, measured from the inner sidewall 5314 to the inner sidewall 5314 through the largest width of the central bore 5312 of the body 5302 when the resilient member 5014 is not subjected to any external compressive forces. To allow the fastener 5012 to pass through the resilient member 5014 during installation, but still allow the resilient member 5014 to engage the fastener 5012 when compressed by the cover plate 5010 and the fastener 5012, the $ID_{RM}$ can be slightly larger than the outer diameter of the fastener 5012, $OD_F$. For example, $ID_{RM}$ can be greater than or equal to 1.01 $OD_F$. Further, $ID_{RM}$ can be greater than or equal to 1.02 $OD_F$, such as greater than or equal to 1.03 $OD_F$, greater than or equal to 1.04 $OD_F$, greater than or equal to 1.05 $OD_F$, or greater than or equal to 1.06 $OD_F$. In another aspect, $ID_{RM}$ can be less than or equal to 1.10 $OD_F$, such as less than or equal to 1.09 $OD_F$, less than or equal to 1.08 $OD_F$, or less than or equal to 1.07 $OD_F$. It is to be understood that $ID_{RM}$ can be within a range between, and including, any of the minimum and maximum values of $ID_{RM}$ disclosed herein.

In another aspect, the resilient member 5014 can have an uncompressed outer diameter, $OD_{RMU}$, and $OD_{RMU}$ can be less than $ID_{3CB}$. For example, $OD_{RMU}$ can be less than or equal to 99.9% $ID_{3CB}$. Further, $OD_{RMU}$ can be less than or equal to 99.8% $ID_{3CB}$, such as less than or equal to 99.7% $ID_{3CB}$, less than or equal to 99.6% $ID_{3CB}$, or less than or equal to 99.5% $ID_{3CB}$. In another aspect, $OD_{RMU}$ can be greater than or equal to 99.0% $ID_{3CB}$, such as greater than or equal to 99.1% $ID_{3CB}$, greater than or equal to 99.2% $ID_{3CB}$, greater than or equal to 99.3% $ID_{3CB}$, or greater than or equal to 99.4% $ID_{3CB}$. It is to be understood that $OD_{RMU}$ can be within a range between, and including, any of the maximum and minimum values of $OD_{RMU}$ disclosed herein.

Cover Plate

Figure 54:
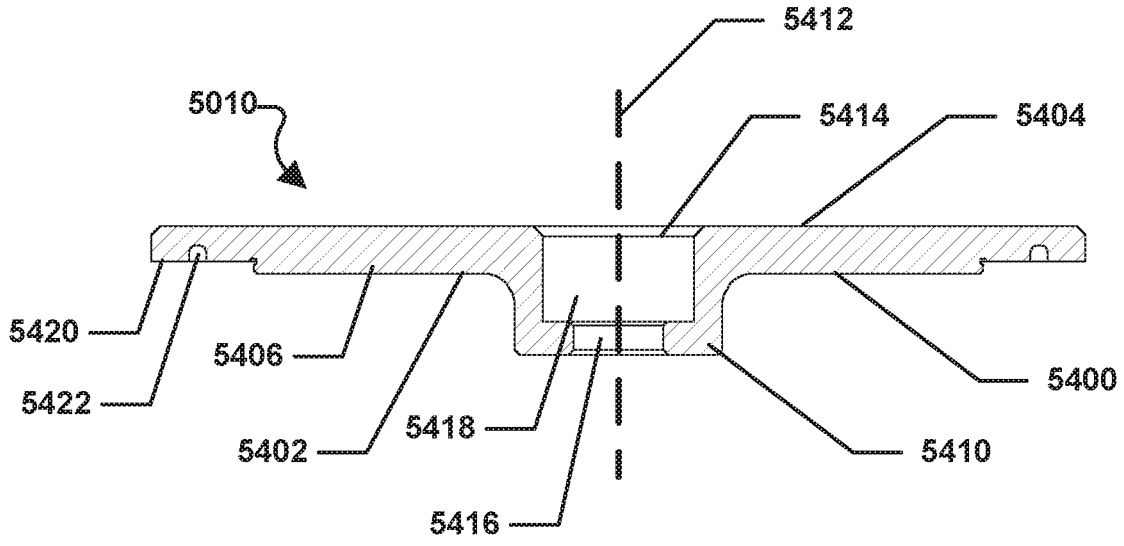
FIG. 54 includes an illustration of a cross-section view of a cover plate for a grinding wheel assembly in accordance with an embodiment.

FIG. 54 illustrates the details concerning the construction of the cover plate 5010. The cover plate 5010 can include a body 5400 that is generally disk-shaped. Further, the body 5400 of the cover plate 5010 can include a proximal surface 5402 and a distal surface 5404. A generally cylindrical support hub 5406 can extend outwardly from the proximal surface 5402, in a downward direction, as indicated in FIG. 54 and FIG. 46. The support hub 5406 is configured to extend into and support the abrasive article 5008 when the grinding wheel assembly 5000 is assembled as shown in FIG. 50 and FIG. 49.

FIG. 54 further shows that the cover plate 5010 can include a central engagement hub 5410 extending outwardly, in a downward direction, from the support hub 5406 along a central axis 5412. As shown in greater detail in FIG. 51, the engagement hub 5410 of the cover plate 5010, when installed in the grinding wheel assembly 5000, can extend through the abrasive article 5008 and into the third portion 5224 of the central bore 5218 formed in the body 5200 of the arbor 5004.

Returning to FIG. 54, the cover plate 5010 can also include a central bore 5414 that extends through the cover plate 5010, i.e., the body 5400 of the cover plate 5010, the support hub 5406, and the engagement hub 5410, along the central axis 5412. The central bore 5414 can include a proximal portion 5416 that is sized and shaped to allow the fastener 5012 to pass therethrough. Further, the central bore 5414 can include a distal portion 5418 that is sized and shaped to receive the head of the fastener 5012, as shown in greater detail in FIG. 51.

FIG. 54 further illustrates that the cover plate 5010 can include a central surface 5420 around the support hub 5406. The central surface 5420 can be substantially perpendicular to the central axis 5412. A groove 5422 can be formed in the central surface 5420 such that the groove 5422 circumscribes the support hub 5406 of the cover plate 5010. The groove 5422 can be generally semi-circular in cross-section and the groove 5422 can be configured to receive the third resilient member 5016 as shown in greater detail below.

Assembled Grinding Wheel Assembly

Referring back to FIG. 51, the grinding wheel assembly 5000 is shown in an assembled state. As shown in FIG. 51, the second resilient member 5016 can fit into the groove 5214 formed in the mounting plate 5210 of the arbor 5004 and the abrasive article 5008 can fit on the mounting plate 5210 of the arbor 5004 around the mounting hub 5212 and adjacent to the second resilient member 5016. The abrasive article 5008 can engage the mounting hub 5212 of the arbor 5004 in a slip fit so that the abrasive article 5008 can be relatively easily installed and removed from the arbor 5004 and the grinding wheel assembly 5000.

FIG. 51 shows that the first resilient member 5014 can be installed within the arbor 5004 of the grinding wheel assembly 5000. Specifically, the first resilient member 5014 can be installed within the third portion 5224 of the central bore 5218 formed in the body 5200 of the arbor 5004. Moreover, the first resilient member 5014 can be installed within the third portion 5224 of the central bore 5218 prior to the installation of the second resilient member 5016 and the abrasive article 5008. Alternatively, the first resilient member 5014 can be installed after the second resilient member 5016 and the abrasive article 5008.

After the second resilient member 5016, the abrasive article 5008, and the resilient member 5014 are installed, as described above, the cover plate 5010 with the third resilient member 5018 installed therein can be installed on the arbor 5004 so that the central engagement hub 5410 of the cover plate 5010 extends through the abrasive article 5008 and into the third portion 5224 of the central bore 5218 formed in the body 5200 of the arbor 5004. Thereafter, the fastener 5012 can be installed and tightened. Specifically, the third resilient member 5018 can be installed in the groove 5422 formed in the cover plate 5010. Further, the fastener 5012 can be installed within the grinding wheel assembly 5000 as illustrated in FIG. 51 and the fastener 5012, i.e., the shank of the fastener, can extend through the central bore 5414 formed in the cover plate 5000 and the central bore 5312 formed in the resilient member 5014. Further, a portion of the threaded shank of the fastener 5012 can engage the threads formed in the second portion 5222 of the central bore 5218 formed in the body 5200 of the arbor 5004. As the fastener 5012 is tightened, the central engagement hub 5410 of the cover plate 5010 can be drawn, or otherwise pulled, further into the arbor 5004, i.e., further into the third portion 5224 of the central bore 5218 of the body 5200 of the arbor 5004.

As the fastener 5012 is tightened and the central engagement hub 5410 moves further into the arbor 5004, the resilient member 5014 can be compressed, i.e., by a compressive force provided by the fastener, so that the length of the resilient member 5014 is reduced. Specifically, the castellated pattern, or structure, formed by the grooves 5308 in the outer sidewall 4210 of the resilient member 5014 and the elastomeric material of the resilient member 5014 can allow the resilient member 5014 to be compressed, thereby reducing the overall length of the resilient member 5014 to one of the values of $L_{RMC}$ as described above. Further, the second and third resilient members 5016, 5018 adjacent to, or flanking, the abrasive article 5008 can also be slightly compressed so that the cross-sectional shape of the second and third resilient members 5016, 5018 changes from a circular shape to an elliptical shape. The mounting plate 5006 in conjunction with the cover plate 5010 and the fastener 5012 can hold the abrasive article 5008 in place within the grinding wheel assembly 5010. The second and third resilient members 5016, 5018 also help provide support for the abrasive article 5008 and the abrasive article 5008 can be keyed to the mounting plate 5210 of the arbor 5004, the cover plate 5010, or both the mounting plate 5210 of the arbor and the cover plate 5010 to prevent the abrasive article 5008 from spinning with respect to the arbor 5004.

The resilient members 5014, 5016, 5018 can substantially reduce vibration of the grinding wheel assembly 5000 during use. More specifically, the resilient member 5014, installed within the arbor 5004, as described herein, can facilitate vibration dampening through the center of the grinding wheel assembly 5000 and can act as a compressible object to ensure proper coupling of the various components of the grinding wheel assembly 5000. The single central fastener 5012 simplifies assembly and disassembly of the grinding wheel assembly 5000 and provides a compressive force, when properly tightened, on the resilient member 5014 to ensure proper assembly and engagement of the resilient member 5014 for vibration dampening.

As shown in FIG. 51, the grinding wheel assembly 5000 can also include a spring washer 5100 installed between the central fastener 5012 and the cover plate 5010. Moreover, when the grinding wheel assembly 5000 is properly assembled a gap 5102 can be formed between the central engagement hub 5410 of the cover plate 5010 and the mounting hub 5212 of the arbor 5004. In a particular embodiment, the gap 5100 can include a gap height, $H_G$. Further, in a particular aspect, $H_G$ can be less than or equal to 2.5 mm. Further, $H_G$ can be less than or equal to 2.0 mm, such as less than or equal to 1.75 mm, less than or equal to 1.5 mm, less than or equal to 1.25 mm, less than or equal to 1.0 mm, less than or equal to 0.75 mm, or less than or equal to 0.5 mm. In another aspect, $H_G$ can be greater than or equal to 0.05 mm, such as greater than or equal to 0.10 mm, greater than or equal to 0.15 mm, greater than or equal to 0.2 mm, greater than or equal to 0.25 mm, greater than or equal to 0.3 mm, greater than or equal to 0.35 mm, greater than or equal to 0.4 mm, or greater than or equal to 0.45 mm. It is to be understood that $H_G$ can be within a range between, and including, any of the values of $H_G$ described herein.

In another aspect, the grinding wheel assembly 5000 can have an overall diameter, $D_O$, and an overall height, $H_O$, and a ratio, $D_O$:$H_O$, can be less than or equal to 1.0. Further, $D_O$:$H_O$ can be less than or equal to 0.99, such as less than or equal to 0.98, less than or equal to 0.97, or less than or equal to 0.96. In another aspect, $D_O$:$H_O$ can be greater than or equal to 0.20, such as greater than or equal to 0.21, greater than or equal to 0.22, greater than or equal to 0.23, greater than or equal to 0.24, or greater than or equal to 0.25. It is to be understood that $D_O$:$H_O$ can be within a range between, and including, any of the maximum and minimum values of $D_O$:$H_O$ described herein.

Method of Grinding a Workpiece

Figure 55:
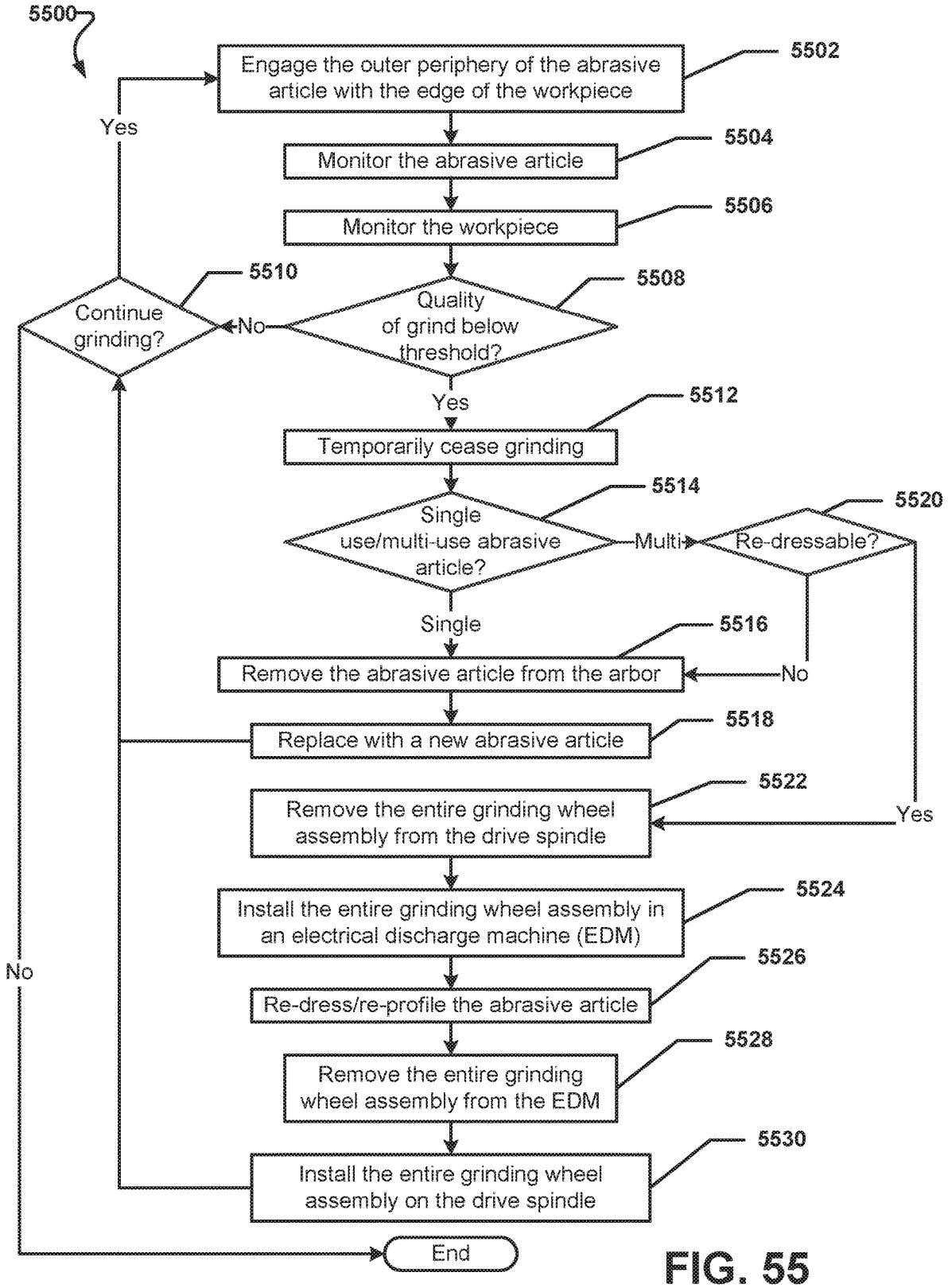
FIG. 55 includes an illustration of a flow chart depicting a method of grinding a workpiece with a grinding wheel assembly in accordance with an embodiment.

Referring now to FIG. 55, a method of grinding a workpiece with a grinding wheel assembly is illustrated and is generally designated 5500. Commencing at step 5502, the method 5500 can include engaging the outer periphery of an abrasive article with an edge of a workpiece. At step 5504, the method 5500 can include monitoring the abrasive article. Further, at step 5506, the method 5500 can include monitoring the workpiece. Moving to step 5508, the method 5500 can include determining whether the quality of the grind has fallen below a predetermined threshold. That determination can be based on the ability of the abrasive article to continue to properly grind the workpiece and can be made by a user or operator. If the quality of the grind does not fall below the threshold, the method 5500 can continue to step 5510. At step 5510, the method 5500 can include determining whether to continue grinding. If so, the method 5500 can return to step 5502 and the method 5500 can continue as described herein. Otherwise, at step 5510, if it is determined to not continue to grind, the method 5500 can end.

Returning to step 5508, if the quality of the grind falls below the threshold, the method 5500 can proceed to step 5512 and the method 5500 can include temporarily ceasing the grinding operation. Then, at step 5514, the method 5500 can include determining whether the abrasive article is a single use abrasive article or a multi-use abrasive article. If the abrasive article is a single use abrasive article, the method 5500 may proceed to step 5516. At step 5516, the method 550 can include removing the abrasive article from the arbor. Moreover, at step 5518, the method 550 can include replacing with a new abrasive article. The method 5500 can then proceed to step 5510 and continue as described herein.

Returning to step 5514, if the abrasive article is a multi-use abrasive article, the method 5500 can continue to step 5520. At step 5520, the method 5500 can include determining whether the abrasive article is re-dressable. For example, the abrasive article may not be re-dressable if it has previously been re-dressed. If the abrasive article is not re-dressable, the method 5500 may proceed to step 5516 and the method 5500 can continue as described herein. Conversely, if the abrasive article is re-dressable, the method 5500 can move to step 5522. At step 5522, the method can include removing the entire grinding wheel assembly from the drive spindle. At step 5524, the method 5500 can include installing the entire grinding wheel assembly in an electrical discharge machine (EDM). Thereafter, at step 5526, the method 5500 can include re-dressing and/or re-profiling the abrasive article. At step 5528, the method 5500 can include removing the entire grinding wheel assembly from the EDM. Further, at step 5530, the method 5500 can include installing, or re-installing, the entire grinding wheel assembly on the drive spindle. Then, the method 5500 can continue to step 5510. At step 5510, as previously stated, the method 5500 can include determining whether to continue grinding. If so, the method 5500 can return to step 5502 and the method 5500 can continue as described herein. Otherwise, at step 5510, if it is determined to not continue to grind, the method 5500 can end.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

EMBODIMENTS

Embodiment 1

An abrasive tool comprising:
an arbor having a body formed with an internal bore;
a mounting plate on the arbor;
a cover plate;
an abrasive article disposed between the mounting plate and the cover plate; and
at least one internal resilient member disposed within the internal bore of the arbor.

Embodiment 2

An abrasive tool comprising:
an arbor having a body formed with an internal bore;
a mounting plate on the arbor;
a cover plate having a hub extending therefrom, wherein the hub extends at least partially into the internal bore of the hub;
an abrasive article disposed between the mounting plate and the cover plate; and
at least one internal resilient member disposed within the internal bore of the arbor.

Embodiment 3

An abrasive tool comprising:
an arbor having a body formed with an internal bore;
a mounting plate on the arbor;
an abrasive article disposed on the mounting plate;
at least one internal resilient member disposed within the internal bore of the arbor; and
a cover plate disposed on the abrasive article opposite the mounting plate, the cover plate having a hub extending therefrom, wherein the hub extends through the abrasive article and the mounting plate and at least partially into the internal bore of the arbor.

Embodiment 4

An abrasive tool comprising:
an arbor having a body formed with an internal bore;
a mounting plate on the arbor;
a cover plate disposed on the arbor;
an abrasive article disposed on the arbor between the mounting plate and a cover plate; and
an internal resilient member disposed within the arbor and spaced a distance from the abrasive article, wherein the internal resilient member is configured to be compressed within the arbor by a fastener that is threadably engaged with the arbor.

Embodiment 5

The abrasive tool according to any of embodiments 1, 2, 3, or 4, further comprising:
a single fastener extending through the cover plate and into the arbor.

Embodiment 6

The abrasive tool according to embodiment 5, wherein the single fastener extends through the cover plate, the abrasive article and the mounting plate.

Embodiment 7

The abrasive tool according to embodiment 6, wherein the single fastener is configured to be threadably engaged with the arbor.

Embodiment 8

The abrasive tool according to any of embodiments 1, 2, 3, or 4, wherein the cover plate is configured to compress the at least one internal resilient member.

Embodiment 9

The abrasive tool according to embodiment 8, wherein the at least one internal resilient member has an uncompressed length, $L_{RMU}$, when the abrasive tool is in an unassembled stated and a compressed length, $L_{RMC}$, when the abrasive tool is in an assembled state and $L_{RMC}$ is less than or equal to 99% $L_{RMU}$.

Embodiment 10

The abrasive tool according to embodiment 9, wherein $L_{RMC}$ is less than or equal to 98% $L_{RMU}$, such as less than or equal to 97% $L_{RMU}$, less than or equal to 96% $L_{RMU}$, or less than or equal to 95% $L_{RMU}$.

Embodiment 11

The abrasive tool according to embodiment 10, wherein $L_{RMC}$ is greater than or equal to 90% $L_{RMU}$, such as greater than or equal to 91% $L_{RMU}$, greater than or equal to 92% $L_{RMU}$, greater than or equal to 93% $L_{RMU}$, greater than or equal to 94% $L_{RMU}$, or greater than or equal to 95% $L_{RMU}$.

Embodiment 12

The abrasive tool according to embodiment 5, wherein the single fastener includes an outer diameter, $OD_F$, and the at least one resilient member includes an inner diameter, $ID_{RM}$, and $ID_{RM}$ is greater than or equal to 1.01 $OD_F$.

Embodiment 13

The abrasive tool according to embodiment 12, wherein $ID_{RM}$ is greater than or equal to 1.02 $OD_F$, such as greater than or equal to 1.03 $OD_F$, greater than or equal to 1.04 $OD_F$, greater than or equal to 1.05 $OD_F$, or greater than or equal to 1.06 $OD_F$.

Embodiment 14

The abrasive tool according to embodiment 12, wherein $ID_{RM}$ is less than or equal to 1.10 $OD_F$, such as less than or equal to 1.09 $OD_F$, less than or equal to 1.08 $OD_F$, or less than or equal to 1.07 $OD_F$.

Embodiment 15

The abrasive tool according to any of embodiments 1, 2, 3, or 4, wherein the at least one resilient member has a length, $L_{RMU}$, and the internal bore of the arbor has a length, $L_{DCB}$, and $L_{RMU}$ is less than $L_{DCB}$.

Embodiment 16

The abrasive tool according to embodiment 15, wherein $L_{RMU}$ is less than or equal to 90% $L_{DCB}$.

Embodiment 17

The abrasive tool according to embodiment 16, wherein $L_{RMU}$ is less than or equal to 85% $L_{DCB}$, such as less than or equal to 80% $L_{DCB}$, less than or equal to 75% $L_{DCB}$, or less than or equal to 70% $L_{DCB}$.

Embodiment 18

The abrasive tool according to embodiment 17, wherein $L_{RMU}$ is greater than or equal to 50% $L_{DCB}$, such as greater than or equal to 55% $L_{DCB}$, greater than or equal to 60% $L_{DCB}$, or greater than or equal to 65% $L_{DCB}$.

Embodiment 19

The abrasive tool according to any of embodiments 1, 2, 3, or 4, wherein the internal resilient member comprises a body having an outer surface and at least one groove is formed in the outer surface of the body.

Embodiment 20

The abrasive tool according to any of embodiments 1, 2, 3, or 4, wherein the internal resilient member comprises a body having an outer surface and a plurality of grooves are formed in the outer surface of the body.

Embodiment 21

The abrasive tool according to embodiment 20, wherein the plurality of grooves form a castellated pattern in the outer surface of the internal resilient member.

Embodiment 22

The abrasive tool according to any of embodiments 1, 2, 3, or 4, wherein the internal resilient member comprises a polymer.

Embodiment 23

The abrasive tool according to embodiment 22, wherein the internal resilient member comprises an elastomer.

Embodiment 24

The abrasive tool according to embodiment 23, wherein the internal resilient member comprises polychloroprene.

Embodiment 25

The abrasive tool according to embodiment 24, wherein the internal resilient member comprises a neoprene spring rubber.

Embodiment 26

The abrasive tool according to embodiment 25, wherein the internal resilient member has a hardness of at least 50 as measured according to Shore A durometer.

Embodiment 27

The abrasive tool according to embodiment 26, wherein the internal resilient member has a hardness of at least 55, at least 60, at least 65, or at least 70.

Embodiment 28

The abrasive tool according to embodiment 27, wherein the internal resilient member has a hardness of not greater than 100, not greater than 90, not greater than 80, or not greater than 75.

Embodiment 29

The abrasive tool according to any of embodiments 1, 2, 3, or 4, wherein the mounting plate comprises an internal bore and the abrasive tool further comprises at least a second resilient member at least partially disposed within the internal bore of the mounting plate.

Embodiment 30

The abrasive tool according to embodiment 29, wherein the second resilient member comprises a distal surface having an angled portion.

Embodiment 31

The abrasive tool according to embodiment 30, wherein the angled portion of the distal surface of the second resilient member is configured to engage a complementary shaped surface on the cover plate.

Embodiment 32

The abrasive tool according to embodiment 31, wherein the cover plate is configured to engage the second resilient member and bias the second resilient member radially outward when the abrasive tool is assembled.

Embodiment 33

The abrasive tool according to embodiment 29, wherein the second resilient member includes a central bore and at least one offset bore offset from a center of the second resilient member.

Embodiment 34

The abrasive tool according to embodiment 33, wherein the second resilient member has an outer diameter, $OD_{RM}$, the offset bore has an inner diameter, $ID_{OB}$, and $ID_{OB}$ is greater than or equal to 1% $OD_{RM}$.

Embodiment 35

The abrasive tool according to embodiment 34, wherein $ID_{OB}$ is greater than or equal to 2% $OD_{RM}$, such as greater than or equal to 3% $OD_{RM}$, greater than or equal to 4% $OD_{RM}$, or greater than or equal to 5% $OD_{RM}$.

Embodiment 36

The abrasive tool according to embodiment 35, wherein $ID_{OB}$ is less than or equal to 20% $OD_{RM}$, such as less than or equal to 15% $OD_{RM}$, less than or equal to 10% $OD_{RM}$, or less than or equal to 7.5% $OD_{RM}$.

Embodiment 37

The abrasive tool according to any of embodiments 1, 2, 3, or 4, wherein the at least one internal first resilient member comprises an uncompressed outer diameter, $OD_{RMU}$, the inner bore comprises an inner diameter $ID_{DCB}$ and $OD_{RMU}$ is less than $ID_{DCB}$.

Embodiment 38

The abrasive tool according to embodiment 37, wherein $OD_{RMU}$ is less than or equal to 99.9% $ID_{DCB}$.

Embodiment 39

The abrasive tool according to embodiment 38, wherein $OD_{RMU}$ is less than or equal to 99.8% $ID_{DCB}$, such as less than or equal to 99.7% $ID_{DCB}$, less than or equal to 99.6% $ID_{DCB}$, or less than or equal to 99.5% $ID_{DCB}$.

Embodiment 40

The abrasive tool according to embodiment 39, wherein $OD_{RMU}$ is greater than or equal to 99.0% $ID_{DCB}$, such as greater than or equal to 99.1% $ID_{DCB}$, greater than or equal to 99.2% $ID_{DCB}$, greater than or equal to 99.3% $ID_{DCB}$, or greater than or equal to 99.4% $ID_{DCB}$.

Embodiment 41

The abrasive tool according to any of embodiments 1, 2, 3, or 4, wherein the mounting plate is integrally formed with the arbor.

Embodiment 42

The abrasive tool according to any of embodiments 1, 2, 3, or 4, wherein the mounting plate and the arbor are a single, continuous piece.

Embodiment 43

The abrasive tool according to any of embodiments 1, 2, 3, or 4, wherein the at least one resilient member has a length, LRMU, and the internal bore of the arbor has a length, LDCB, and LRMU is greater than LDCB.

Embodiment 44

The abrasive tool according to embodiment 43, wherein LRMU is greater than or equal to 101% LDCB.

Embodiment 45

The abrasive tool according to embodiment 44, wherein LRMU is greater than or equal to 102% LDCB, such as greater than or equal to 103% LDCB, greater than or equal to 104% LDCB, or greater than or equal to 105% LDCB.

Embodiment 46

The abrasive tool according to embodiment 45, wherein LRMU is less than or equal to 125% LDCB, such as less than or equal to 120% LDCB, less than or equal to 115% LDCB, or less than or equal to 110% LDCB.

Embodiment 47

The abrasive tool according to any of embodiments 1, 2, 3, or 4, wherein the mounting plate is removably engaged with the arbor.

Embodiment 48

A method of performing a grinding operation with a grinding wheel assembly, the method comprising:

installing the entire grinding wheel assembly in an electrical discharge machine (EDM); and re-dressing an abrasive article installed in the grinding wheel assembly.

Embodiment 49

The method of embodiment 48, further comprising: re-profiling the abrasive article.

Embodiment 50

The method of embodiment 49, further comprising: removing the entire grinding wheel assembly from the EDM.

Embodiment 51

The method of embodiment 50, further comprising: installing the entire grinding wheel assembly on a drive spindle.

Embodiment 52

The abrasive tool according to any of embodiments 1, 2, 3, or 4, wherein the abrasive tool has an overall diameter, $D_O$, and an overall height, $H_O$, and a ratio, $D_O$:$H_O$, is less than or equal to 1.0.

Embodiment 53

The abrasive tool of embodiment 52, wherein $D_O$:$H_O$ is less than or equal to 0.99, such as less than or equal to 0.98, less than or equal to 0.97, or less than or equal to 0.96.

Embodiment 54

The abrasive tool of embodiment 53, wherein $D_O$:$H_O$ is greater than or equal to 0.20, such as greater than or equal to 0.21, greater than or equal to 0.22, greater than or equal to 0.23, greater than or equal to 0.24, or greater than or equal to 0.25.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An abrasive tool comprising:

an arbor having a body formed with an internal bore;

a mounting plate on the arbor;

a cover plate comprising an engagement hub, wherein the engagement hub extends at least partially into the internal bore of the arbor;

an abrasive article disposed between the mounting plate and the cover plate;

a single fastener extending through the cover plate and into the arbor, wherein the at least one internal resilient member is compressed around the single fastener in the assembled state; and at least one internal resilient member disposed within the internal bore of the arbor, wherein the single fastener is configured to be threadably engaged with the arbor, wherein the mounting plate comprises a mounting hub and the abrasive body comprises a central bore, wherein the mounting hub fits into the central bore of the abrasive body; and wherein the engagement hub extends through the abrasive article and the mounting plate.

2. The abrasive tool of claim 1, wherein the single fastener extends through the cover plate, the abrasive article and the mounting plate.

3. The abrasive tool of claim 1, wherein the cover plate is configured to compress the at least one internal resilient member.

4. The abrasive tool of claim 1, wherein the cover plate comprises a support hub and the abrasive body comprises a central bore, wherein the support hub fits into the central bore of the abrasive body.

5. The abrasive tool of claim 1, wherein a second resilient member is spaced apart from the abrasive article.

6. The abrasive tool of claim 1, wherein a second resilient member flanks the abrasive article.

7. The abrasive tool of claim 1, wherein the arbor comprises a groove formed in an upper surface of the mounting plate.

8. An abrasive tool comprising:

an arbor having a body formed with an internal bore;

a mounting plate on the arbor;

a cover plate having an engagement hub extending therefrom, wherein the engagement hub extends at least partially into the internal bore of the arbor;

an abrasive article disposed between the mounting plate and the cover plate;

a single fastener extending through the cover plate and into the arbor;

at least one internal resilient member disposed within the internal bore of the arbor, wherein the at least one internal resilient member is compressed around the single fastener in the assembled state, wherein the single fastener is configured to be threadably engaged with the arbor, and wherein the mounting plate comprises a mounting hub and the abrasive body comprises a central bore, wherein the mounting hub fits into the central bore of the abrasive body.

9. The abrasive tool of claim 8, wherein the at least one internal resilient member has a length, $L_{RMU}$, and the internal bore of the arbor has a length, $L_{DCB}$, and $L_{RMU}$ is less than $L_{DCB}$.

10. The abrasive tool of claim 9, wherein $L_{RMU}$ is less than or equal to 90% $L_{DCB}$.

11. The abrasive tool of claim 8, wherein the at least one internal resilient member comprises a body having an outer surface and a plurality of grooves are formed in the outer surface of the body.

12. The abrasive tool of claim 11, wherein the plurality of grooves form a castellated pattern in the outer surface of the at least one internal resilient member.

13. The abrasive tool of claim 8, wherein the at least one internal resilient member comprises a polymer.

14. The abrasive tool of claim 13, wherein the polymer comprises an elastomer.

15. The abrasive tool of claim 8, wherein the at least one internal resilient member has a hardness of at least 50 as measured according to Shore A durometer.

16. An abrasive tool comprising:

an arbor having a body formed with an internal bore;

a mounting plate on the arbor;

a cover plate disposed on the arbor, wherein the cover plate has an engagement hub extending therefrom, and wherein the engagement hub extends at least partially into the internal bore of the arbor;

an abrasive article disposed on the arbor between the mounting plate and the cover plate;

an internal resilient member disposed within the arbor and spaced a distance from the abrasive article, wherein the at least at least one internal resilient member is compressed around a single fastener in the assembled state, wherein the internal resilient member is configured to be compressed within the arbor by the single fastener that is threadably engaged with the arbor and wherein the internal resilient member comprises a plurality of grooves ; and wherein the mounting plate comprises a mounting hub and the abrasive body comprises a central bore, wherein the mounting hub fits into the central bore of the abrasive body.

17. The abrasive tool of claim 16, wherein the mounting plate is integrally formed with the arbor.

18. The abrasive tool of claim 16, wherein the mounting plate and the arbor are a single, continuous piece.

19. The abrasive tool of claim 16, wherein the resilient member has a length, $L_{RMU}$, and the internal bore of the arbor has a length, $L_{DCB}$, and $L_{RMU}$ is greater than $L_{DCB}$.

20. The abrasive tool of claim 16, wherein the mounting plate is removably engaged with the arbor.

* * * * *